US009902608B2

(12) United States Patent
Taylor

(10) Patent No.: US 9,902,608 B2
(45) Date of Patent: Feb. 27, 2018

(54) SAFETY DEVICE FOR REINS

(71) Applicant: Daniel Peter Taylor, East Windsor, NJ (US)

(72) Inventor: Daniel Peter Taylor, East Windsor, NJ (US)

(73) Assignee: Howard A. Taylor, Esq., Philadelphia, PA (US)

( * ) Notice: Subject to any disclaimer, the term of this patent is extended or adjusted under 35 U.S.C. 154(b) by 0 days.

(21) Appl. No.: 15/078,999

(22) Filed: Mar. 23, 2016

(65) Prior Publication Data

US 2017/0275150 A1 Sep. 28, 2017

Related U.S. Application Data

(63) Continuation of application No. PCT/US2016/023835, filed on Mar. 23, 2016.

(51) Int. Cl.

| | |
|---|---|
| ***B68B 5/00*** | (2006.01) |
| ***A44B 11/24*** | (2006.01) |
| ***A44B 18/00*** | (2006.01) |
| ***B68B 1/04*** | (2006.01) |

(52) U.S. Cl.

CPC ..... *B68B 5/00* (2013.01); *A44B 11/24* (2013.01); *A44B 18/00* (2013.01); *B68B 1/04* (2013.01); *Y10T 24/2708* (2015.01)

(58) Field of Classification Search

CPC ..... B65B 5/00; A44B 11/24; A44B 18/00; Y10T 24/2708; B68B 1/04

See application file for complete search history.

(56) References Cited

U.S. PATENT DOCUMENTS

| | | | | |
|---|---|---|---|---|
| 2,717,437 | A | 9/1955 | De Mestral | |
| 3,009,235 | A | 11/1961 | De Mestral | |
| 4,472,925 | A | 9/1984 | Woodruff | |
| 4,519,187 | A | 5/1985 | Reynolds | |
| 4,627,126 | A | 12/1986 | Nichols | |
| 4,813,213 | A | 3/1989 | Nicowski | |
| 5,029,434 | A * | 7/1991 | Erickson | B68C 1/147 54/44.1 |
| 5,148,656 | A | 9/1992 | Meaghan | |
| 5,284,005 | A | 2/1994 | Jacobi | |
| 5,771,843 | A | 6/1998 | Karlin | |
| 5,966,911 | A | 10/1999 | Gray et al. | |
| 6,151,872 | A | 11/2000 | Rasmussen | |
| 6,264,755 | B1 | 7/2001 | Georgiou | |
| 6,516,593 | B2 | 2/2003 | Markle | |
| 6,553,747 | B1 | 4/2003 | Texel | |
| 6,591,589 | B2 | 7/2003 | Cook | |
| 6,591,590 | B1 | 7/2003 | Henneberg | |
| 6,813,872 | B2 | 11/2004 | Gray et al. | |

(Continued)

FOREIGN PATENT DOCUMENTS

| | | | |
|---|---|---|---|
| DE | 29509174 | U1 | 8/1995 |
| DE | 202011105589 | U1 | 11/2011 |
| DE | 202013003414 | U1 | 5/2013 |

*Primary Examiner* — Robert Sandy

(74) *Attorney, Agent, or Firm* — Paul & Paul; Ourmazd S. Ojan; John S. Child, Jr.

(57) ABSTRACT

A safety device for equestrian sports uses at least one hook-and-loop fastener for connecting ends of the control lines for guiding a horse such that the ends of the control lines will separate and thereby stop a fallen rider or driver from being dragged by a horse or a horse drawn vehicle.

30 Claims, 43 Drawing Sheets

(56) References Cited

U.S. PATENT DOCUMENTS

| | | | | |
|---|---|---|---|---|
| 8,001,750 | B2 | 8/2011 | Howard | |
| 8,454,035 | B2 | 6/2013 | Watson | |
| 8,523,200 | B2 | 9/2013 | Hayden | |
| 8,863,316 | B2 | 10/2014 | Gaskins | |
| 2004/0159082 | A1 | 8/2004 | Gray et al. | |
| 2006/0107626 | A1* | 5/2006 | Wilson | B68B 1/04 54/44.1 |

* cited by examiner 100
102
104
106
108
114
116
118
120
122
126
128
130
132
134
136
142
144
146
148

100
102
104
106
108
110
112
114
116
118
120
122
124
126
128
130
134
138
140
142
144
146
148

144
236
237
230
216
228
224
226
200
102
106
108
104
120
122
114
130
142
138

25
49
51
300
334
316
336
102
104
106
108
118
120
122
114
130
132
142
146

326

300
316
51
49
336
106
108
104
120
122
114
130
324
50
102
146
142
138

SAFETY DEVICE FOR REINS

BACKGROUND OF THE INVENTION

1. Field of the Invention

The present invention relates to a system and device to mitigate the potential for serious injury due to a fallen rider or driver being dragged by a horse or horse-drawn vehicle.

2. Description of the Prior Art

Equestrian sports such as harness racing, thoroughbred horse racing, steeplechase, show jumping, and other equestrian events have a very long tradition. In such sports, riders of horses or drivers of horse-drawn vehicles use control lines, sometimes referred to as reins that are usually connected to the horse's bridle, in the case of bitless bridles such as a hackamore for example, or to a bit in the horse's mouth, to directionally control and guide the horse to the left or the right or to stop the horse. This is usually accomplished with at least two control lines, one for the right direction and one for the left direction. To reduce the chance that the rider or driver will lose control of one or more of the control lines, the terminal ends of the control lines near where they are normally held by the rider, jockey, or driver are connected together. A harness racing sulky used in harness racing is illustrated in U.S. Pat. No. 5,966,911, issued to Gray et al. on Oct. 19, 1999, which is incorporated by reference herein in its entirety. Heretofore, the terminal ends of the control lines near where they are normally held by the driver of the sulky have been connected together by a connector having a central swivel, two short strap portions connected to each side of the swivel, and a buckle connected to the end of each strap. An example of this type of connector is shown in FIGS. 1-2. The terminal ends of the control lines have holes for engagement by the buckles 51 of the connector 50. The connection provided by the prior art connector can withstand a great deal of tensile force without allowing the terminal ends of the control lines to separate. All too frequently, if a fallen driver has one or both legs or other extremity entangled in the control lines, the fallen driver will be dragged to his or her death or will suffer grievous injury because the prior art connector will not allow the terminal ends of the control lines to separate and release the fallen driver.

A similar problem exists in horseback riding and horseracing. The traditional control lines for these sports are connected using a buckle as illustrated in U.S. Pat. No. 5,148,656, issued to Meaghan on Sep. 22, 1992, which is incorporated by reference herein in its entirety. This type of connector 52 is also illustrated in FIGS. 3-4. Again, the terminal ends of the control lines, near where they are held by the rider, are connected by a buckle that will not allow the ends of the control lines to separate and release a fallen rider, which entails the risk of death or severe injury.

The problem outlined above has persisted for decades, perhaps centuries, with no known attempt at finding a solution. The need persists in the art for a safety device that will mitigate the potential for serious injury due to a fallen rider or driver being dragged by a horse or horse drawn vehicle.

SUMMARY OF THE INVENTION

The present invention is directed to a safety device for use with reins for equestrian sports. The safety device uses at least one hook-and-loop fastener for connecting ends of the control lines for guiding a horse such that the ends of the control lines will separate and thereby stop a fallen rider or driver from being dragged by a horse or a horse drawn vehicle.

The present invention also encompasses a safety connector that is capable of being retrofit to existing rein systems for equestrian sports. The safety connector uses at least one hook-and-loop fastener for connecting ends of the control lines for guiding a horse such that the ends of the control lines will separate and thereby stop a fallen rider or driver from being dragged by a horse or a horse drawn vehicle. For convenience of reference, the portion of each control line that includes the end that connects to the bit or the bridle, or is otherwise operably linked or connected to the headgear of the horse, in order to communicate control commands from the rider or driver to the horse, is referred to herein as the head portion of the control line.

It is an aspect of the present invention to provide a safety device for use with the control lines for guiding a horse, wherein the safety device includes a releasable fastener system.

It is an aspect of the present invention to provide a safety device for use with control lines for guiding a horse, the control lines including at least a first control line and a second control line, the first control line having a head portion, the second control line having a head portion, the first control line being usable for guiding the horse to the left, the second control line being usable for guiding the horse to the right, the safety device comprising:

a first strap portion operably connected to one of the head portion of the first control line and the head portion of the second control line;

a second strap portion operably connected to the other of the head portion of the first control line and the head portion of the second control line;

a first portion of a hook-and-loop fastener attached to the first strap portion, the first portion of the hook-and-loop fastener being in the form of a panel lying flat against one side of the first strap portion;

a second portion of a hook-and-loop fastener attached to the second strap portion, the second portion of the hook-and-loop fastener being in the form of a panel lying flat against one side of the second strap portion; and at least one keeper attached to one of the first strap portion and the second strap portion such that, wherein when the first portion of the hook-and-loop fastener is fastened to the second portion of the hook-and-loop fastener, one of the first strap portion and the second strap portion, to which the at least one keeper is not attached, can extend through the at least one keeper, wherein a threshold tensile force required to separate the first strap portion and the second strap portion is lower than the tensile force that would be placed on the control lines for guiding a horse if a rider or driver entangled in the control lines for guiding a horse were to be dragged on the ground by the horse or a horse drawn vehicle.

It is another aspect of the present invention to provide a safety connector for use with control lines for guiding a horse, the control lines including at least a first control line and a second control line, the first control line having a head portion, the second control line having a head portion, the first control line being usable for guiding the horse to the left, the second control line being usable for guiding the horse to the right, the safety connector comprising:

a swivel having a first ring and a second ring;

a first strap portion attached to the first ring;

a second strap portion attached to the second ring;

a first portion of hook-and-loop fastener attached to the first strap portion, the first portion of hook-and-loop fastener being in the form of a panel lying flat against one side of the first strap portion;

a complementary portion of hook-and-loop fastener adapted for attachment to a third strap portion, the complementary portion of hook-and-loop fastener being complementary to the first portion of hook-and-loop fastener, the third strap portion being operably connected to one of the head portion of the first control line and the head portion of the second control line, the complementary portion of hook-and-loop fastener being in the form of a panel that can lie flat against one side of the third strap portion when the complementary portion of hook-and-loop fastener is attached to the third strap portion; and at least one keeper attached to the first strap portion such that, when the complementary portion of hook-and-loop fastener is attached to the third strap portion and the first portion of hook-and-loop fastener is fastened to the complementary portion of hook-and-loop fastener, the third strap portion can extend through the at least one keeper, wherein, when the complementary portion of hook-and-loop fastener is attached to the third strap portion and the first portion of hook-and-loop fastener is fastened to the complementary portion of hook-and-loop fastener, a threshold tensile force required to separate the first strap portion and the third strap portion is lower than the tensile force that would be placed on the control lines for guiding a horse if a rider or driver entangled in the control lines for guiding a horse were to be dragged on the ground by the horse or a horse drawn vehicle.

It is yet another aspect of the present invention to provide a safety connector as described above, wherein the first and second rings of the swivel are rotationally connected by a pivot pin, wherein the first and second rings can rotate freely relative to one another, wherein the pivot pin has a journal portion having a longitudinal axis, wherein at least one of the first and second rings rotates about the journal portion of the pivot pin, wherein the longitudinal axis of the journal portion of the pivot pin about which at least one of first and second rings rotates defines the axis of rotation of the first and second rings relative to one another, where the first and second rings are positioned side by side along the axis of rotation defined by the pivot pin with the first and second rings being positioned in tandem one after the other in a direction coincident with the axis of rotation defined by the pivot pin, wherein each of the first and second rings defines a respective opening, and wherein the axis of rotation defined by the pivot pin approximately bisects the opening of each of the first and second rings.

It is yet another aspect of the present invention to provide a safety connector as described above, wherein the complementary portion of hook-and-loop fastener is a third portion of hook-and-loop fastener and wherein the at least one keeper is a first keeper, the safety connector further comprising:

a second portion of hook-and-loop fastener attached to the second strap portion, the second portion of hook-and-loop fastener being in the form of a panel lying flat against one side of the second strap portion;

a fourth portion of hook-and-loop fastener adapted for attachment to a fourth strap portion, the fourth portion of hook-and-loop fastener being complementary to the second portion of hook-and-loop fastener, the fourth strap portion being operably connected to another one of the head portion of the first control line and the head portion of the second control line, the fourth portion of hook-and-loop fastener being in the form of a panel that can lie flat against one side of the fourth strap portion when the fourth portion of hook-and-loop fastener is attached to the fourth strap portion; and a second keeper attached to the second strap portion such that, when the fourth portion of hook-and-loop fastener is attached to the fourth strap portion and the second portion of hook-and-loop fastener is fastened to the fourth portion of hook-and-loop fastener, the fourth strap portion can extend through the second keeper.

It is yet another aspect of the present invention to provide a safety connector as described above, wherein, when the fourth portion of hook-and-loop fastener is attached to the fourth strap portion and the second portion of hook-and-loop fastener is fastened to the fourth portion of hook-and-loop fastener, a threshold tensile force required to separate the second strap portion and the fourth strap portion is lower than the tensile force that would be placed on the control lines for guiding a horse if a rider or driver entangled in the control lines for guiding a horse were to be dragged on the ground by the horse or a horse drawn vehicle.

It is yet another aspect of the present invention to provide a safety connector as described above, wherein the first strap portion is routed through the first ring of the swivel and sewn back onto itself to pivotally attach the first strap portion to the first ring, wherein the second strap portion is routed through the second ring of the swivel and sewn back onto itself to pivotally attach the second strap portion to the second ring, wherein portions of the first strap portion that are sewn together, after the first strap portion is routed through the first ring, form an upper panel of the first strap portion and a lower panel of the first strap portion, wherein the first keeper is provided near the first ring, wherein the first keeper is captured between the upper panel of the first strap portion and the lower panel of the first strap portion, wherein the first keeper passes between the upper panel of the first strap portion and the lower panel of the first strap portion, wherein the upper panel of the first strap portion and the lower panel of the first strap portion are sewn together on either side of the first keeper to capture the first keeper at a fixed location on the first strap portion near the first ring, wherein portions of the second strap portion that are sewn together, after the second strap portion is routed through the second ring, form an upper panel of the second strap portion and a lower panel of the second strap portion, wherein the second keeper is provided near the second ring, wherein the second keeper is captured between the upper panel of the second strap portion and the lower panel of the second strap portion, wherein the second keeper passes between the upper panel of the second strap portion and the lower panel of the second strap portion, and wherein the upper panel of the second strap portion and the lower panel of the second strap portion are sewn together on either side of the second keeper to capture the second keeper at a fixed location on the second strap portion near the second ring.

It is yet another aspect of the present invention to provide a safety connector as described above, wherein the first strap portion has a tip located distally from the first ring, wherein a length of the first strap portion extends between the first ring and the tip of the first strap portion, wherein the first portion of hook-and-loop fastener is provided on the length of the first strap portion intermediate the tip of the first strap portion and the first ring, wherein the second strap portion has a tip located distally from the second ring, wherein a length of the second strap portion extends between the second ring and the tip of the second strap portion, and wherein the second portion of hook-and-loop fastener is provided on the length of the second strap portion intermediate the tip of the second strap portion and the second ring.

It is yet another aspect of the present invention to provide a safety connector as described above, wherein the first portion of hook-and-loop fastener lies flat against one side of the first strap portion intermediate the first keeper and the tip of the first strap portion, and wherein the second portion of hook-and-loop fastener lies flat against one side of the second strap portion intermediate the second keeper and the tip of the second strap portion.

It is yet another aspect of the present invention to provide a safety connector as described above, wherein the first portion of hook-and-loop fastener is attached to the first strap portion using sewing, and wherein the second portion of hook-and-loop fastener is attached to the second strap portion using sewing.

It is yet another aspect of the present invention to provide a safety connector as described above, wherein the third portion of hook-and-loop fastener has a back side and is provided with adhesive on the back side, wherein the adhesive is covered by a release liner that is peeled away in order to attach the third portion of hook-and-loop fastener to the third strap portion, wherein the fourth portion of hook-and-loop fastener has a back side and is provided with adhesive on the back side, and wherein the adhesive is covered by a release liner that is peeled away in order to attach the fourth portion of hook-and-loop fastener to the fourth strap portion.

It is yet another aspect of the present invention to provide a safety connector as described above, wherein the at least one keeper is a first keeper, the safety connector further comprising:

a buckle attached to the second strap portion, the buckle being capable of engaging a fourth strap portion, the buckle having a frame and a prong, the fourth strap portion having a plurality of holes for engagement by the prong, the fourth strap portion being operably connected to another one of the head portion of the first control line and the head portion of the second control line; and a second keeper attached to the second strap portion such that, when the fourth strap portion and the buckle are fastened together, the fourth strap portion can extend through the second keeper.

It is yet another aspect of the present invention to provide a safety connector as described above, wherein the first strap portion is routed through the first ring of the swivel and sewn back onto itself to pivotally attach the first strap portion to the first ring, wherein the second strap portion is routed through the second ring of the swivel and sewn back onto itself to pivotally attach the second strap portion to the second ring, wherein portions of the first strap portion that are sewn together, after the first strap portion is routed through the first ring, form an upper panel of the first strap portion and a lower panel of the first strap portion, wherein the first keeper is provided near the first ring, wherein the first keeper is captured between the upper panel of the first strap portion and the lower panel of the first strap portion, wherein the first keeper passes between the upper panel of the first strap portion and the lower panel of the first strap portion, wherein the upper panel of the first strap portion and the lower panel of the first strap portion are sewn together on either side of the first keeper to capture the first keeper at a fixed location on the first strap portion near the first ring, wherein the second strap portion is routed over one side of the frame and sewn back on itself to capture the frame and pivotally attach the frame to the second strap portion and thereby attach the buckle to the second strap portion, wherein the frame defines an opening through which the second strap portion is routed, wherein the frame and the prong are free to pivot relative to the second strap portion, wherein portions of the second strap portion that are sewn together, after the second strap portion is routed through the frame, form an upper panel of the second strap portion and a lower panel of the second strap portion, wherein the second keeper is captured between the upper panel of the second strap portion and the lower panel of the second strap portion, wherein the second keeper passes between the upper panel of the second strap portion and the lower panel of the second strap portion, and wherein the upper panel of the second strap portion and the lower panel of the second strap portion are sewn together on either side of the second keeper to capture the second keeper at a fixed location on the second strap portion, wherein a portion of the second strap portion positioned to surround the one side of the frame has an opening for the prong that allows the prong to extend through the second strap portion, and wherein the opening for the prong is large enough so that the prong can pivot freely about the one side of the frame and in relation to the second strap portion.

It is yet another aspect of the present invention to provide a safety connector as described above, wherein the first strap portion has a tip located distally from the first ring, wherein a length of the first strap portion extends between the first ring and the tip of the first strap portion, and wherein the first portion of hook-and-loop fastener is provided on the length of the first strap portion intermediate the tip of the first strap portion and the first ring.

It is yet another aspect of the present invention to provide a safety connector as described above, wherein the first portion of hook-and-loop fastener lies flat against one side of the first strap portion intermediate the first keeper and the tip of the first strap portion.

It is yet another aspect of the present invention to provide a safety connector as described above, wherein the first portion of hook-and-loop fastener is attached to the first strap portion using sewing.

It is yet another aspect of the present invention to provide a safety connector as described above, wherein the complementary portion of hook-and-loop fastener has a back side and is provided with adhesive on the back side, wherein the adhesive is covered by a release liner that is peeled away in order to attach the complementary portion of hook-and-loop fastener to the third strap portion.

It is yet another aspect of the present invention to provide a safety connector as described above, wherein the second strap portion has a length and is provided with a plurality of holes distributed evenly along at least a portion of the length of the second strap portion, the plurality of holes being adapted for engagement by a prong of a buckle attached to a fourth strap portion, the fourth strap portion being operably connected to another one of the head portion of the first control line and the head portion of the second control line.

It is yet another aspect of the present invention to provide a safety connector as described above, wherein the first strap portion is routed through the first ring of the swivel and sewn back onto itself to pivotally attach the first strap portion to the first ring, wherein the second strap portion is routed through the second ring of the swivel and sewn back onto itself to pivotally attach the second strap portion to the second ring, wherein portions of the first strap portion that are sewn together, after the first strap portion is routed through the first ring, form an upper panel of the first strap portion and a lower panel of the first strap portion, wherein the at least one keeper is provided near the first ring, wherein the at least one keeper is captured between the upper panel of the first strap portion and the lower panel of the first strap portion, wherein the at least one keeper passes between the upper panel of the first strap portion and the lower panel of the first strap portion, wherein the upper panel of the first strap portion and the lower panel of the first strap portion are sewn together on either side of the at least one keeper to capture the at least one keeper at a fixed location on the first strap portion near the first ring.

It is yet another aspect of the present invention to provide a safety connector as described above, wherein the first strap portion has a tip located distally from the first ring, wherein a length of the first strap portion extends between the first ring and the tip of the first strap portion, and wherein the first portion of hook-and-loop fastener is provided on the length of the first strap portion intermediate the tip of the first strap portion and the at least one keeper.

It is yet another aspect of the present invention to provide a safety connector as described above, wherein the complementary portion of hook-and-loop fastener has a back side and is provided with adhesive on the back side, wherein the adhesive is covered by a release liner that is peeled away in order to attach the complementary portion of hook-and-loop fastener to the third strap portion.

It is yet another aspect of the present invention to provide a safety device as described above, wherein the second portion of a hook-and-loop fastener has a length, wherein the at least one keeper is attached to the first strap portion, wherein a length of the second strap portion extending between the second portion of the hook-and-loop fastener and a tip of the second strap portion is at least long enough such that the second strap portion can extend through the at least one keeper when about two thirds of the length of the second portion of the hook-and-loop fastener is overlapping and in engagement with the first portion of the hook-and-loop fastener to thereby allow the amount of engagement between the second portion of the hook-and-loop fastener and the first portion of the hook-and-loop fastener to be varied over a range of from about full engagement to about two thirds engagement, in terms of a portion of the length of the second portion of the hook-and-loop fastener that overlaps and is in engagement with the first portion of the hook-and-loop fastener, to thereby allow the threshold tensile force for disengaging the first strap portion from the second strap portion to be adjusted to suit a user's needs or preferences.

It is yet another aspect of the present invention to provide a safety device as described above, wherein the length of the second strap portion extending between the second portion of the hook-and-loop fastener and the tip of the second strap portion is at least long enough such that the second strap portion can extend through the at least one keeper when about one half of the length of the second portion of the hook-and-loop fastener is overlapping and in engagement with the first portion of the hook-and-loop fastener to thereby allow the amount of engagement between the second portion of the hook-and-loop fastener and the first portion of the hook-and-loop fastener to be varied over a range of from about full engagement to about one half engagement, in terms of a portion of the length of the second portion of the hook-and-loop fastener that overlaps and is in engagement with the first portion of a hook-and-loop fastener.

It is yet another aspect of the present invention to provide a safety device as described above, wherein the length of the second strap portion extending between the second portion of the hook-and-loop fastener and the tip of the second strap portion is at least long enough such that the second strap portion can extend through the at least one keeper when about one third of the length of the second portion of the hook-and-loop fastener is overlapping and in engagement with the first portion of the hook-and-loop fastener to thereby allow the amount of engagement between the second portion of the hook-and-loop fastener and the first portion of the hook-and-loop fastener to be varied over a range of from about full engagement to about one third engagement, in terms of a portion of the length of the second portion of the hook-and-loop fastener that overlaps and is in engagement with the first portion of a hook-and-loop fastener.

It is yet another aspect of the present invention to provide a safety device as described above, wherein the length of the second strap portion extending between the second portion of the hook-and-loop fastener and the tip of the second strap portion is at least long enough such that the second strap portion can extend through the at least one keeper when about one fourth of the length of the second portion of the hook-and-loop fastener is overlapping and in engagement with the first portion of the hook-and-loop fastener to thereby allow the amount of engagement between the second portion of the hook-and-loop fastener and the first portion of the hook-and-loop fastener to be varied over a range of from about full engagement to about one fourth engagement, in terms of a portion of the length of the second portion of the hook-and-loop fastener that overlaps and is in engagement with the first portion of a hook-and-loop fastener.

It is yet another aspect of the present invention to provide a safety device as described above, wherein the length of the second strap portion extending between the second portion of the hook-and-loop fastener and the tip of the second strap portion is at least long enough such that the second strap portion can extend through the at least one keeper when about one fifth of the length of the second portion of the hook-and-loop fastener is overlapping and in engagement with the first portion of the hook-and-loop fastener to thereby allow the amount of engagement between the second portion of the hook-and-loop fastener and the first portion of the hook-and-loop fastener to be varied over a range of from about full engagement to about one fifth engagement, in terms of a portion of the length of the second portion of the hook-and-loop fastener that overlaps and is in engagement with the first portion of a hook-and-loop fastener.

It is yet another aspect of the present invention to provide a safety device for use with control lines for guiding a horse, the control lines including at least a first control line and a second control line, the first control line having a head portion, the second control line having a head portion, the first control line being usable for guiding the horse to one of the left and the right directions, the second control line being usable for guiding the horse to the other of the left and the right directions, the safety device comprising:

a first strap portion operably connected to one of the head portion of the first control line and the head portion of the second control line, the first strap portion having a first end and a second end, the first strap portion being operably connected to the one of the head portion of the first control line and the head portion of the second control line through the first end thereof, the second end of the first strap portion defining a tip of the first strap portion;

a second strap portion operably connected to the other of the head portion of the first control line and the head portion of the second control line, the second strap portion having a first end and a second end, the first strap portion being operably connected to the other of the head portion of the first control line and the head portion of the second control line through the first end thereof, the second end of the second strap portion defining a tip of the second strap portion;

a first portion of a hook-and-loop fastener attached to the first strap portion, the first portion of the hook-and-loop fastener being in the form of a panel lying flat against one side of the first strap portion, the first portion of the hook-and-loop fastener having a length;

a second portion of a hook-and-loop fastener attached to the second strap portion, the second portion of the hook-and-loop fastener being in the form of a panel lying flat against one side of the second strap portion, the second portion of the hook-and-loop fastener having a length; and at least one keeper received for sliding movement on one of the first strap portion and the second strap portion, wherein when the first portion of the hook-and-loop fastener is fastened to the second portion of the hook-and-loop fastener, at least a portion of the one of the first strap portion and the second strap portion on which the keeper is received and the other of the first strap portion and the second strap portion extend through the at least one keeper, wherein a threshold tensile force required to separate the first strap portion and the second strap portion is lower than the tensile force that would be placed on the control lines for guiding a horse if a rider or driver entangled in the control lines for guiding a horse were to be dragged on the ground by the horse or a horse drawn vehicle, and wherein the keeper is movable by sliding along a length of the first strap portion and the second strap portion corresponding to at least a portion of the length of one of the first portion of the hook-and-loop fastener and the second portion of the hook-and-loop fastener to thereby allow the threshold tensile force for disengaging the first strap portion from the second strap portion to be adjusted to suit a user's needs or preferences by varying the position of the keeper along the length of the first strap portion and the second strap portion.

It is yet another aspect of the present invention to provide a safety device as described above wherein the keeper is movable by sliding along a length of the first strap portion and the second strap portion corresponding to at least the length of one of the first portion of the hook-and-loop fastener and the second portion of the hook-and-loop fastener.

It is yet another aspect of the present invention to provide a safety device as described above, wherein the keeper is received for sliding motion on the first strap portion, and wherein the safety device further comprises means for preventing the keeper from falling off the tip of the first strap portion.

It is yet another aspect of the present invention to provide a safety device as described above, wherein the means for preventing the keeper from falling off the tip of the first strap portion comprises a structure selected from a portion of increased thickness provided on the first strap portion at a position located on a portion of the first strap portion extending from the first portion of the hook-and-loop fastener to the tip of the first strap portion, a portion of increased width provided in the first strap portion at a position located on a portion of the first strap portion extending from the first portion of the hook-and-loop fastener to the tip of the first strap portion, and a hook provided on the first strap portion at a position located on a portion of the first strap portion extending from the first portion of the hook-and-loop fastener to the tip of the first strap portion.

It is yet another aspect of the present invention to provide a safety device as described above, wherein the safety device further comprises means for limiting sliding movement of the keeper, the means for limiting sliding movement of the keeper limiting sliding movement of the keeper to a portion of the first strap portion that at least in part overlaps a portion of the first portion of the hook-and-loop fastener, wherein the means for preventing the keeper from falling off the tip of the first strap portion forms part of the means for limiting sliding movement of the keeper.

It is yet another aspect of the present invention to provide a safety device as described above, wherein the means for limiting sliding movement of the keeper comprises a first portion of increased thickness provided on the first strap portion and a second portion of increased thickness provided on the first strap portion at a position located a distance apart from the first portion of increased thickness and with at least a portion of the first portion of the hook-and-loop fastener positioned intermediate the first portion of increased thickness and the second portion of increased thickness, wherein the first portion of increased thickness and the second portion of increased thickness project outward on an opposite side of the first strap portion in relation to the first portion of the hook-and-loop fastener.

It is yet another aspect of the present invention to provide a safety device as described above wherein the first portion of the hook-and-loop fastener is positioned intermediate the first portion of increased thickness and the second portion of increased thickness.

It is yet another aspect of the present invention to provide a safety device as described above, wherein the means for limiting sliding movement of the keeper comprises a first portion of increased width provided on the first strap portion and a second portion of increased width provided on the first strap portion at a position located a distance apart from the first portion of increased width and with at least a portion of the first portion of the hook-and-loop fastener positioned intermediate the first portion of increased width and the second portion of increased width.

It is yet another aspect of the present invention to provide a safety device as described above wherein the first portion of the hook-and-loop fastener is positioned intermediate the first portion of increased width and the second portion of increased width.

It is yet another aspect of the present invention to provide a safety device as described above, wherein the means for limiting sliding movement of the keeper comprises a first hook provided on the first strap portion and a second hook provided on the first strap portion at a position located a distance apart from the first hook and with at least a portion of the first portion of the hook-and-loop fastener positioned intermediate the first hook and the second hook, wherein the first hook and the second hook project outward on an opposite side of the first strap portion in relation to the first portion of the hook-and-loop fastener.

It is yet another aspect of the present invention to provide a safety device as described above wherein the first portion of the hook-and-loop fastener is positioned intermediate the first hook and the second hook.

It is yet another aspect of the present invention to provide a safety device as described above, wherein the means for limiting sliding movement of the keeper comprises an elongated slot formed between first and second layers of the first strap portion, the keeper passing between the first and second layers of the first strap portion, the first and second layers of the first strap portion being attached together at first and second spaced apart positions along the first strap portion to captivate the keeper on the first strap portion while allowing the keeper to move between the first and second spaced apart positions, which define the ends of the elongated slot, and wherein at least a portion of the first portion of the hook-and-loop fastener is positioned intermediate the first and second spaced apart positions on an outer surface of the first strap portion.

It is yet another aspect of the present invention to provide a safety device as described above wherein the first portion of the hook-and-loop fastener is positioned intermediate the first and second spaced apart positions on an outer surface of the first strap portion.

It is yet another aspect of the present invention to provide a safety device as described above, wherein the means for limiting sliding movement of the keeper comprises an elongated slot formed between a captivating strap and the first strap portion, the keeper passing between the captivating strap and the first strap portion, the captivating strap having first and second ends, the captivating strap being attached to the first strap portion at the first and second ends of the captivating strap to captivate the keeper on the first strap portion while allowing the keeper to move between the first and second ends of the captivating strap, which define the ends of the elongated slot, and wherein at least a portion of the first portion of the hook-and-loop fastener is positioned intermediate the first and second ends of the captivating strap outside the elongated slot such that the keeper can move over the at least a portion of the first portion of the hook-and-loop fastener.

It is yet another aspect of the present invention to provide a safety device as described above wherein the first portion of the hook-and-loop fastener is positioned intermediate the first and second ends of the captivating strap outside the elongated slot such that the keeper can move over the first portion of the hook-and-loop fastener.

These and other aspects of the present invention will be made clearer upon study of the detailed description of the invention provided below and the appended drawings.

BRIEF DESCRIPTION OF THE DRAWINGS

FIGS. 39-42 are views of a safety device for reins that is used for connecting the ends of the control lines for controlling and guiding a horse in accordance with a ninth embodiment of the present invention.

The same reference characters denote the corresponding features consistently throughout the attached drawings.

DETAILED DESCRIPTION OF THE PREFERRED EMBODIMENTS

Figure 1:
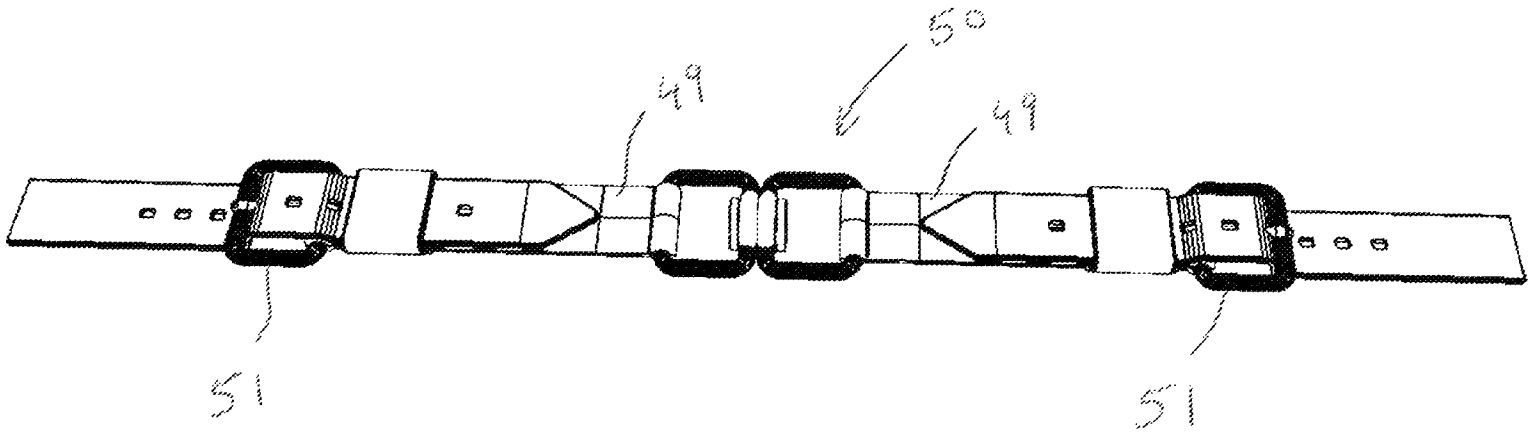
Fig. 1 Prior Art
FIGS. 1-2 are perspective views of a prior art connector for connecting the ends of the control lines for controlling and guiding a horse.
Figure 2:
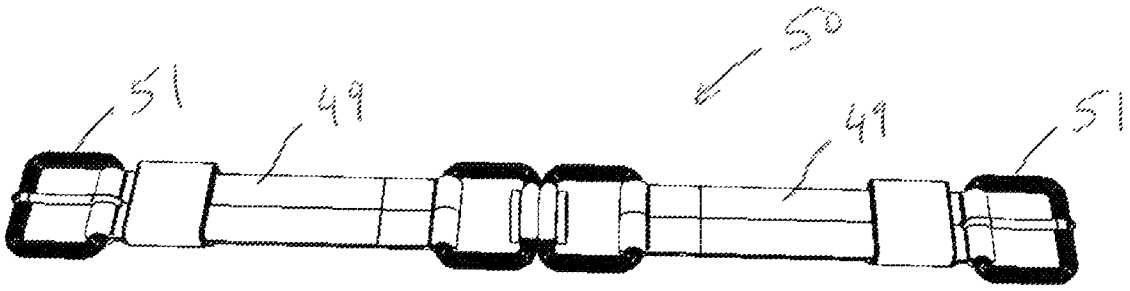
Fig. 2 Prior Art
Figure 4:
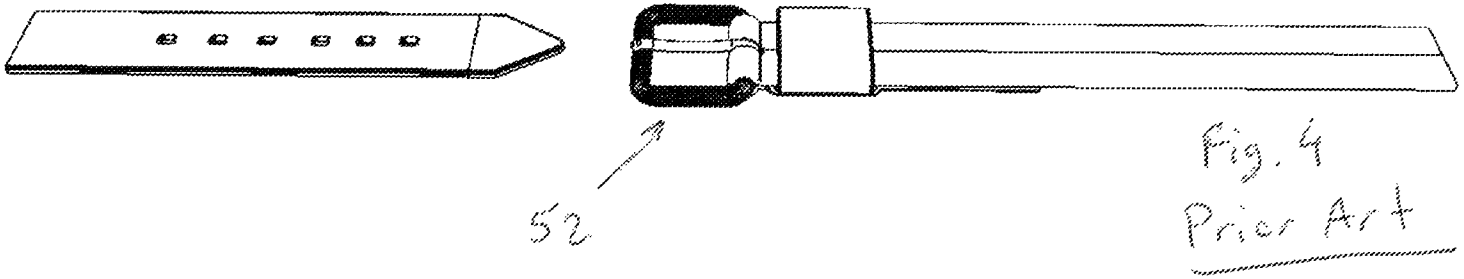
Fig. 4 Prior Art
FIGS. 3-4 are perspective views of another prior art connector for connecting the ends of the control lines for controlling and guiding a horse.
Figure 3:
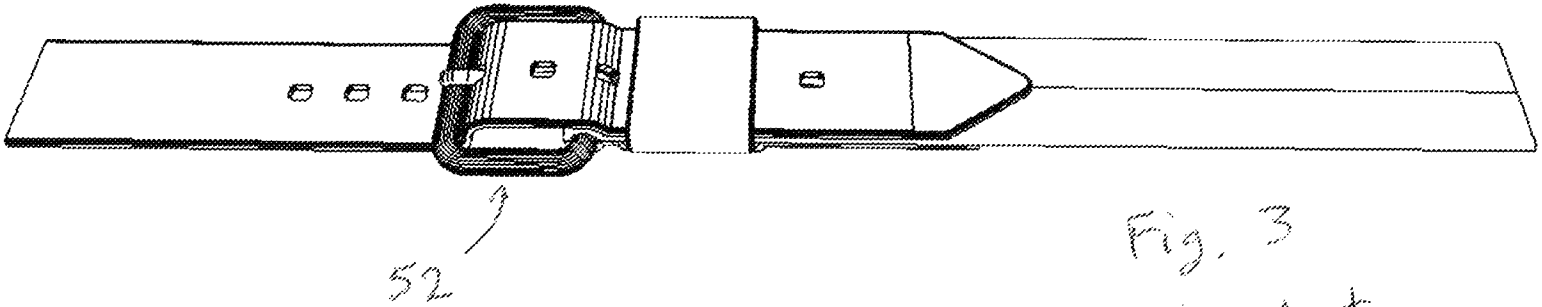
Fig. 3 Prior Art
Figures 5, 6:
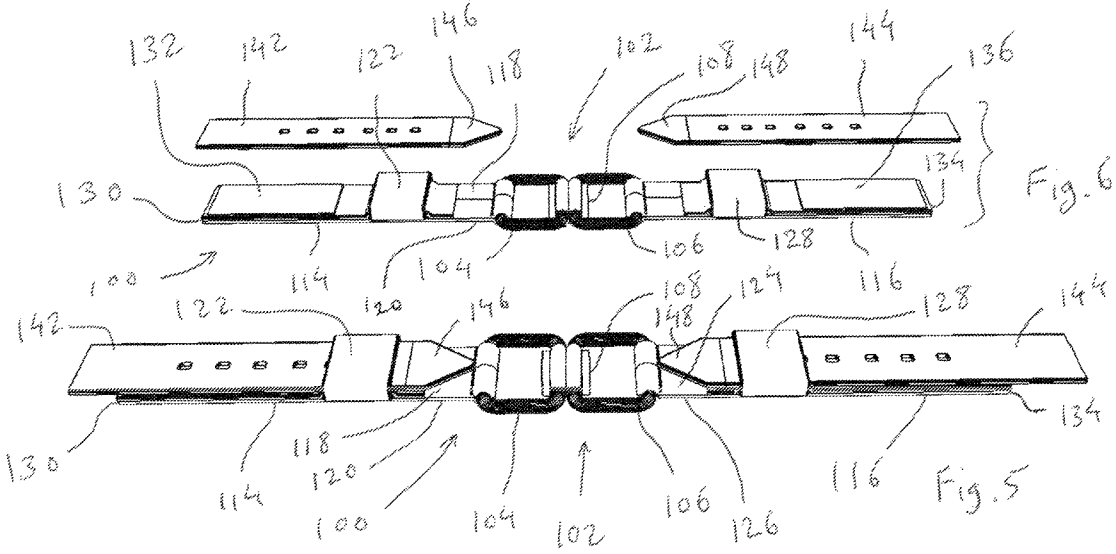
FIGS. 5-9 are views of a first embodiment of a safety connector for connecting the ends of the control lines for controlling and guiding a horse in accordance with the present invention.
Figures 7, 8:
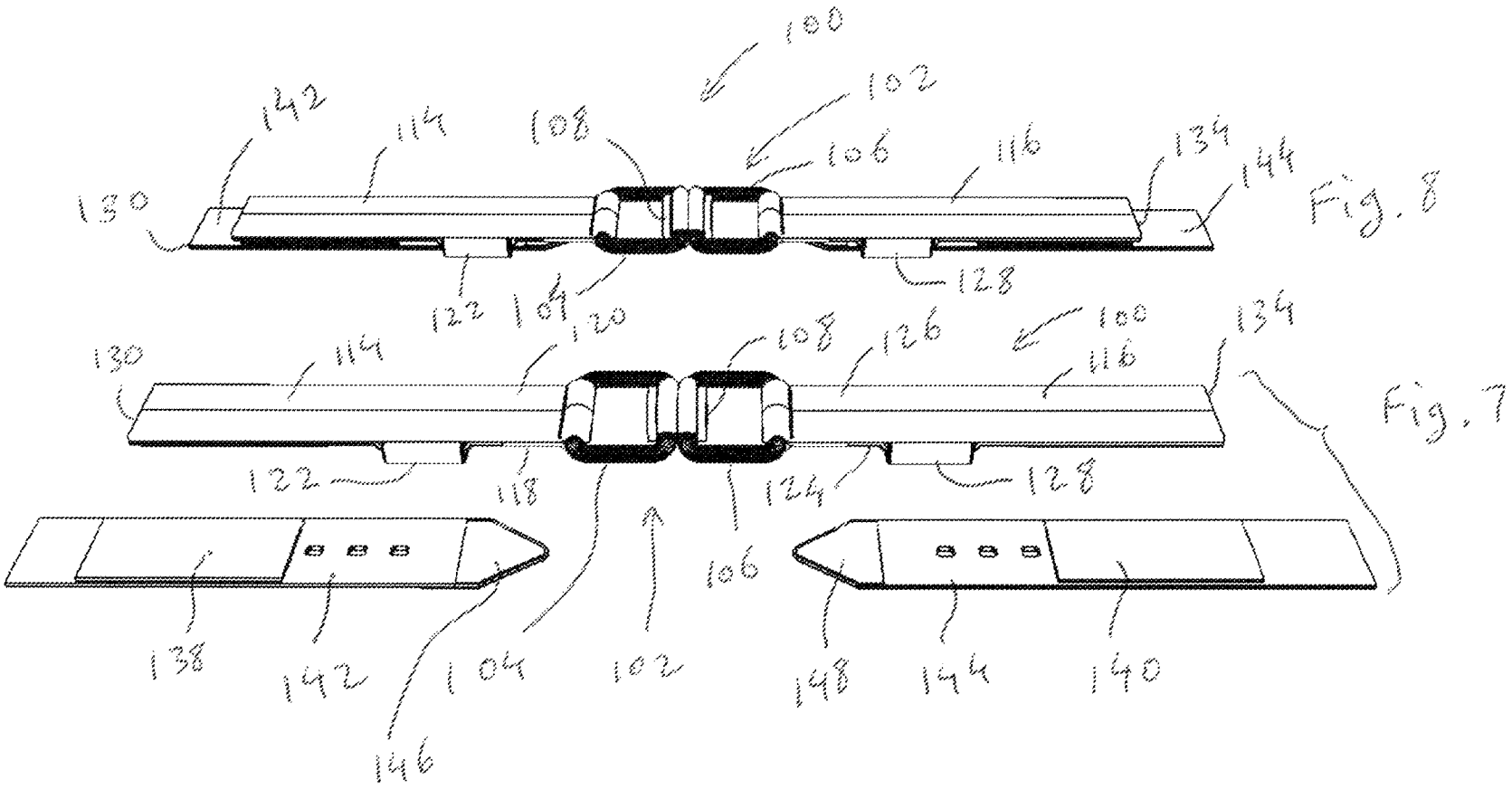
Figure 9:
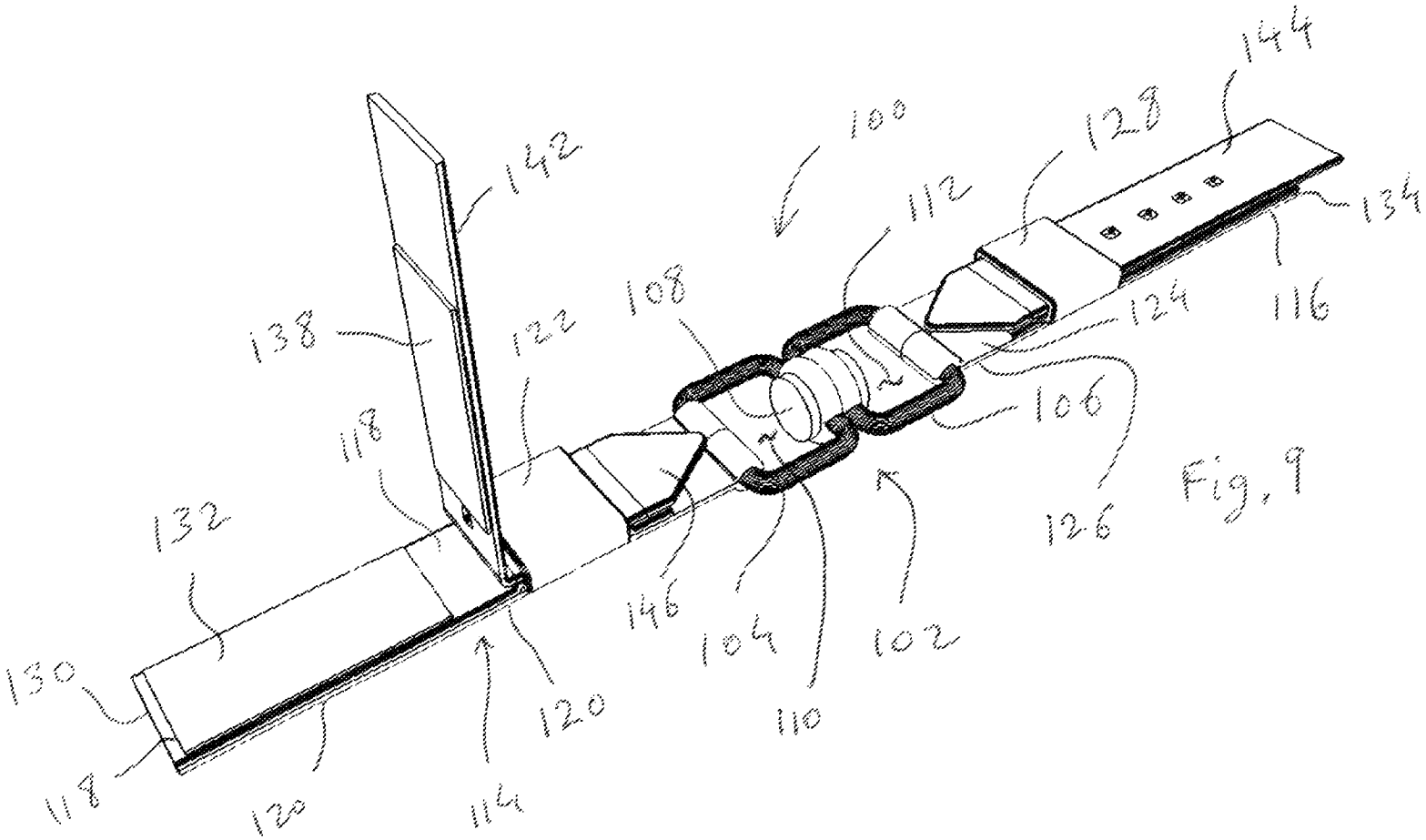
Figures 10, 11:
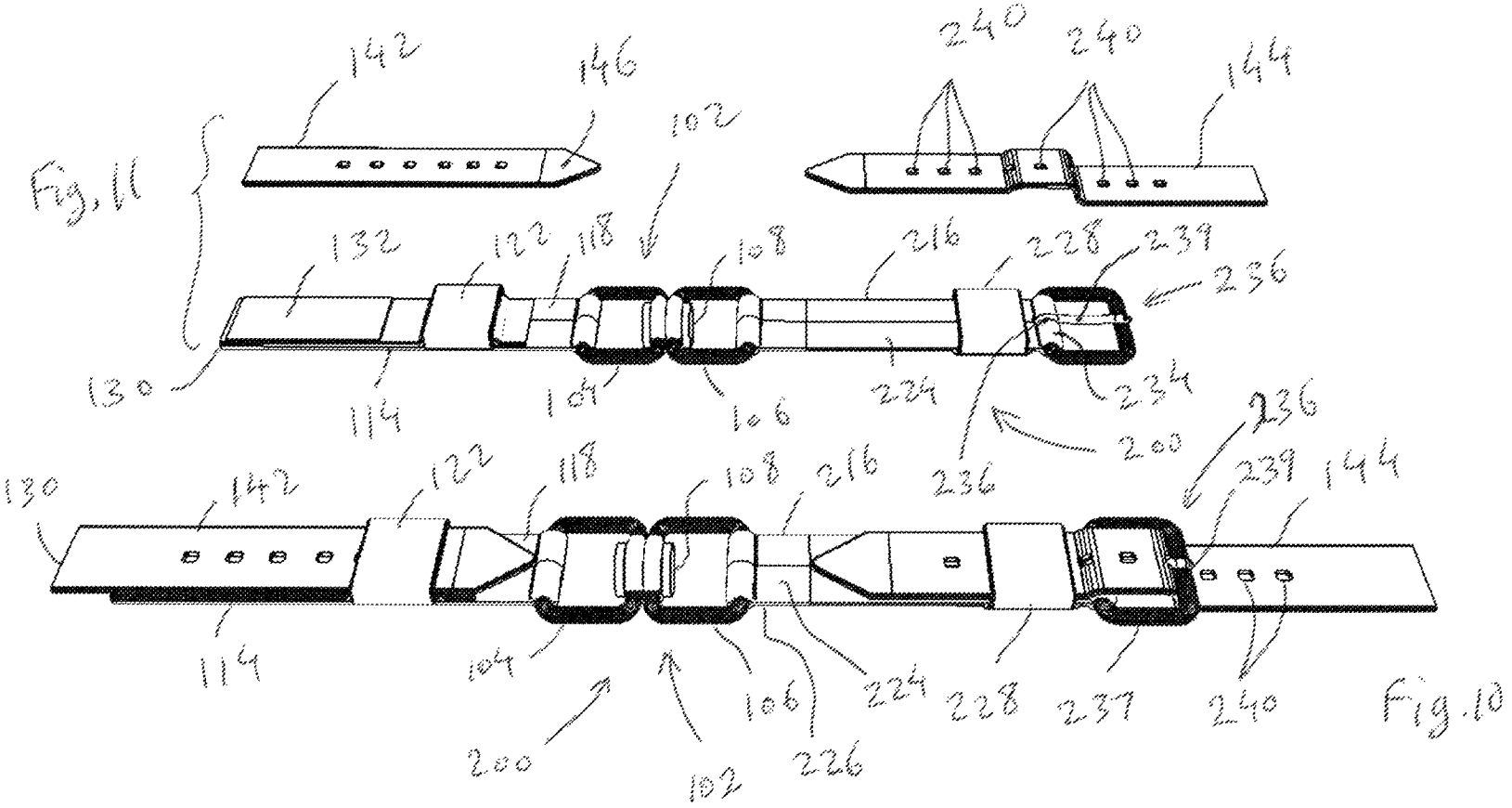
FIGS. 10-13 are views of a second embodiment of a safety connector for connecting the ends of the control lines for controlling and guiding a horse in accordance with the present invention.
Figures 12, 13:
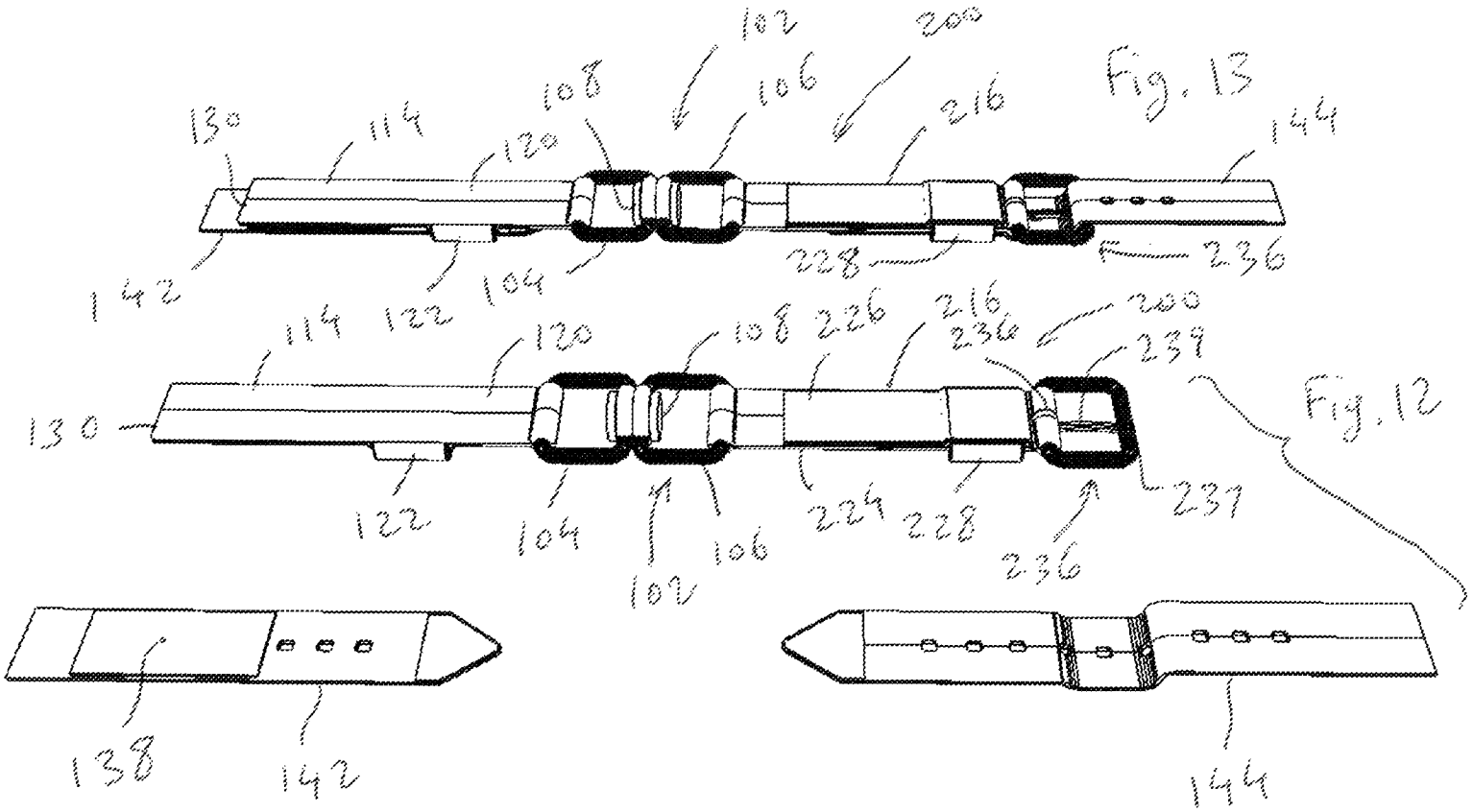
Figures 14, 15:
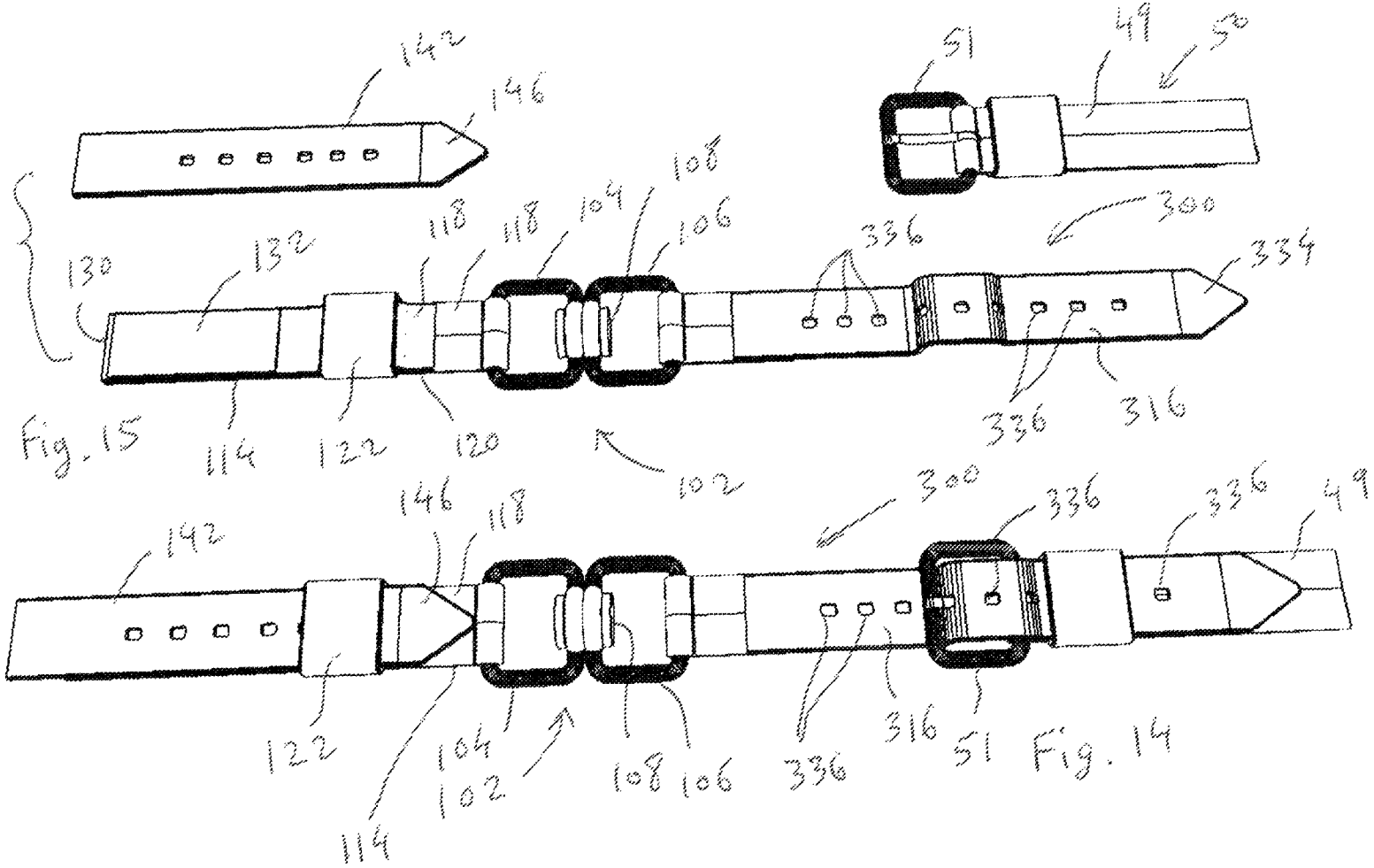
FIGS. 14-17 are views of a third embodiment of a safety connector for connecting the ends of the control lines for controlling and guiding a horse in accordance with the present invention.
Figures 16, 17:
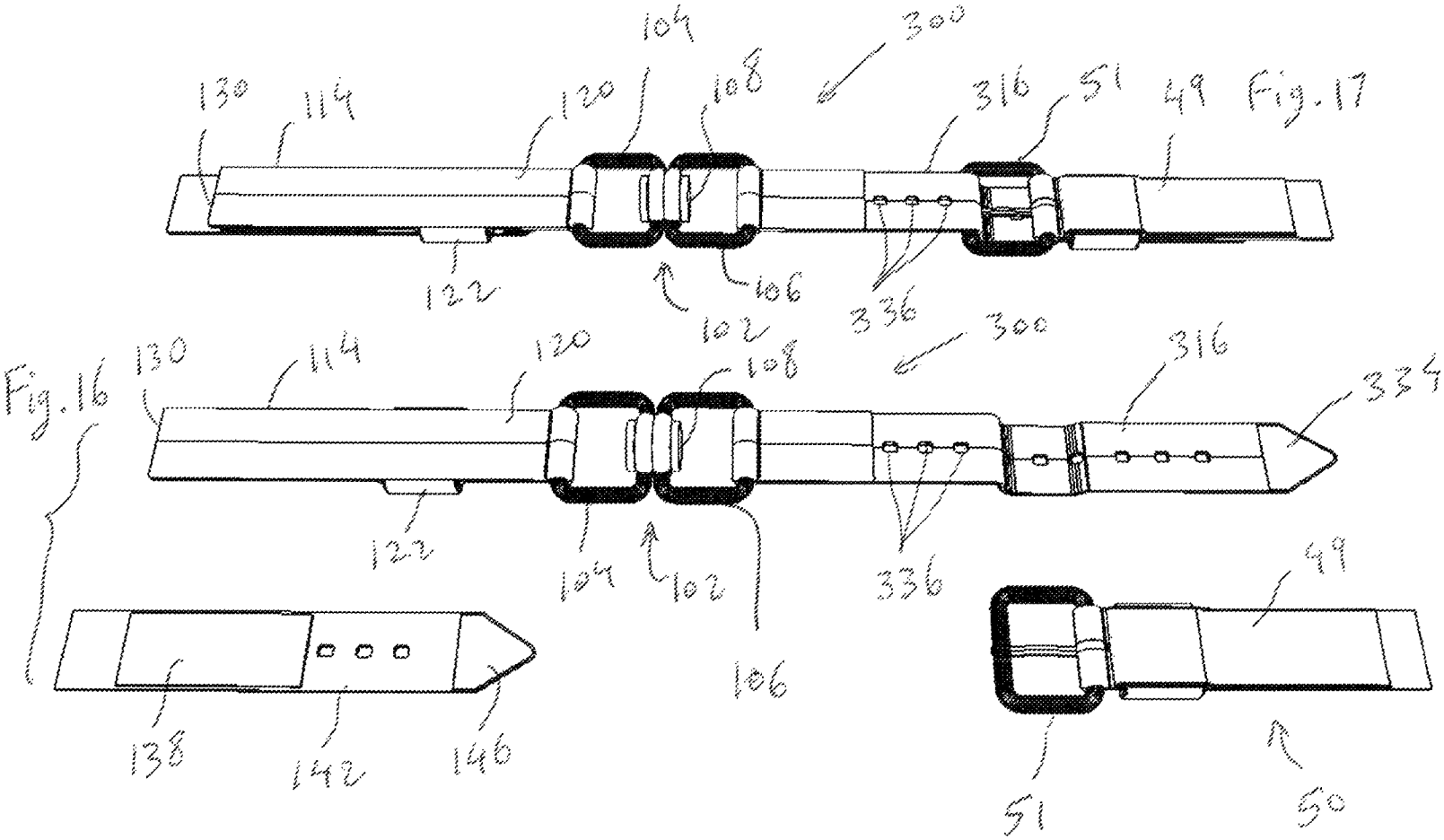
Figure 19:
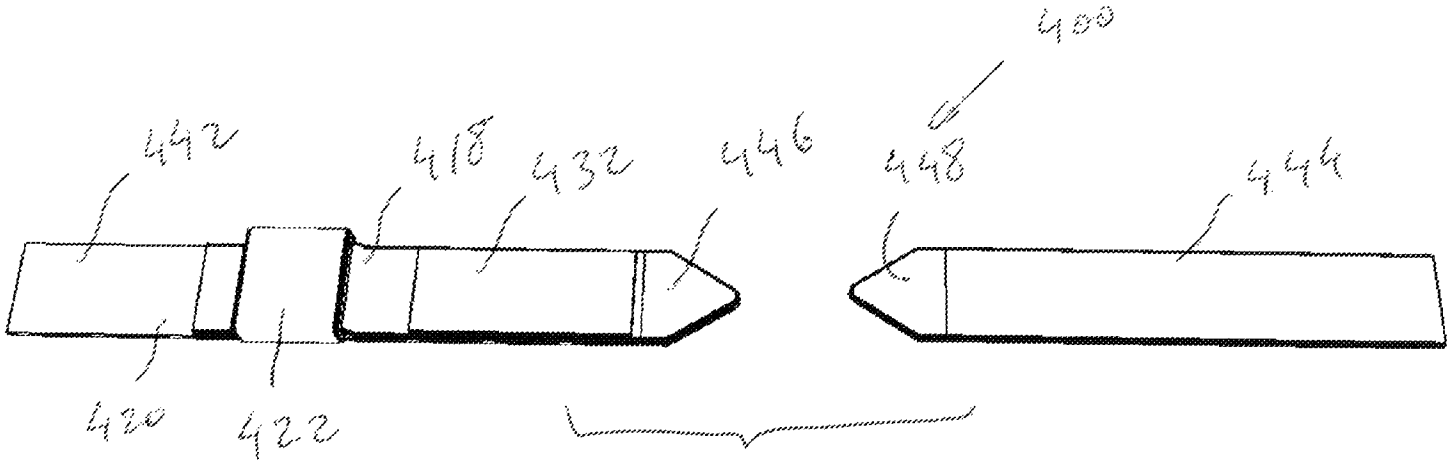
FIGS. 18-21 are views of a safety device for reins that is used for connecting the ends of the control lines for controlling and guiding a horse in accordance with the present invention.
Figure 18:
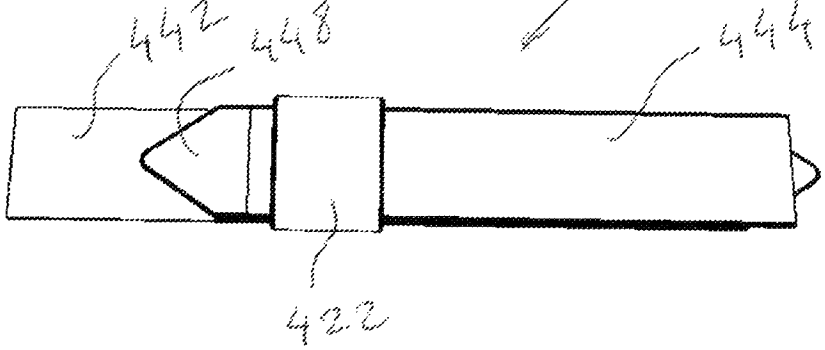
Figures 20, 21:
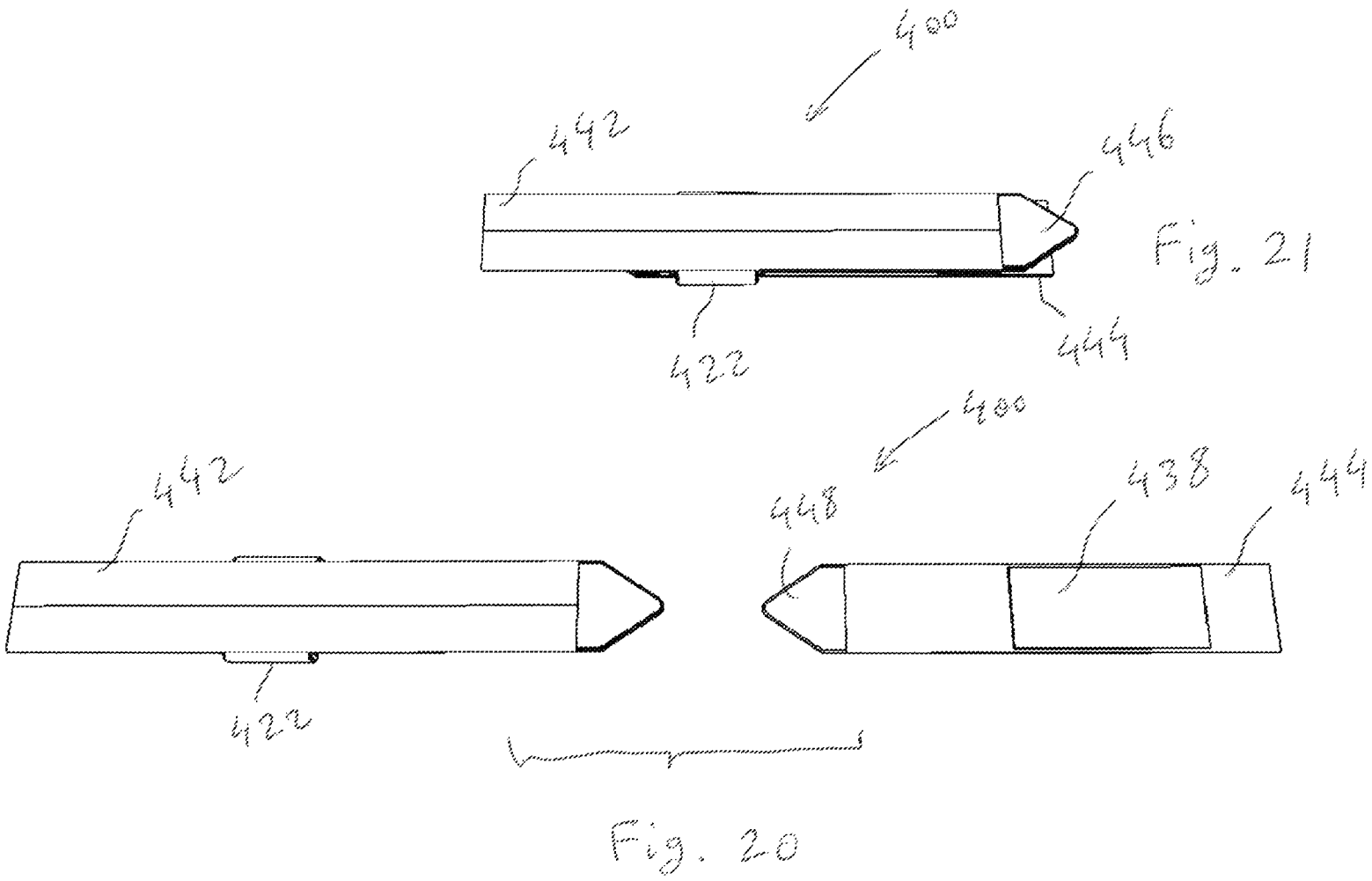
Figure 22:
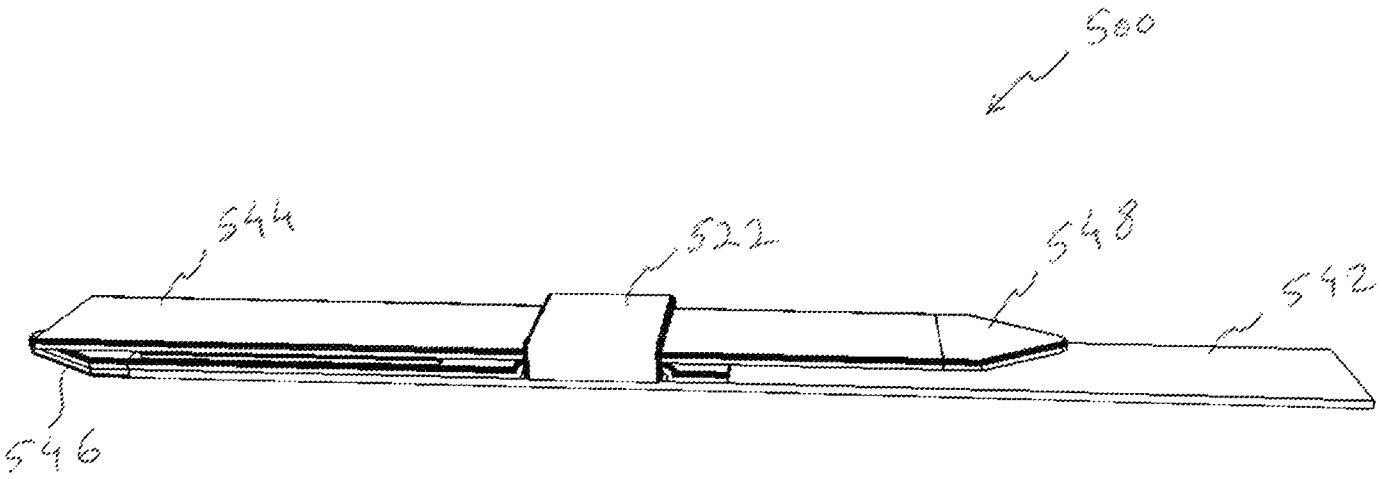
FIGS. 22-25 are views of a safety device for reins that is used for connecting the ends of the control lines for controlling and guiding a horse in accordance with a fifth embodiment of the present invention.
Figure 23:
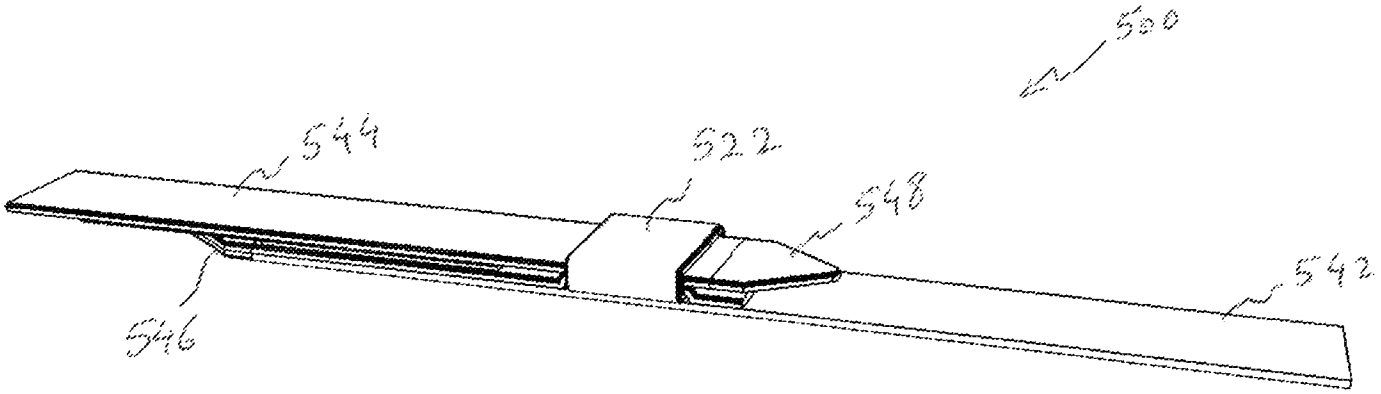
Figure 24:
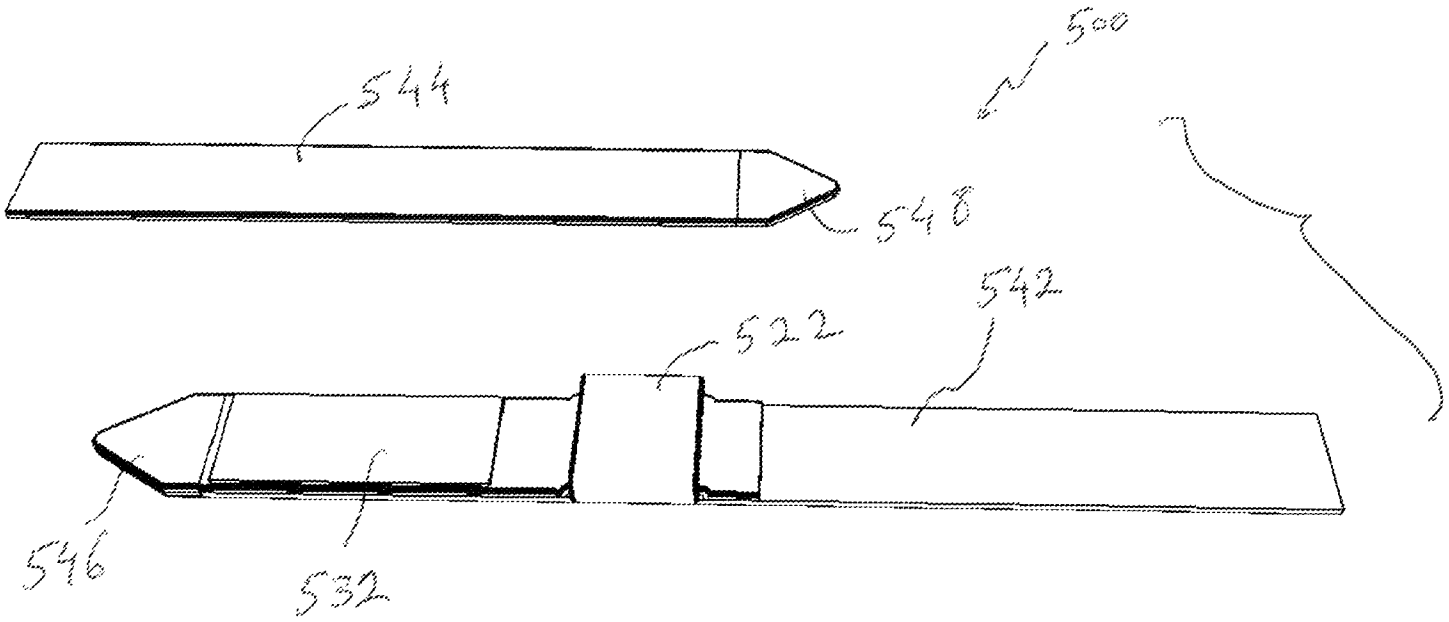
Figure 25:
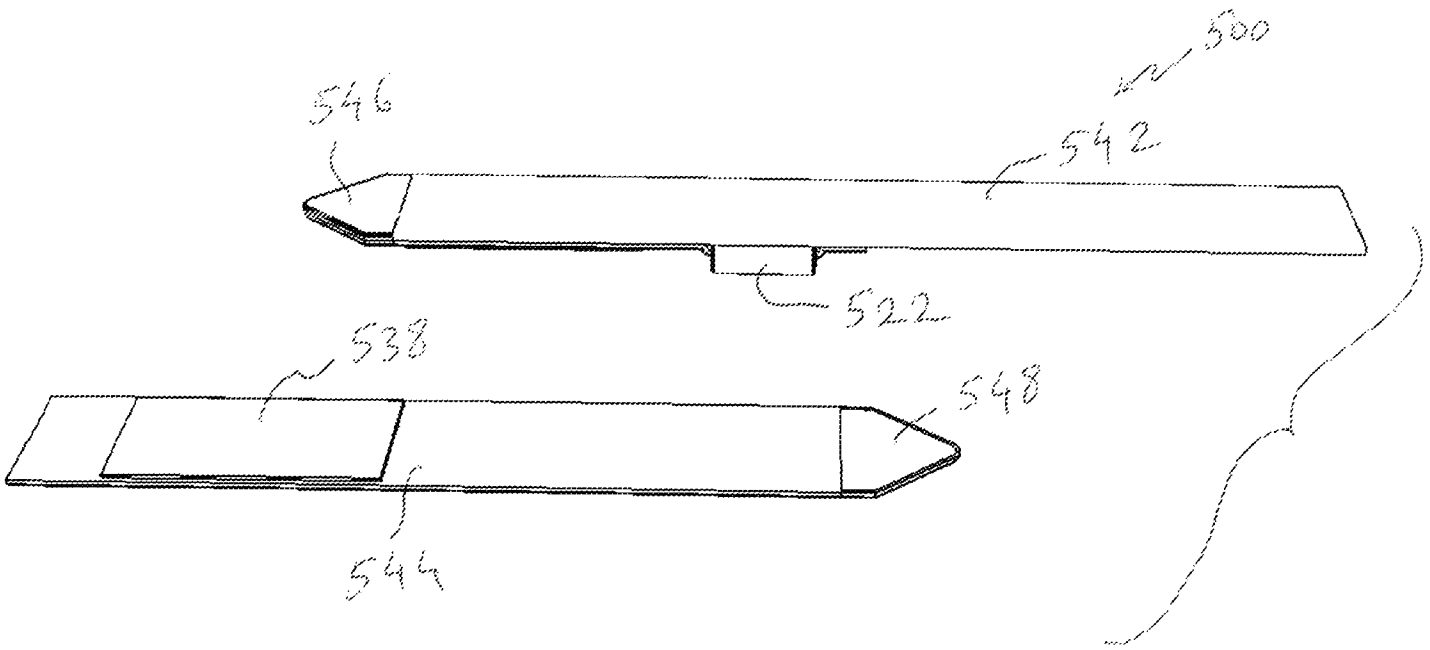
Figure 26:
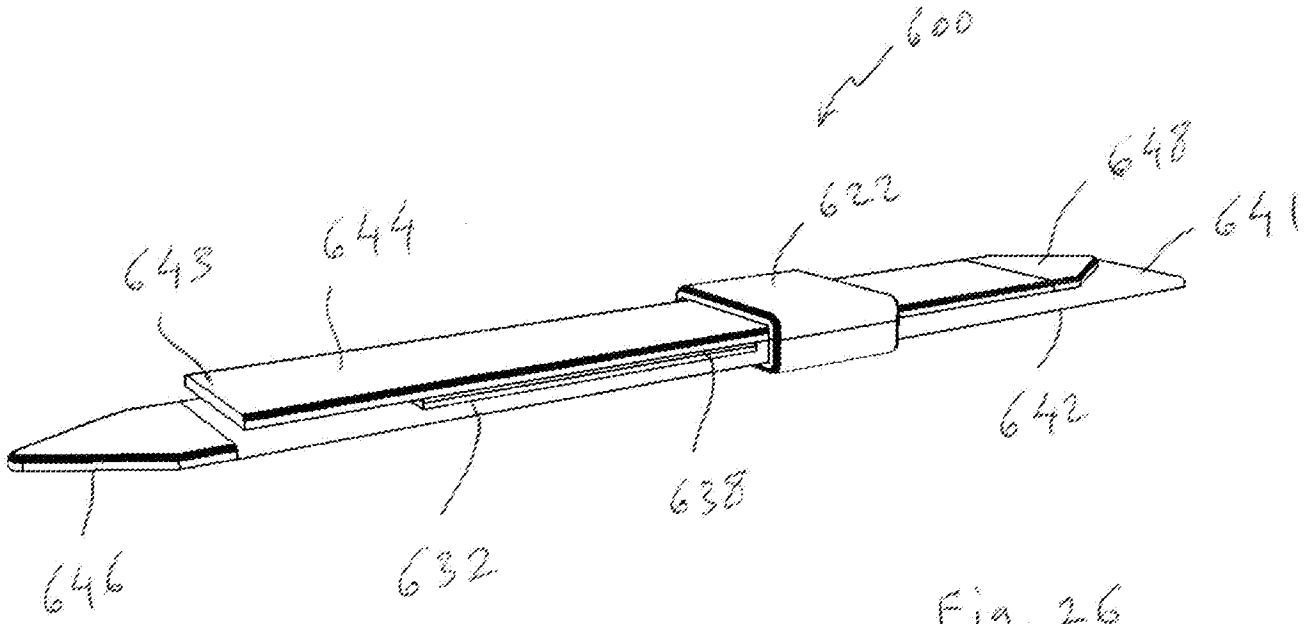
FIGS. 26-30 are views of a safety device for reins that is used for connecting the ends of the control lines for controlling and guiding a horse in accordance with a sixth embodiment of the present invention.
Figure 27:
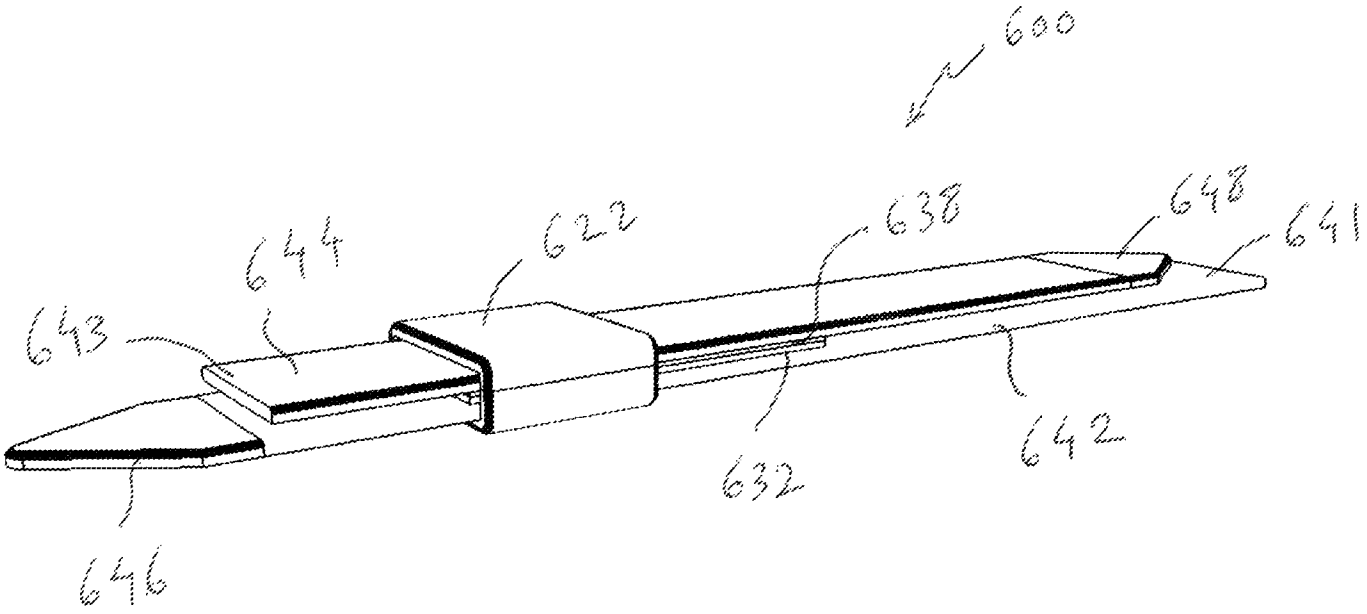
Figure 28:
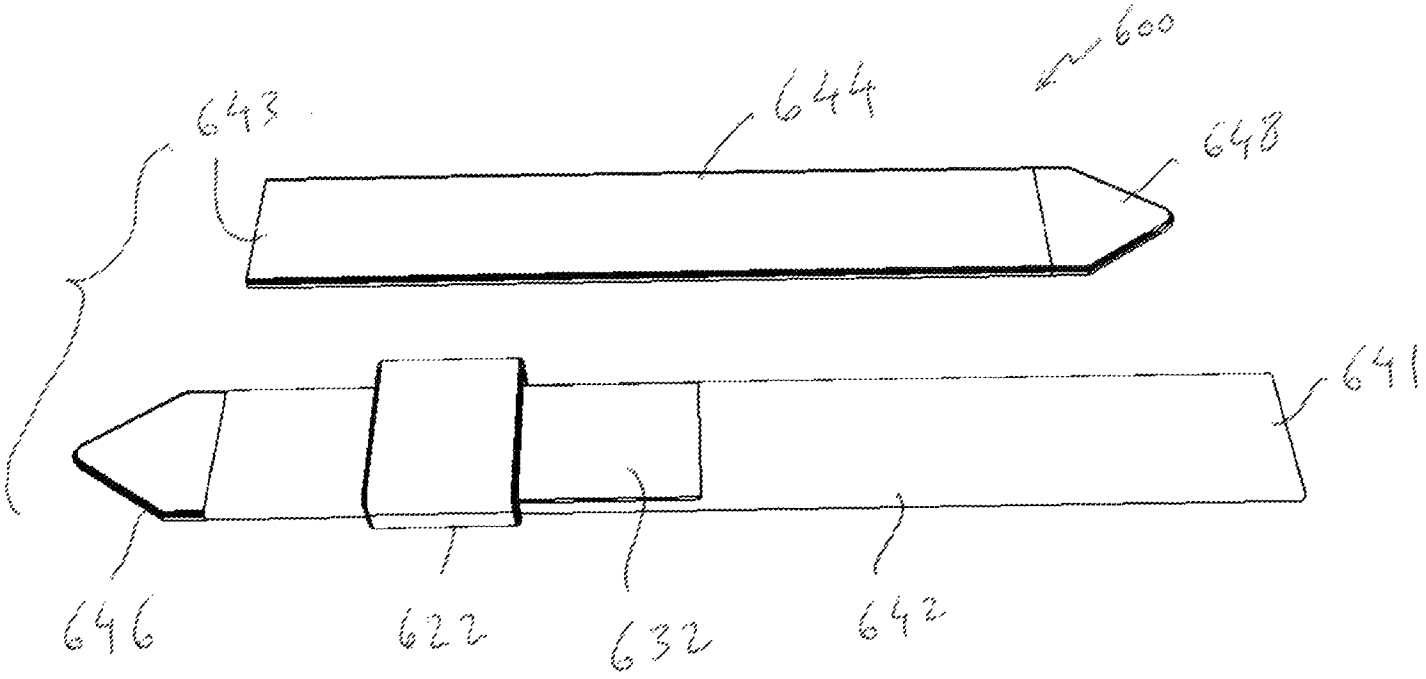
Figure 29:
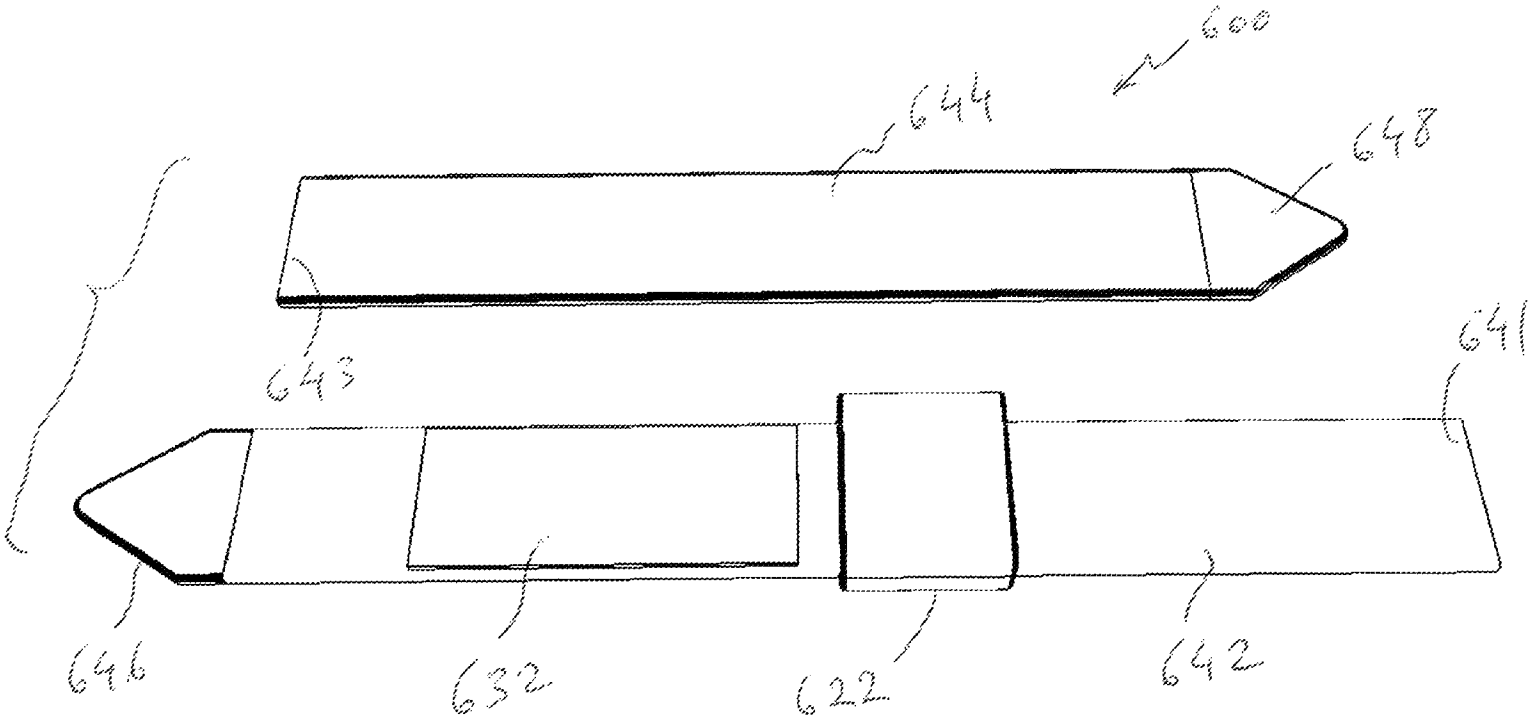
Figure 30:
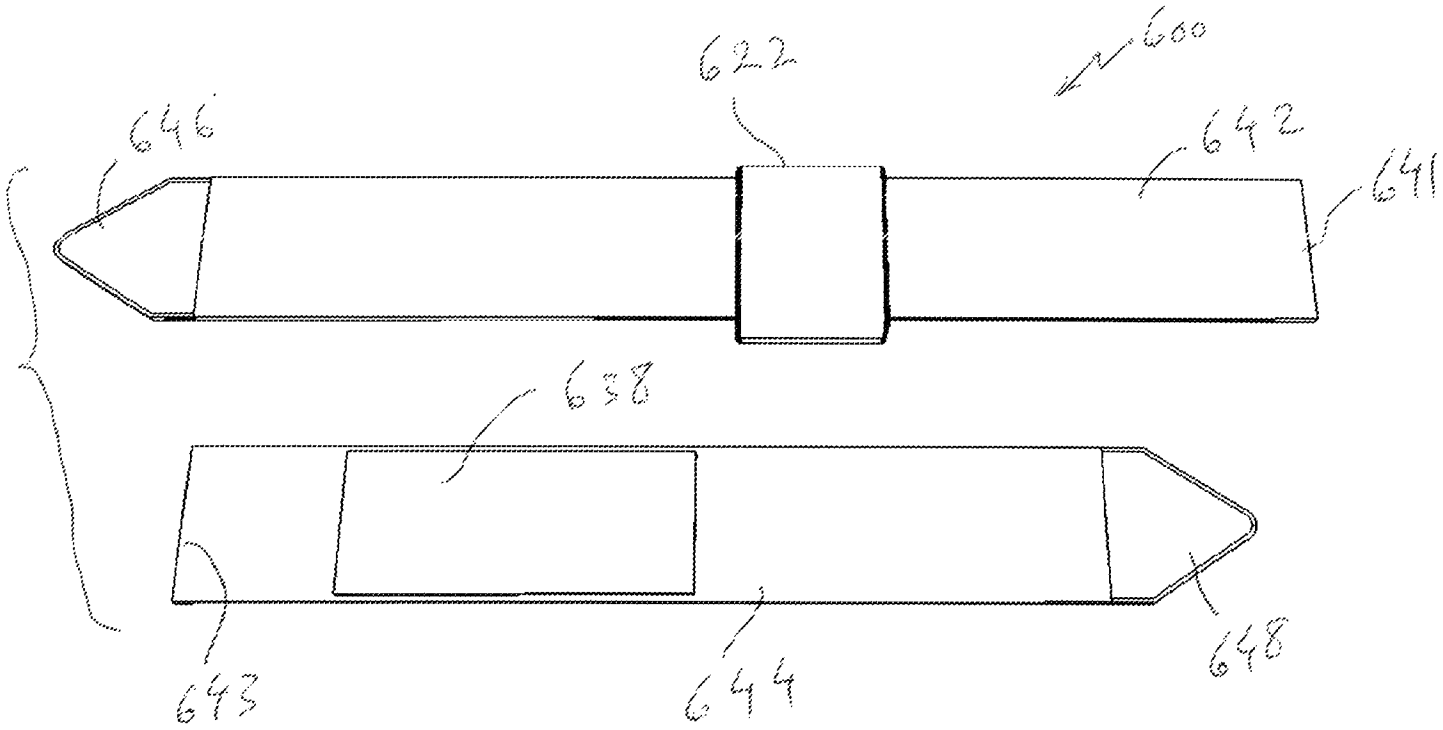
Figure 31:
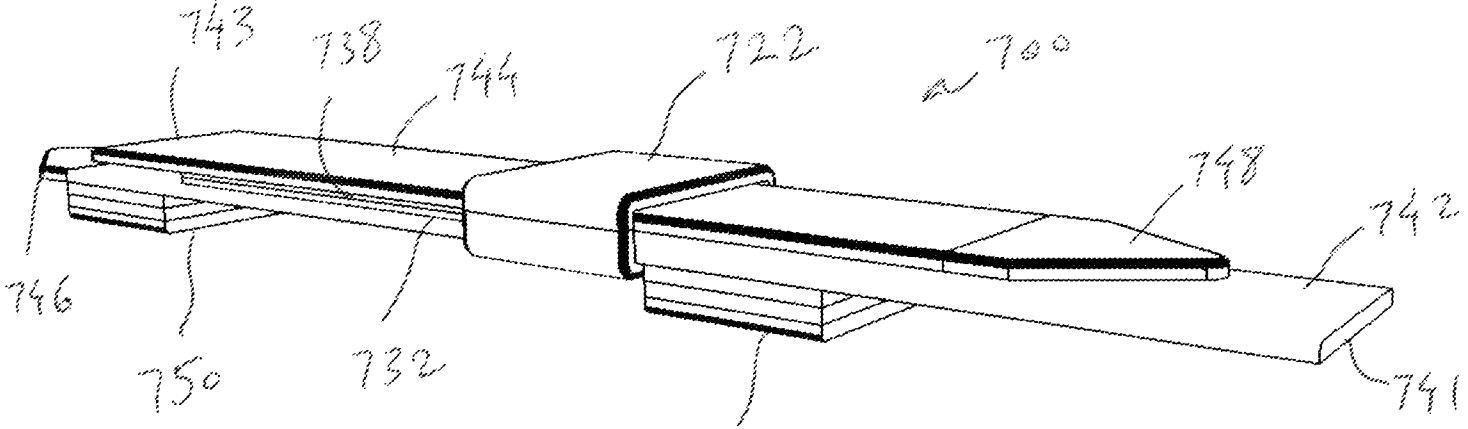
FIGS. 31-34 are views of a safety device for reins that is used for connecting the ends of the control lines for controlling and guiding a horse in accordance with a seventh embodiment of the present invention.
Figure 32:
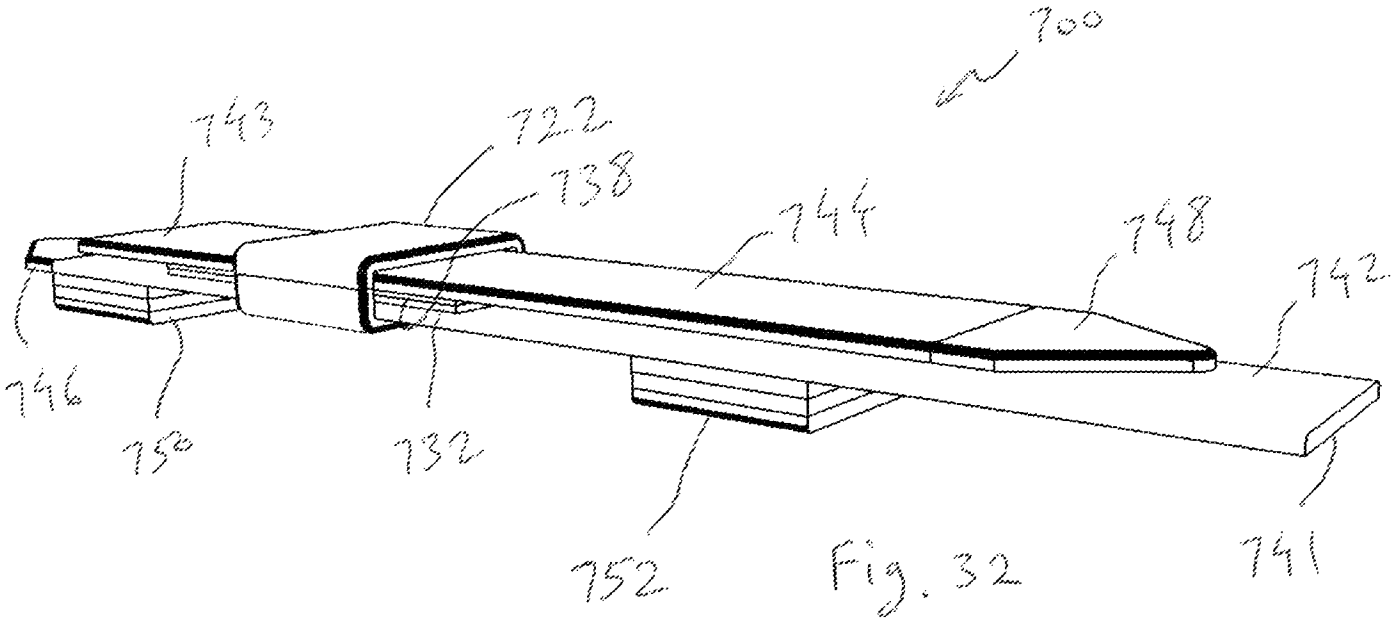
Figure 33:
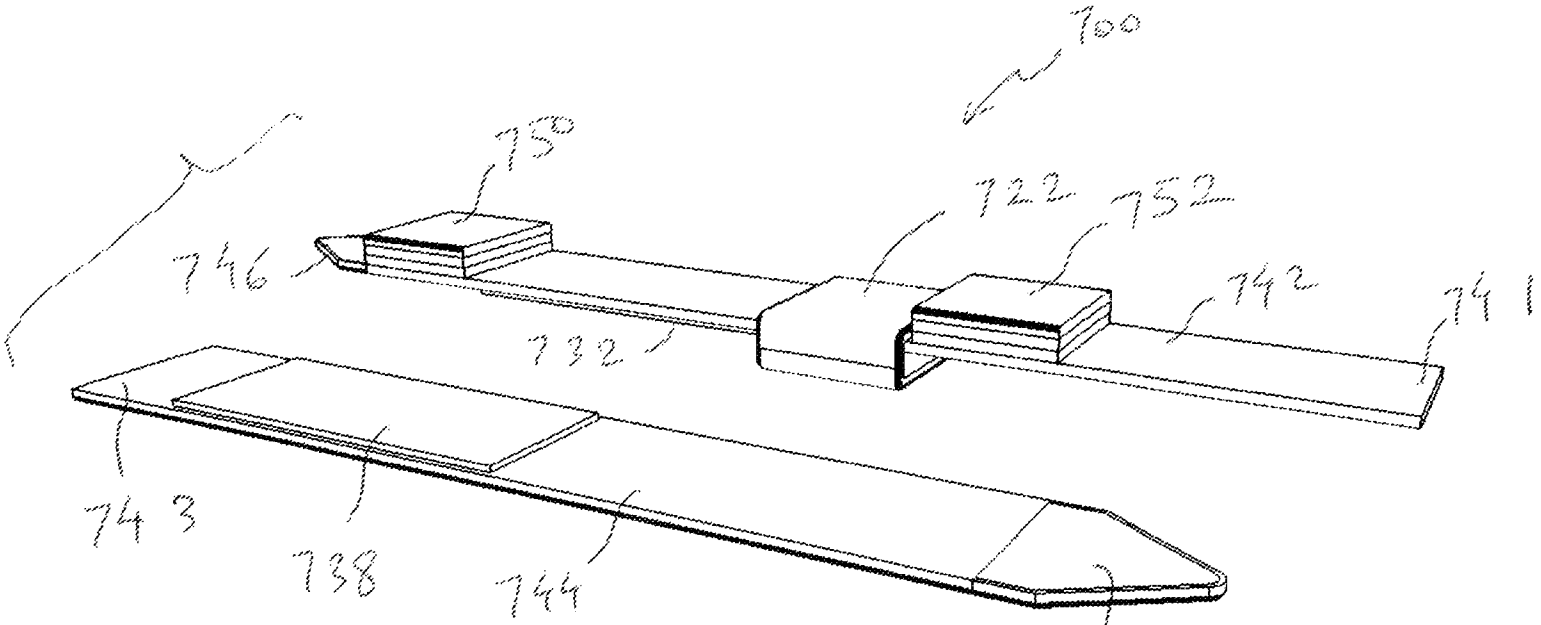
Figure 34:
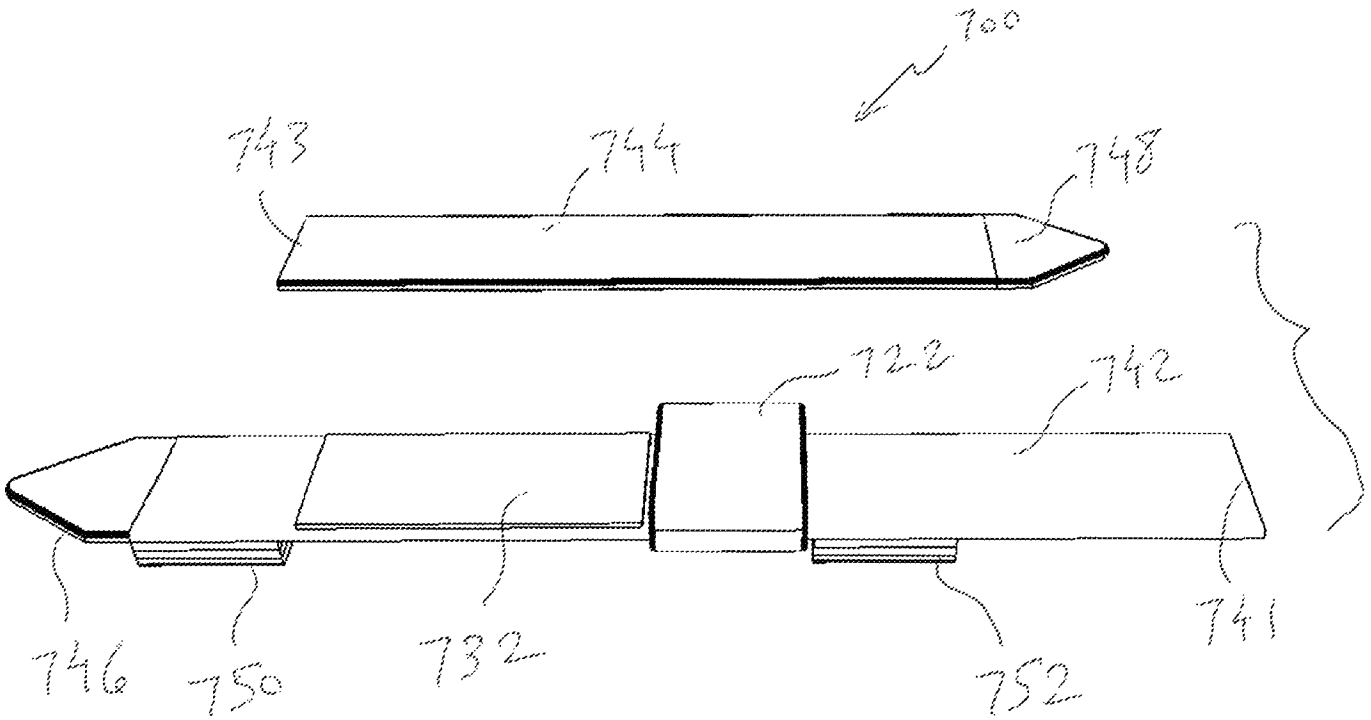
Figure 35:
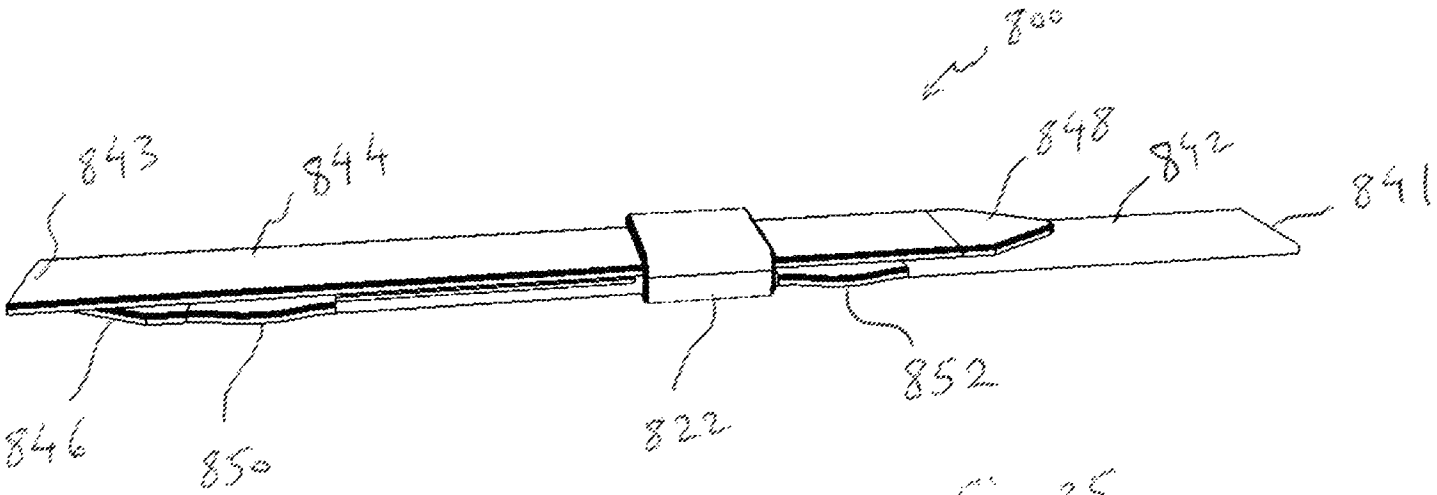
FIGS. 35-38 are views of a safety device for reins that is used for connecting the ends of the control lines for controlling and guiding a horse in accordance with an eighth embodiment of the present invention.
Figure 36:
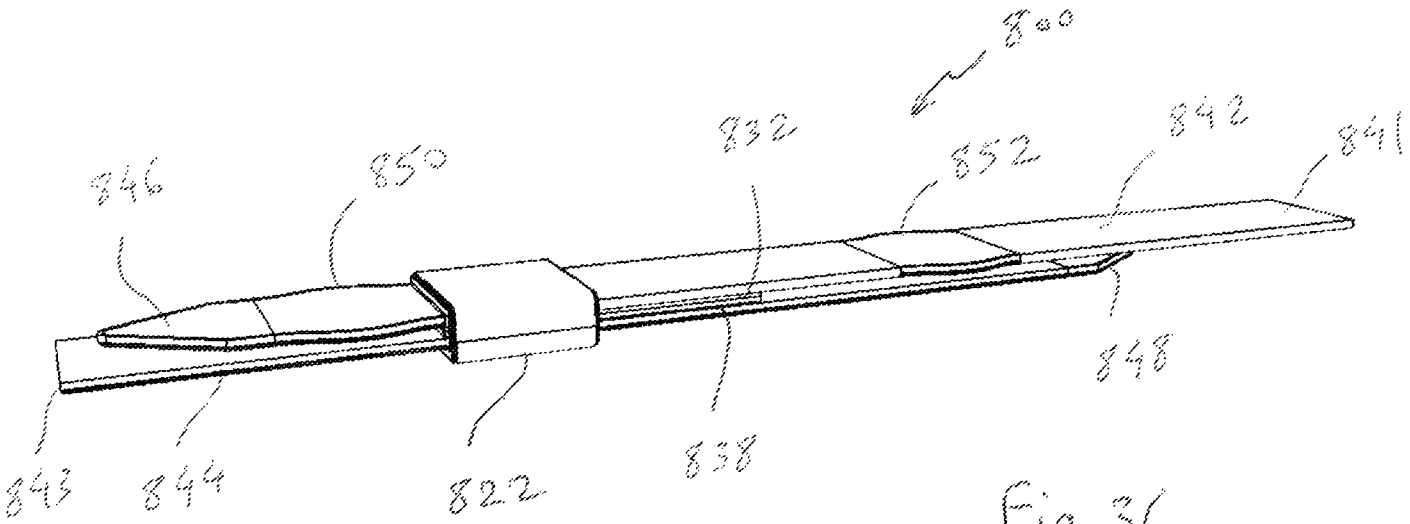
Figure 37:
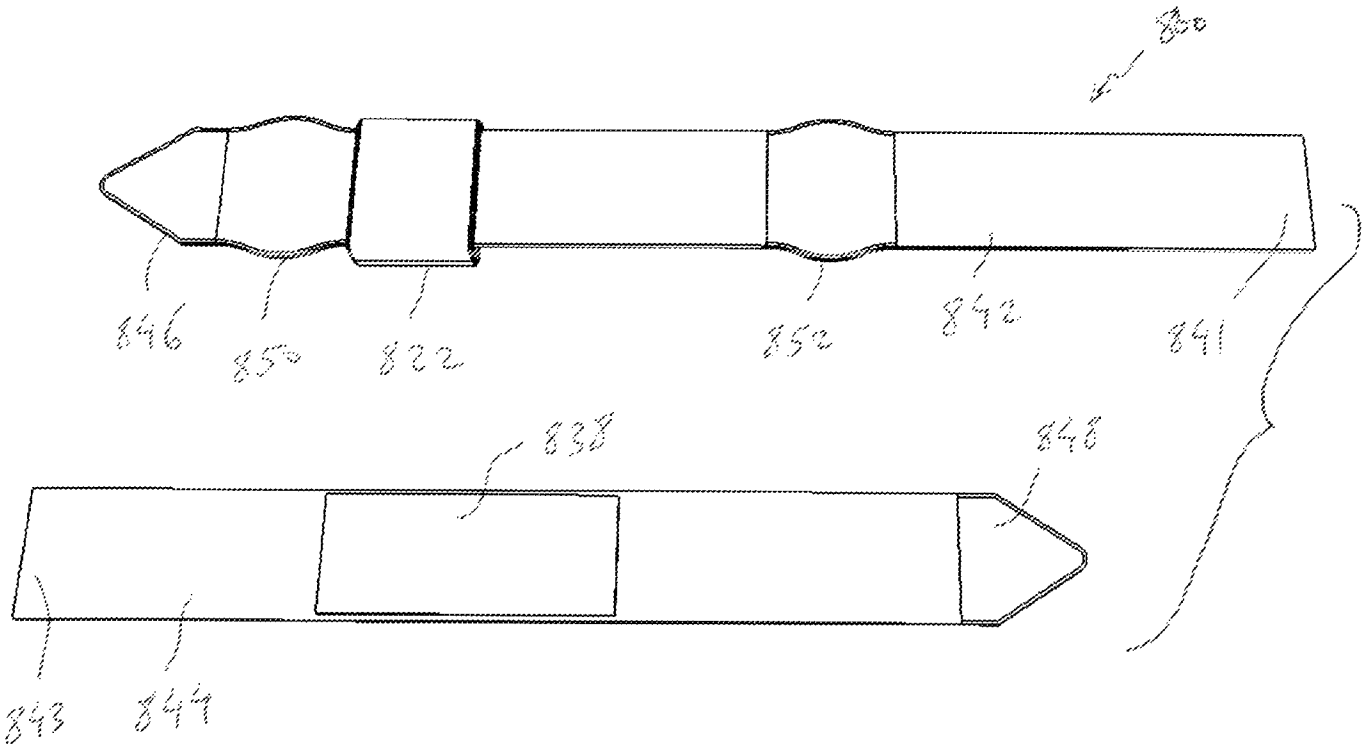
Figure 38:
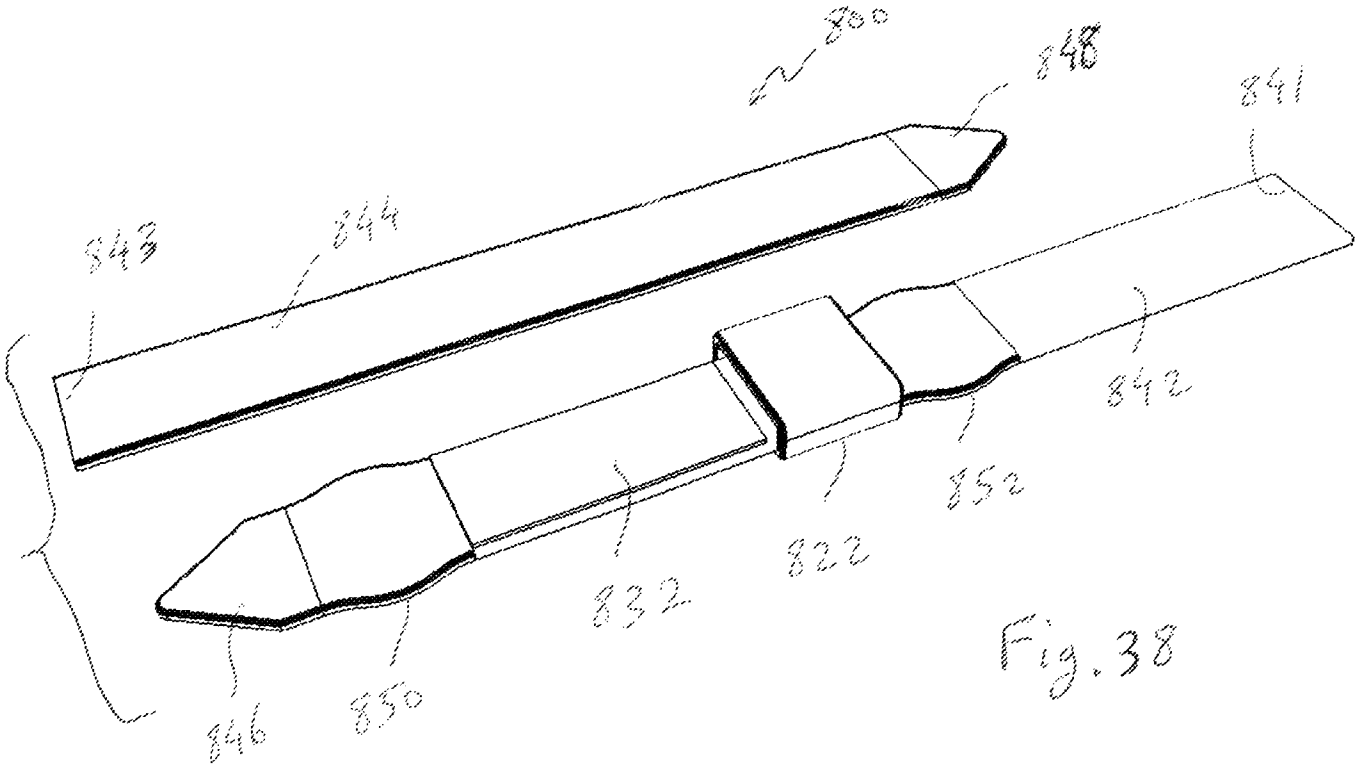
Figure 34:
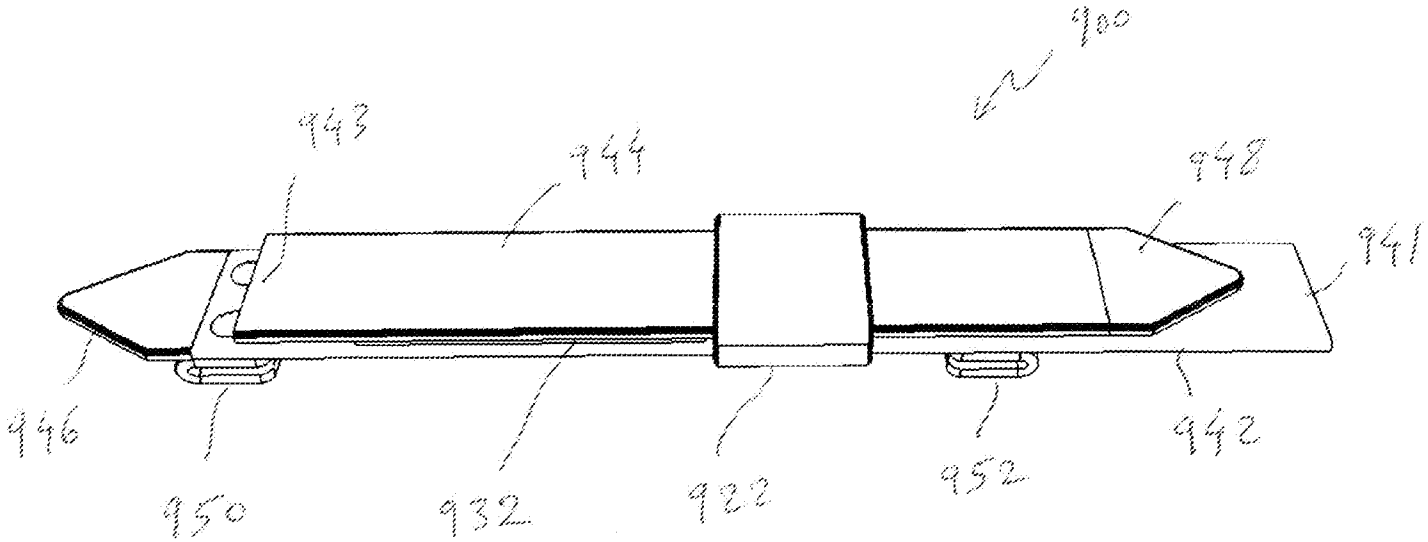
Figure 40:
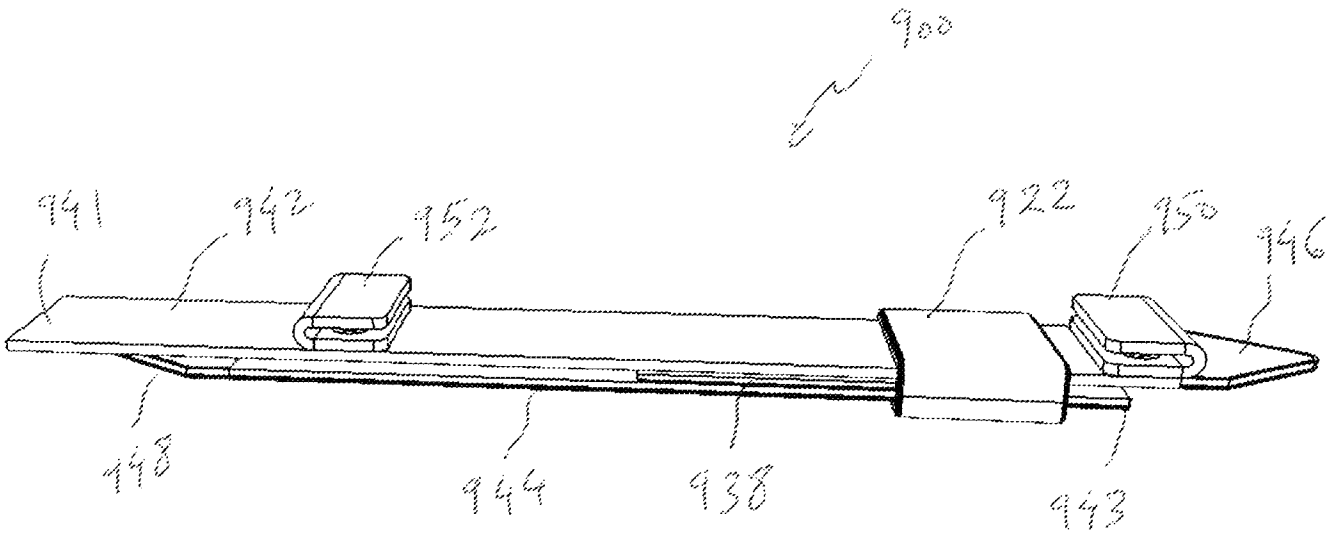
Figure 41:
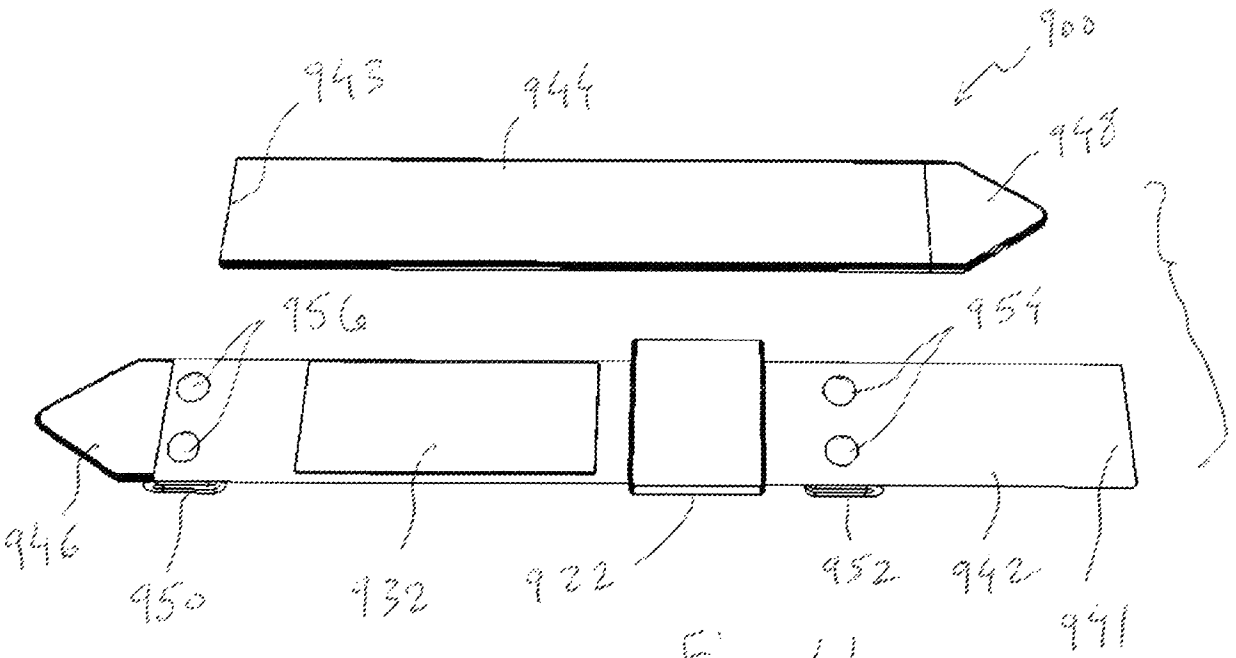
Figure 42:
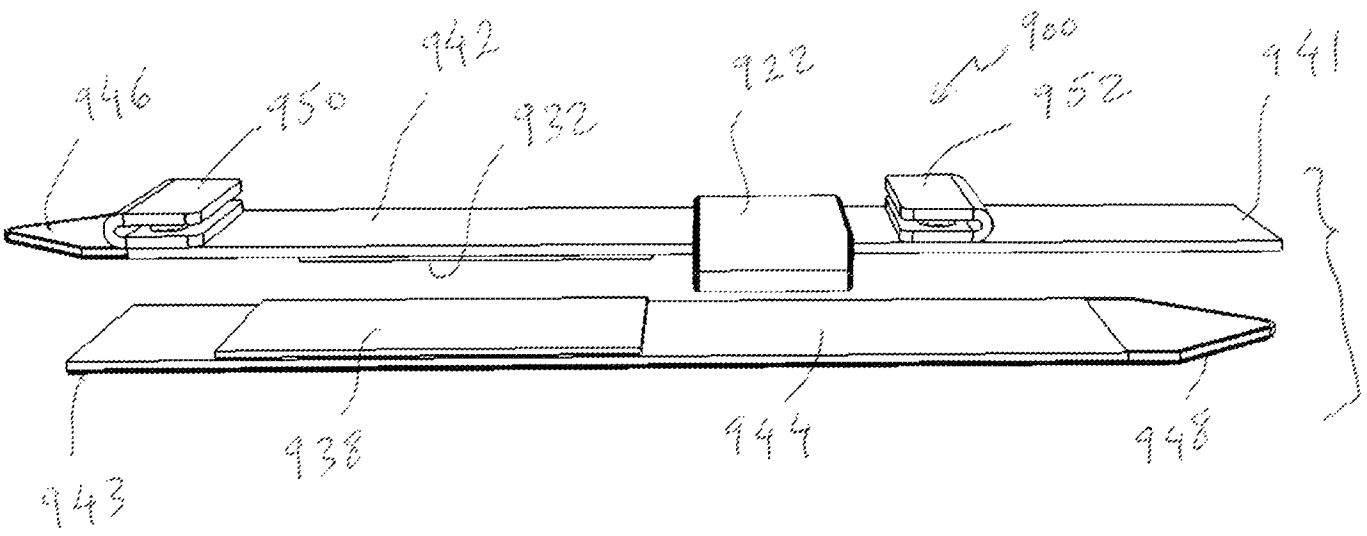
Figure 43:
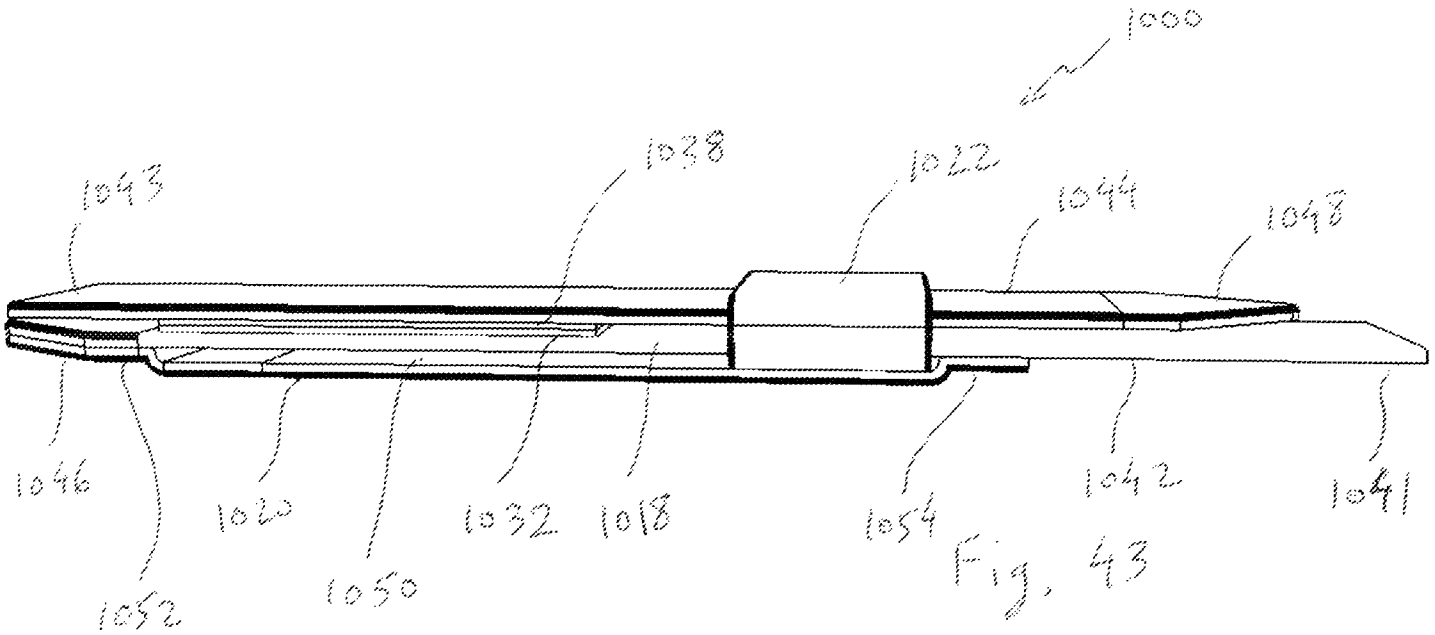
FIGS. 43-46 are views of a safety device for reins that is used for connecting the ends of the control lines for controlling and guiding a horse in accordance with a tenth embodiment of the present invention.
Figure 44:
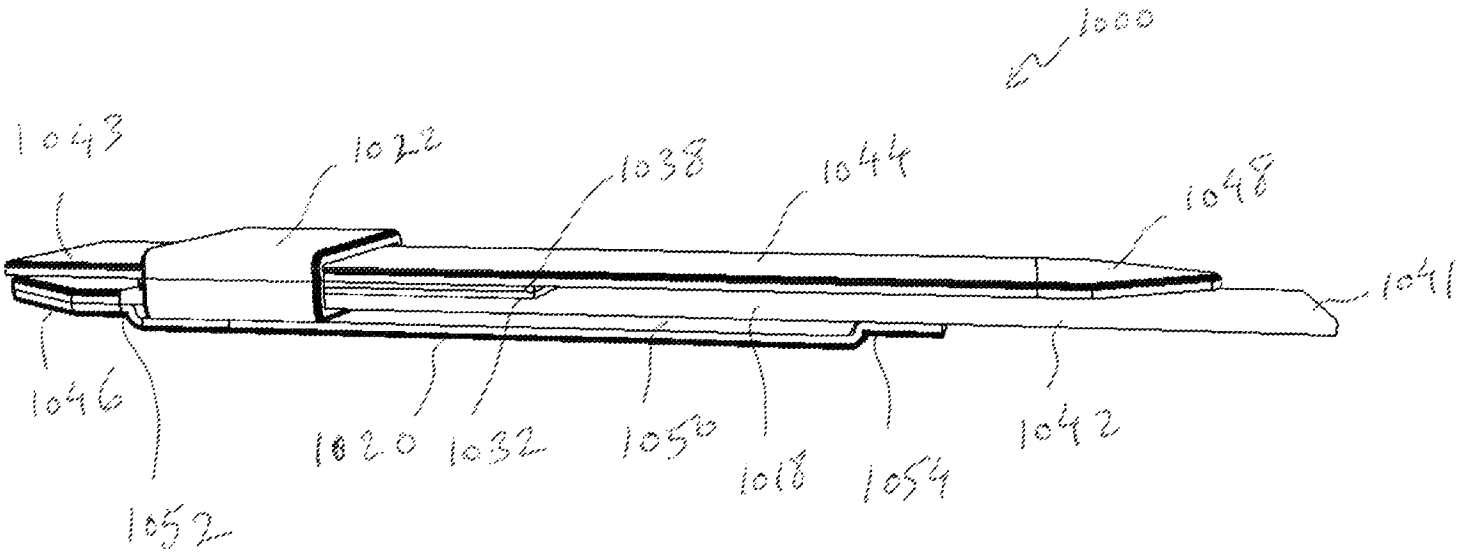
Figure 45:
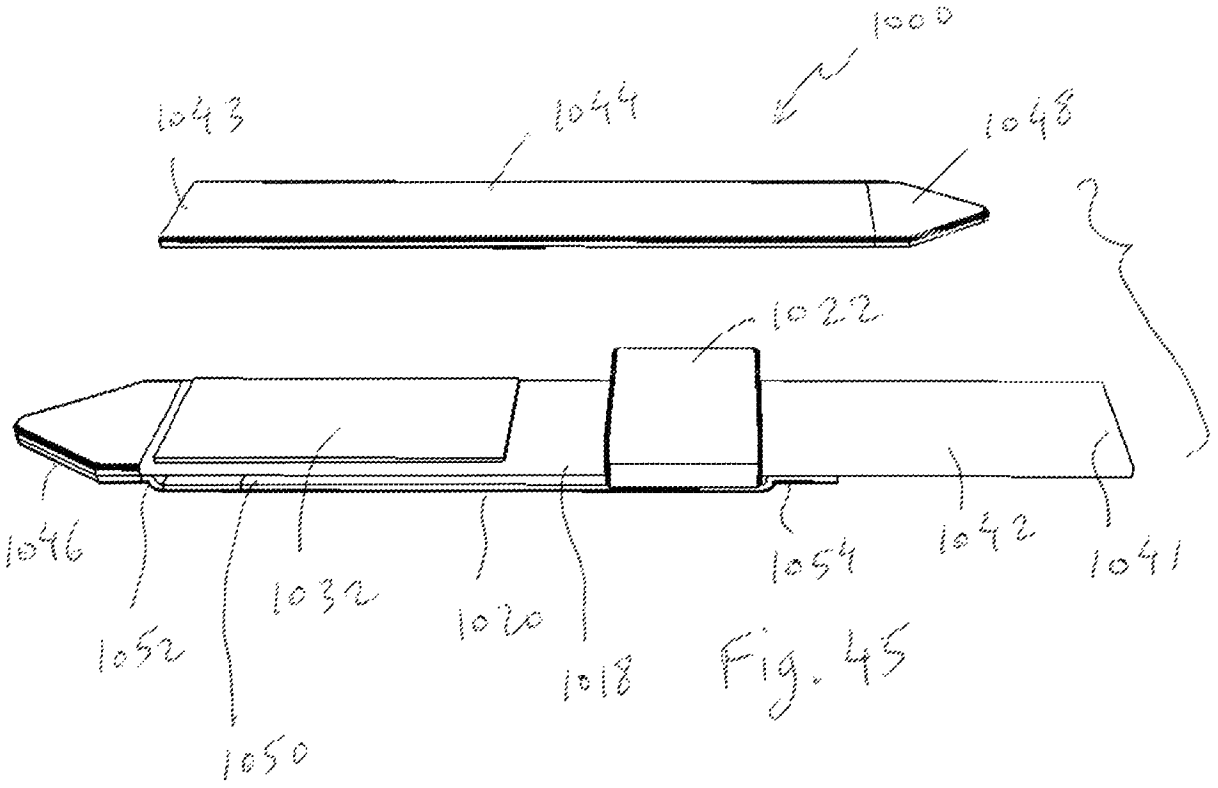
Figure 46:
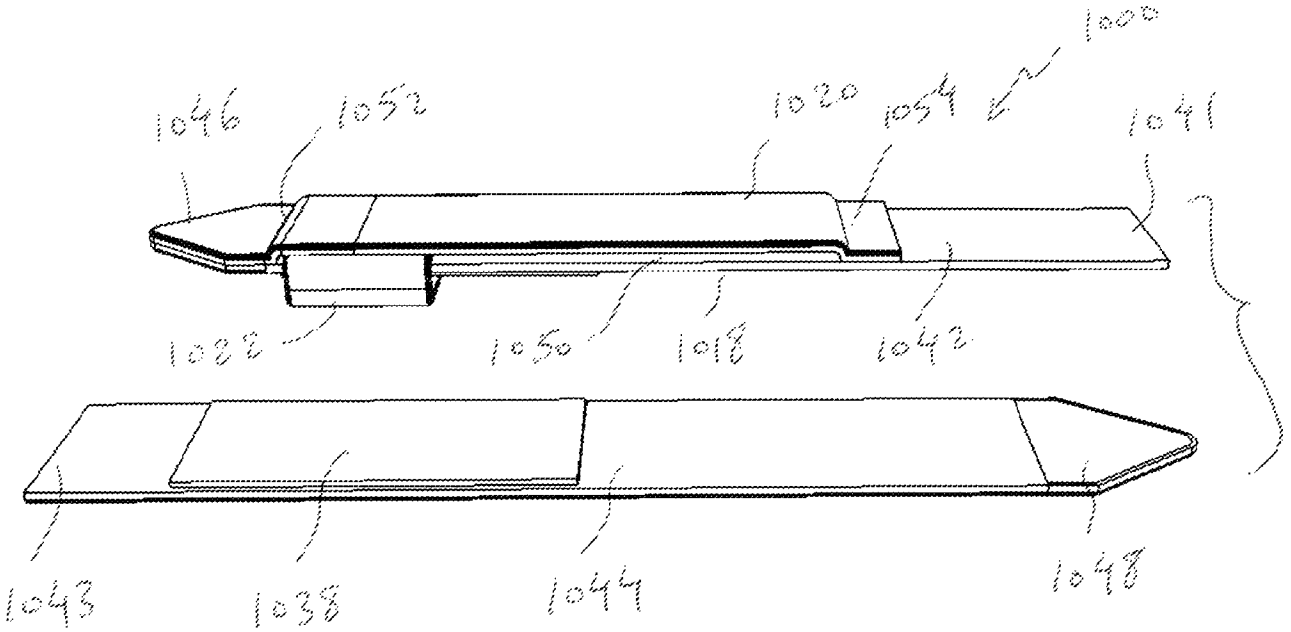
Figure 47:
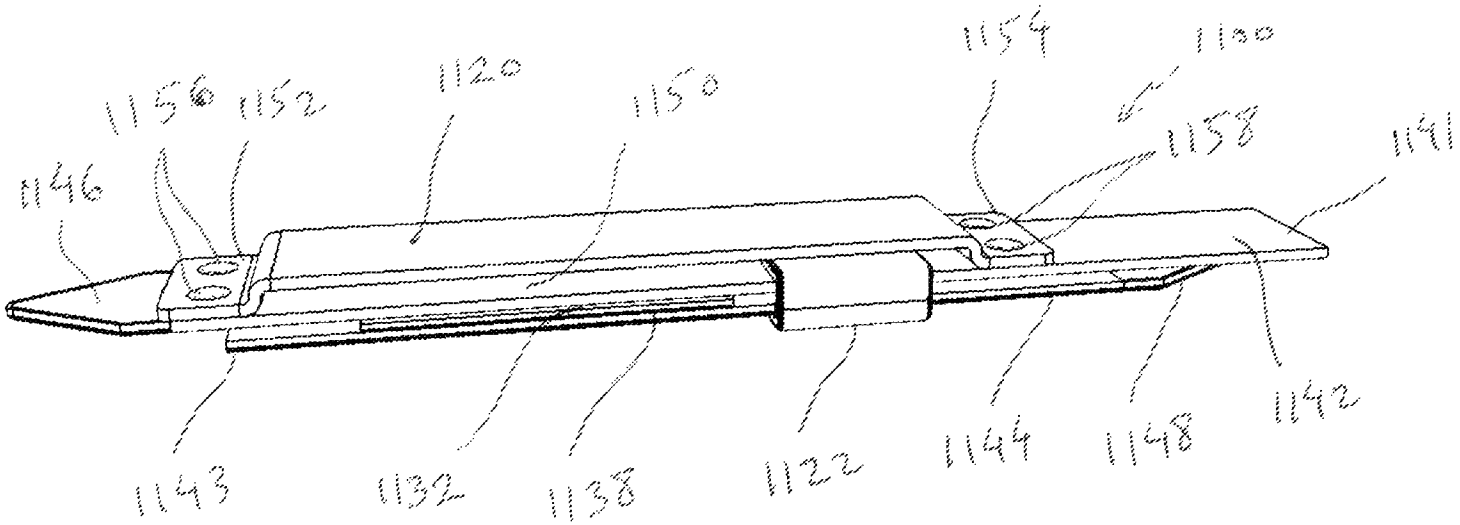
FIGS. 47-50 are views of a safety device for reins that is used for connecting the ends of the control lines for controlling and guiding a horse in accordance with an eleventh embodiment of the present invention.
Figure 48:
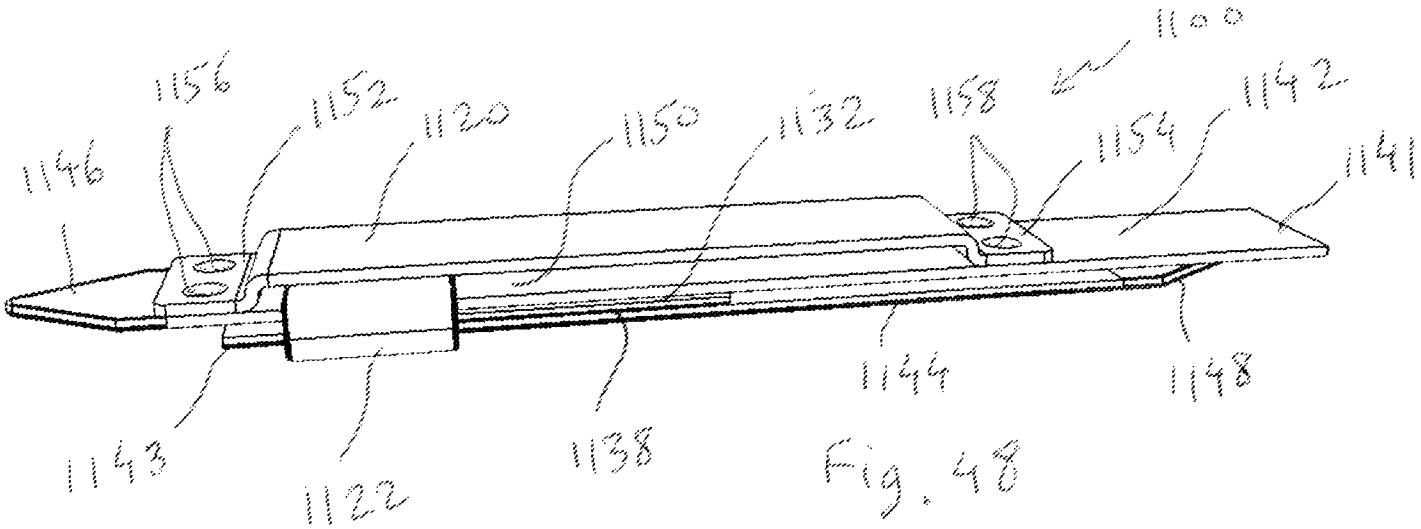
Figure 49:
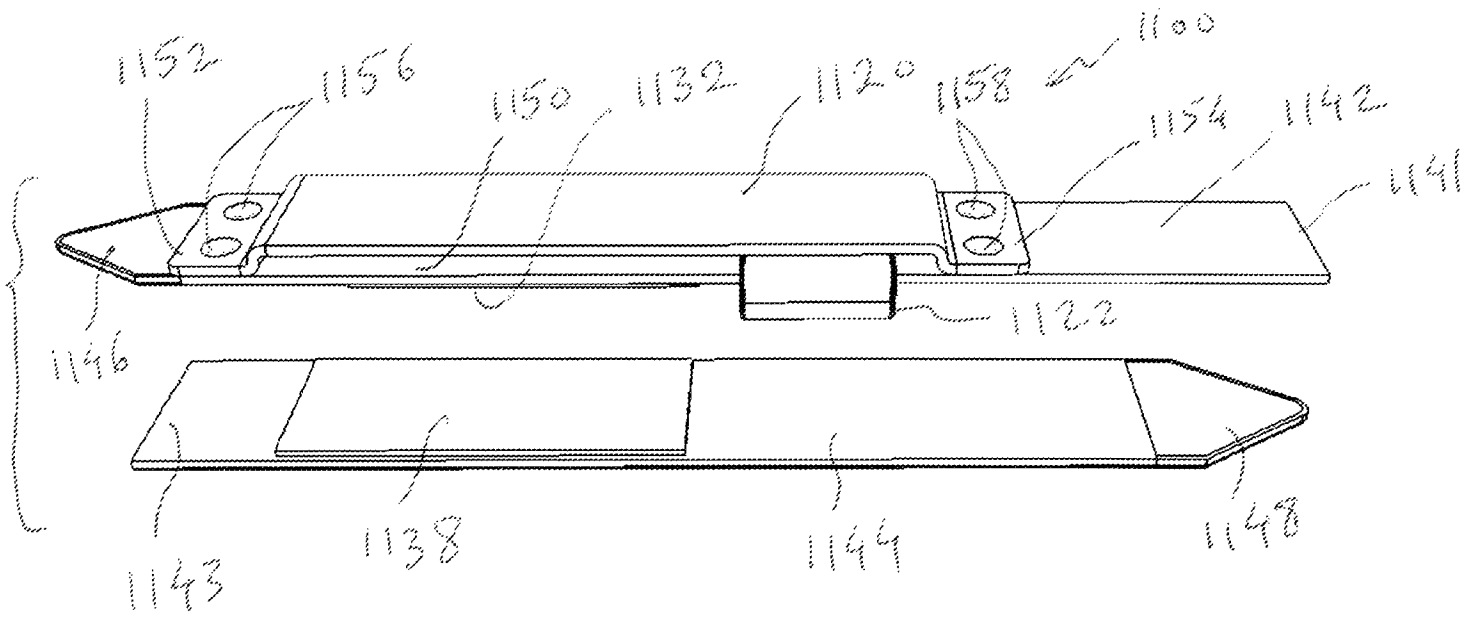
Figure 50:
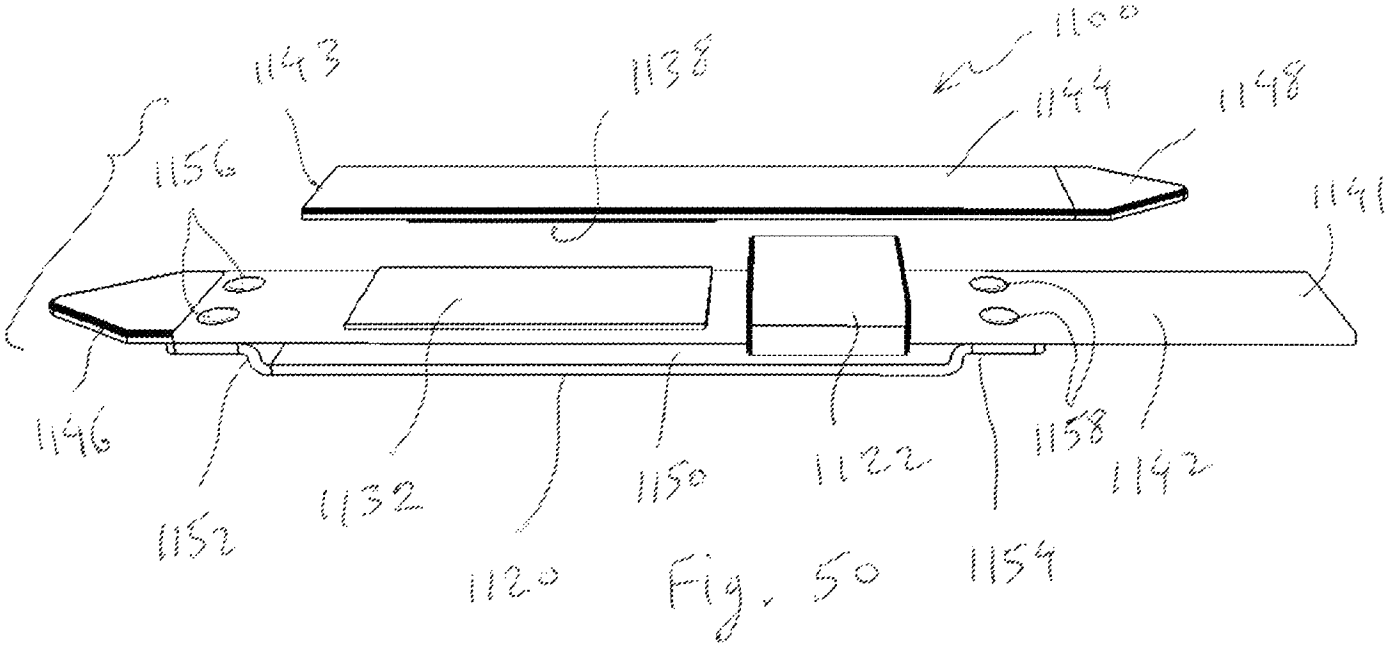

Referring to FIGS. 5-9, a first embodiment 100 of a safety connector according to the present invention can be seen. The swivel 102 includes two rings 104, 106 that are rotationally connected by a pivot pin 108. The rings 104, 106 can rotate freely relative to one another. The longitudinal axis of the journal portion of the pivot pin 108 about which at least one of the rings 104, 106 rotates defines the axis of rotation of the rings 104, 106 relative to one another. The rings 104, 106 are positioned side by side along the axis of rotation defined by the pivot pin 108 with the rings 104, 106 being positioned in tandem one after the other in a direction coincident with the axis of rotation defined by the pivot pin 108. Each ring 104, 106 defines an opening 110, 112, and the axis of rotation defined by the pivot pin approximately bisects the opening of each of the rings 104, 106. In the illustrated embodiment, the pivot pin 108 is formed by a rivet that is free to rotate relative to both rings. However, the pivot pin 108 may be fixed to one of the rings 104, 106, while the other ring is free to rotate about the pivot pin 108. A first strap portion 114 is routed through the first ring 104 of the swivel 102 and sewn back onto itself to pivotally attach the first strap portion 114 to the first ring 104. A second strap portion 116 is routed through the second ring 106 of the swivel 102 and sewn back onto itself to pivotally attach the second strap portion 116 to the second ring 106. The portions of the first strap portion 114 that are sewn together, after the first strap portion 114 is routed through the first ring 104, form an upper panel 118 of the first strap portion 114 and a lower panel 120 of the first strap portion 114. A first keeper 122 is provided near the first ring 104. The first keeper 122 is captured between the upper panel 118 of the first strap portion 114 and the lower panel 120 of the first strap portion 114. The first keeper 122 passes between the upper panel 118 of the first strap portion 114 and the lower panel 120 of the first strap portion 114, and the upper panel 118 of the first strap portion 114 and the lower panel 120 of the first strap portion 114 are sewn together on either side of the first keeper 122 to capture the first keeper 122 at a fixed location on the first strap portion 114 near the first ring 104. The portions of the second strap portion 116 that are sewn together, after the second strap portion is routed through the second ring 106, form an upper panel 124 of the second strap portion 116 and a lower panel 126 of the second strap portion 116. A second keeper 128 is provided near the second ring 106. The second keeper 128 is captured between the upper panel 124 of the second strap portion 116 and the lower panel 126 of the second strap portion 116. The second keeper 128 passes between the upper panel 124 of the second strap portion 116 and the lower panel 126 of the second strap portion 116, and the upper panel 124 of the second strap portion 116 and the lower panel 126 of the second strap portion 116 are sewn together on either side of the second keeper 128 to capture the second keeper 128 at a fixed location on the second strap portion 116 near the second ring 106.

The first strap portion 114 has a tip 130 located distally from the first ring 104. A length of the first strap portion 114 extends between the first ring 104 and the tip 130 of the first strap portion 114. A first portion of hook-and-loop fastener 132 is provided on the length of the first strap portion 114 intermediate the tip 130 of the first strap portion 114 and the first ring 104. Preferably, the first portion of hook-and-loop fastener 132 is in the form of a panel of hook or loop material lying flat against one side of the first strap portion 114 intermediate the first keeper 122 and the tip 130 of the first strap portion 114. The first portion of hook-and-loop fastener 132 may be attached to the first strap portion 114 using any suitable means including, without limitation, sewing or stitching, adhesives, rivets, snaps, buttons, and grommets. Sewing or stitching and adhesives are currently the most preferred means for attaching the first portion of hook-and-loop fastener 132 to the first strap portion 114.

The second strap portion 116 has a tip 134 located distally from the second ring 106. A length of the second strap portion 116 extends between the second ring 106 and the tip 134 of the second strap portion 116. A second portion of hook-and-loop fastener 136 is provided on the length of the second strap portion 116 intermediate the tip 134 of the second strap portion 116 and the second ring 106. Preferably, the second portion of hook-and-loop fastener 136 is in the form of a panel of hook or loop material lying flat against one side of the second strap portion 116 intermediate the second keeper 128 and the tip 134 of the second strap portion 116. The second portion of hook-and-loop fastener 136 may be attached to the second strap portion 116 using any suitable means including, without limitation, sewing or stitching, adhesives, rivets, snaps, buttons, and grommets. Sewing or stitching and adhesives are currently the most preferred means for attaching the second portion of hook-and-loop fastener 136 to the second strap portion 116. The first portion of hook-and-loop fastener 132 and the second portion of hook-and-loop fastener 136 may be of the same type or of different types.

Each portion of hook-and-loop fastener has a woven, preferably rectangular backing material. If the portion of hook-and-loop fastener is of the hook type, then a fairly dense array of small hooks are provided on the top or exposed surface of the backing material. Each hook is formed of a semi-rigid, resilient, polymeric material that projects outward from the backing material.

If the portion of hook-and-loop fastener is of the loop type, then loosely woven or matted piles of fibers that form a mat of loops of fibers are provided over the top or exposed surface of the backing material. The hook type material and the loop type material are complementary in the sense that a hook type portion of hook-and-loop fastener cooperates with a loop type portion of hook-and-loop fastener to accomplish the fastening function. Fastening is accomplished by pressing the hook type portion of hook-and-loop fastener against the loop type portion of hook-and-loop fastener with the side of one fastener portion that has the array of hooks in face to face relationship with the side of the other fastener portion that has the mat of loops. The hooks become entangled in the loops to attach the fastener portions, and in turn whatever is attached to the fastener portions, to one another. The fastener portions can be pulled apart by force starting from one end of the fastener panels to the other end to accomplish release of the fastener.

The safety connector 100 may, for example, be used to releasably attach the ends of the control lines of a harness racing sulky. The threshold tensile force required to separate the ends of the control lines of the sulky that are attached together by the safety connector 100 is well below the tensile force that would be placed on the control lines if a rider or driver entangled in the control lines were to be dragged on the ground by the horse drawn sulky.

To retrofit the safety connector to the control lines of a sulky, the connector 50 having the center swivel and two buckles is first removed. Then third and fourth portions of hook-and-loop fastener 138, 140 are attached, for example by adhesive, sewing, or stitching, to respective ends 142, 144 of the control lines of the sulky. The respective ends 142, 144 of the control lines of the sulky define third and fourth strap portions 142, 144. In the illustrative example, the third portion of hook-and-loop fastener 138 is at least complementary with the first portion of hook-and-loop fastener 132 so that the first strap portion 114 can be releasably attached to the third strap portion 142. Similarly, the fourth portion of hook-and-loop fastener 140 is at least complementary with the second portion of hook-and-loop fastener 136 so that the second strap portion 116 can be releasably attached to the fourth strap portion 144. Once the first portion of hook-and-loop fastener 132 and the third portion of hook-and-loop fastener 138 are engaged together and the second portion of hook-and-loop fastener 136 and the fourth portion of hook-and-loop fastener 140 are engaged together, the safety connector 100 will keep the ends of the sulky's control lines attached together during normal operation, just as was the case with the connector 50 having the center swivel and two buckles. However, if the sulky rider or driver were to fall off the sulky with his or her leg or other extremity entangled with the sulky control lines, the safety connector 100 will allow the ends of the control lines, i.e. the third and fourth strap portions 142, 144, to separate and release the entangled leg or extremity of the fallen rider or driver and thus stop the rider or driver being dragged on the ground by the horse drawn sulky.

Preferably, the tip 146 of the third strap portion 142 is first placed through the first keeper 122 before the third portion of hook-and-loop fastener 138 and the first portion of hook-and-loop fastener 132 are engaged together. The first keeper 122 prevents the tip of the third strap portion 142 from being lifted off inadvertently, which reduces the likelihood of the first portion of hook-and-loop fastener 132 and the third portion of hook-and-loop fastener 138 becoming disengaged inadvertently. Similarly, the tip 148 of the fourth strap portion 144 is first placed through the second keeper 128 before the fourth portion of hook-and-loop fastener 140 and the second portion of hook-and-loop fastener 136 are engaged together. The second keeper 128 prevents the tip of the fourth strap portion 144 from being lifted off inadvertently, which reduces the likelihood of the second portion of hook-and-loop fastener 136 and the fourth portion of hook-and-loop fastener 140 becoming disengaged inadvertently.

The first portion of hook-and-loop fastener 132 can be disengaged from the third portion of hook-and-loop fastener 138 by grasping the tip 130 of the first strap portion 114 and pulling on it with sufficient force to thereby pull the first strap portion 114 away from the third strap portion 142 and thereby disengage the first portion of hook-and-loop fastener 132 from the third portion of hook-and-loop fastener 138. Similarly, the second portion of hook-and-loop fastener 136 can be disengaged from the fourth portion of hook-and-loop fastener 140 by grasping the tip 134 of the second strap portion 116 and pulling on it with sufficient force to thereby pull the second strap portion 116 away from the fourth strap portion 144 and thereby disengage the second portion of hook-and-loop fastener 136 from the fourth portion of hook-and-loop fastener 140. Thus, the ends of the control lines, i.e. the third and fourth strap portions 142, 144, can be detached or separated from one another when needed or the safety connector 100 can be removed entirely by a user when desired.

Referring to FIGS. 10-13, a second embodiment 200 of a safety connector according to the present invention can be seen. The safety connector 200 includes the swivel 102 that is identically as described for the safety connector 100. The swivel 102 includes two rings 104, 106 that are rotationally connected by a pivot pin 108.

A first strap portion 114 is routed through the first ring 104 of the swivel 102 and sewn back onto itself to pivotally attach the first strap portion 114 to the first ring 104. A second strap portion 216 is routed through the second ring 106 of the swivel 102 and sewn back onto itself to pivotally attach the second strap portion 216 to the second ring 106. The first strap portion 114, the first keeper 122, and the upper and lower panels 118, 120 are exactly as described for safety connector 100 and will not be repeated here. The portions of the second strap portion 216 that are sewn together, after the second strap portion 216 is routed through the buckle frame 237, form an upper panel 224 of the second strap portion 216 and a lower panel 226 of the second strap portion 216. A second keeper 228 is provided on the second strap portion 216. The second keeper 228 is captured between the upper panel 224 of the second strap portion 216 and the lower panel 226 of the second strap portion 216. The second keeper 228 passes between the upper panel 224 of the second strap portion 216 and the lower panel 226 of the second strap portion 216, and the upper panel 224 of the second strap portion 216 and the lower panel 226 of the second strap portion 216 are sewn together on either side of the second keeper 228 to capture the second keeper 228 at a fixed location on the second strap portion 216. Optionally, one or more spacer panels of, for example, strap material may be provided between the upper panel of the second strap portion 216 and the lower panel of the second strap portion 216. Spacer panels may be provided on either side of the portion of the second keeper 228 captured between the upper panel of the second strap portion 216 and the lower panel of the second strap portion 216. Alternatively, the spacer panel may be one continuous panel extending under the portion of the second keeper 228 captured between the upper panel 224 of the second strap portion 216 and the lower panel 226 of the second strap portion 216. Spacer panels may be applied to any of the strap portions of any of the disclosed embodiments.

The first strap portion 114 has a tip 130 located distally from the first ring 104. A length of the first strap portion 114 extends between the first ring 104 and the tip 130 of the first strap portion 114. A first portion of hook-and-loop fastener 132 is provided on the length of the first strap portion 114 intermediate the tip 130 of the first strap portion and the first ring 104.

The second strap portion 216 has a distal end 234 located distally from the second ring 106. A length of the second strap portion 216 extends between the second ring 106 and the distal end of the second strap portion 216. A buckle 236 is provided that is attached to the distal end of the second strap portion 216. The second keeper 228 is provided intermediate the buckle 236 and the second ring 106 at a position nearer to the buckle 236 than to the second ring 106.

The buckle 236 includes a frame 237 that surrounds and defines a central opening. The buckle 236 also includes a prong 239 that is pivotally attached to one side of the frame 237. When the prong 239 is in a first or lowered position, the prong 239 extends across the central opening of the buckle 236 to the other side of the frame 237. When the prong 239 is in the first or lowered position, the prong 239 at least in part overlies the other side of the frame 237 that is across the central opening from the pivotal connection between the prong 239 and the frame 237. Also, when the prong 239 is in the first or lowered position, the prong is in contact with, in other words touches, the other side of the frame 237 that is across the central opening from the pivotal connection between the prong 239 and the frame 237. The side of the frame 237 to which the prong 239 is pivotally connected defines the pivot axis of the prong 239. The prong 239 is pivotally moved to a second or raised position relative to the frame 237 to allow a portion of the fourth strap portion 144 to be threaded through the central opening of the frame 237. The prong 239 can then be engaged to one of the holes 240 in the fourth strap portion 144 and then allowed to move to the lowered position to fix the position of the fourth strap portion 144 relative to the buckle 236 while also securing the fourth strap portion 144 to the buckle 236. The end of the fourth strap portion that lead the fourth strap portion 144 through the central opening of the frame 237, referred to as the leading end or the tip herein, is then passed through the second keeper 228 attached to the second strap portion 216 so that the portion of the fourth strap portion 144 that has passed through the frame 237 will lie flat against the second strap portion 216 to which the frame 237 is pivotally attached.

The second strap portion 216 is routed over one side of the frame 237 and sewn back on itself to capture the frame 237 and pivotally attach the frame 237 to the second strap portion 216 and thereby attach the buckle 236 to the second strap portion 216. With this arrangement, the buckle 236 is semi-permanently attached to the second strap portion 216. The term "semi-permanently" as used herein simply means that the attachment is not designed to be readily releasable during normal use of the buckle as distinguished from the attachment of the fourth strap portion 144 to the buckle 236 that is designed to be selectively releasable as desired by a user. The buckle frame 237 and the prong 239 are free to pivot relative to the second strap portion 216, which is semi-permanently attached to the buckle frame 237. The portions of the second strap portion 216 that are sewn together, after the second strap portion is routed through the frame 237, form an upper panel 224 of the second strap portion 216 and a lower panel 226 of the second strap portion 216. The second keeper 228 is captured between the upper panel 224 of the second strap portion 216 and the lower panel 226 of the second strap portion 216. The second keeper 228 passes between the upper panel 224 of the second strap portion 216 and the lower panel 226 of the second strap portion 216, and the upper panel 224 of the second strap portion 216 and the lower panel 226 of the second strap portion 216 are sewn together on either side of the second keeper 228 to capture the second keeper 228 at a fixed location on the second strap portion 216. The portion of the fourth strap portion 144 that is routed through the second keeper 228 passes between the second keeper and the upper panel 224 of the second strap portion 216. The upper panel 224 of the second strap portion 216 and the lower panel 226 of the second strap portion 216 need not be parts of a continuous strap portion as illustrated, but may be formed by separate pieces that are sewn together with or without a spacer panel positioned between them. The portion of the second strap portion 216 positioned to surround the member of the frame 237 has an opening 238 for the prong 239 that allows the prong 239 to extend through the second strap portion 216. The opening 238 is large enough so that the prong 239 can pivot freely about the frame member and in relation to the second strap portion 216.

The safety connector 200 may, for example, be used to releasably attach the ends of the control lines of a harness racing sulky. The threshold tensile force required to separate the ends of the control lines of the sulky that are attached together by the safety connector 200 is well below the tensile force that would be placed on the control lines if a rider or driver entangled in the control lines were to be dragged on the ground by the horse drawn sulky.

To retrofit the safety connector 200 to the control lines of a sulky, the connector 50 having the center swivel and two buckles is first removed. Then a complementary portion of hook-and-loop fastener 138 is attached, for example by adhesive, sewing, or stitching, to the end portion of one of the control lines of the sulky. The end portion of the one control line provided with the complementary portion of hook-and-loop fastener 138 defines a third strap portion 142, while the end portion of the control line without any hook-and-loop fastener portion defines a fourth strap portion 144. In the illustrative example, the complementary portion of hook-and-loop fastener 138 is complementary with the first portion of hook-and-loop fastener 132 so that the first strap portion 114 can be releasably attached to the third strap portion 142. The second strap portion 216 can be releasably attached to the fourth strap portion 144 using the buckle 236 and the holes 240 in the fourth strap portion 144. Once the first portion of hook-and-loop fastener 132 and the complementary portion of hook-and-loop fastener 138 are engaged together and the buckle 236 and the fourth strap portion 144 are engaged together, the safety connector 200 will keep the ends of the sulky's control lines attached together during normal operation, just as was the case with the connector 50 having the center swivel and two buckles. However, if the sulky rider or driver were to fall off the sulky with his or her leg or other extremity entangled with the sulky control lines, the safety connector 200 will allow the ends of the control lines, i.e. the third and fourth strap portions 142, 144, to separate and release the entangled leg or extremity of the fallen rider or driver and thus stop the rider or driver being dragged on the ground by the horse drawn sulky.

Preferably, the tip 146 of the third strap portion 142 is first placed through the first keeper 122 before the complementary portion of hook-and-loop fastener 138 and the first portion of hook-and-loop fastener 132 are engaged together. The first keeper 122 prevents the tip of the third strap portion 142 from being lifted off inadvertently, which reduces the likelihood of the first portion of hook-and-loop fastener 132 and the complementary portion of hook-and-loop fastener 138 becoming disengaged inadvertently.

The first portion of hook-and-loop fastener 132 can be disengaged from the complementary portion of hook-and-loop fastener 138 by grasping the tip of the first strap portion 114 and pulling on it with sufficient force to thereby pull the first strap portion 114 away from the third strap portion 142 and thereby disengage the first portion of hook-and-loop fastener 132 from the complementary portion of hook-and-loop fastener 138. The second strap portion 216 can be disengaged from the fourth strap portion 144 by undoing the fourth strap portion 144 from the buckle 236. Thus, the ends of the control lines, i.e. the third and fourth strap portions 142, 144, can be detached or separated from one another when needed or the safety connector 200 can be removed entirely by a user when desired.

Referring to FIGS. 14-17, a third embodiment 300 of a safety connector according to the present invention can be seen. The swivel 102 and the first strap portion 114 and their parts are exactly as described previously. The second strap portion 316 is routed through the second ring 106 of the swivel and sewn back onto itself to pivotally attach the second strap portion 316 to the second ring 106.

The second strap portion 316 has a distal end or tip 334 located distally from the second ring 106. A length of the second strap portion 316 extends between the second ring 106 and the distal end 334 of the second strap portion 316. The second strap portion 316 is provided with a plurality of holes 336 that are distributed along the length of the second strap portion 316 intermediate the tip 334 and the second ring 106.

The safety connector 300 may, for example, be used to releasably attach the ends of the control lines of a harness racing sulky or the ends of the control lines connected to the bit or bridle of a horse. The threshold tensile force required to separate the ends of the control lines that are attached together by the safety connector is well below the tensile force that would be placed on the control lines if a rider or driver entangled in the control lines were to be dragged on the ground by the horse or the horse drawn sulky.

To retrofit the safety connector to the control lines of a sulky, for example, one of the control lines is disconnected from the connector 50 having the center swivel and two buckles 51. This leaves one of the buckles 51 of the connector having the center swivel and two buckles free. Then a complementary portion of hook-and-loop fastener 138 is attached, for example by adhesive, sewing, or stitching, to end portion 142 of the control line of the sulky that was disconnected from the connector having the center swivel and two buckles. The end portion of the one control line provided with the complementary portion of hook-and-loop fastener 138 defines a third strap portion 142, while the strap portion 49 of the connector 50 having the free buckle defines a fourth strap portion 49. In the illustrative example, the complementary portion of hook-and-loop fastener 138 is complementary with the first portion of hook-and-loop fastener 132 so that the first strap portion 114 can be releasably attached to the third strap portion 142. The second strap portion 316 can be releasably attached to the fourth strap portion 49 using the buckle 51 and the holes 336 in the second strap portion 316. Once the first portion of hook-and-loop fastener 132 and the complementary portion of hook-and-loop fastener 138 are engaged together and the buckle 51 and the second strap portion 316 are engaged together, the safety connector 300 will keep the ends of the sulky's control lines attached together during normal operation, just as was the case with the connector 50 having the center swivel and two buckles. However, if the sulky rider or driver were to fall of the sulky with his or her leg or other extremity entangled with the sulky control lines, the safety connector will allow the ends of the control lines, i.e. the third and fourth strap portions, to separate and release the entangled leg or extremity of the fallen rider or driver and thus stop the rider or driver being dragged on the ground by the horse drawn sulky.

The first portion of hook-and-loop fastener 132 can be disengaged from the complementary portion of hook-and-loop fastener 138 by grasping the tip of the first strap portion 114 and pulling on it with sufficient force to thereby pull the first strap portion 114 away from the third strap portion 142 and thereby disengage the first portion of hook-and-loop fastener 132 from the complementary portion of hook-and-loop fastener 138. The second strap portion 316 can be disengaged from the fourth strap portion 49 by undoing the second strap portion 316 from the buckle 51. Thus, the ends of the control lines, i.e. the third and fourth strap portions 142, 49, can be detached or separated from one another when needed or the safety connector 300 can be removed entirely by a user when desired.

In the case of the control lines or reins for a riding or saddle horse, the ends of the control lines are ordinarily attached using a buckle. That buckle could be used for engagement with the second strap portion 316 of the safety connector 300.

Referring to FIGS. 18-21, an embodiment of a safety device 400 according to the present invention can be seen. The safety device 400 is for use with the left and right control lines for controlling a horse or horse-drawn wheeled carriage, e.g. sulky. The respective ends of the control lines may define first and second strap portions 442, 444 or are otherwise operably connected to the first and second strap portions 442, 444. The first strap portion 442 has a tip 446 located distally from the head of a horse when in use. A length of the first strap portion 442 extends from the tip 446 of the first strap portion. A first portion of hook-and-loop fastener 432 is provided on the length of the first strap portion 442 proximate the tip of the first strap portion. Preferably, the first portion of hook-and-loop fastener 432 is in the form of a panel of hook or loop material lying flat against one side of the first strap portion 442 near the tip of the first strap portion. The first portion of hook-and-loop fastener 432 may be attached to the first strap portion using any suitable means including, without limitation, sewing or stitching, adhesives, rivets, snaps, buttons, and grommets. Sewing or stitching and adhesives are currently the most preferred means for attaching the first portion of hook-and-loop fastener 432 to the first strap portion 442.

The second strap portion 444 has a tip 448 located distally from the head of a horse when in use. A length of the second strap portion 444 extends from the tip 448 of the second strap portion. A second portion of hook-and-loop fastener 438 is provided on the length of the second strap portion 444 proximate the tip 448 of the second strap portion 444. Preferably, the second portion of hook-and-loop fastener 438 is in the form of a panel of hook or loop material lying flat against one side of the second strap portion 444 near the tip 448 of the second strap portion 444. The second portion of hook-and-loop fastener 438 may be attached to the second strap portion using any suitable means including, without limitation, sewing or stitching, adhesives, rivets, snaps, buttons, and grommets. Sewing or stitching and adhesives are currently the most preferred means for attaching the second portion of hook-and-loop fastener 438 to the second strap portion 444. At least one of the first and second strap portions is provided with a first keeper 422 thereon near the respective portion of hook-and-loop fastener, the respective portion of hook-and-loop fastener being located intermediate the tip of the respective strap portion and the first keeper 422. In the illustrative example, the first keeper 422 is provided on the first strap portion 442. Preferably, at least the first strap portion includes an upper panel 418 and a lower panel 420 that are sewn or stitched together. The first keeper 422 is captured between the upper panel 418 of the first strap portion 442 and the lower panel 420 of the first strap portion 442. The first keeper 422 passes between the upper panel 418 of the first strap portion and the lower panel 420 of the first strap portion, and the upper panel 418 of the first strap portion 442 and the lower panel 420 of the first strap portion 442 are sewn together on either side of the first keeper 422 to capture the first keeper 422 at a fixed location on the first strap portion 442. The first portion of hook-and-loop fastener 432 and the second portion of hook-and-loop fastener 438 are of complementary types. Each portion of hook-and-loop fastener is as has been described previously.

The safety device 400 may, for example, be used to releasably attach the ends of the control lines of a harness racing sulky. The threshold tensile force required to separate the ends of the control lines of the sulky that are attached together in accordance with the safety device of the present invention is well below the tensile force that would be placed on the control lines if a rider or driver entangled in the control lines were to be dragged on the ground by the horse drawn sulky.

Preferably, the tip of the second strap portion 444 is first placed through the first keeper 422 before the second portion of hook-and-loop fastener 438 and the first portion of hook-and-loop fastener 432 are engaged together. The first keeper 422 prevents the tip of the second strap portion 444 from being lifted off inadvertently, which reduces the likelihood of the first portion of hook-and-loop fastener 432 and the second portion of hook-and-loop fastener 438 becoming disengaged inadvertently. A second keeper may optionally be provided on the second strap portion 444.

The first portion of hook-and-loop fastener 432 can be disengaged from the second portion of hook-and-loop fastener 438 by grasping the tip of the first strap portion 442 and pulling on it with sufficient force to thereby pull the first strap portion 442 away from the second strap portion 444 and thereby disengage the first portion of hook-and-loop fastener 432 from the second portion of hook-and-loop fastener 438. Thus, the ends of the control lines can be detached or separated from one another when needed.

Preferably, the threshold tensile force required to separate or disengage the portions of hook-and-loop fastener from each other is in the range of 1 to 100 pounds. Even more preferably, the threshold tensile force required to separate or disengage the portions of hook-and-loop fastener from each other is in the range of 1 to 75 pounds. Yet more preferably, the threshold tensile force required to separate or disengage the portions of hook-and-loop fastener from each other is in the range of 1 to 50 pounds. Yet more preferably, the threshold tensile force required to separate or disengage the portions of hook-and-loop fastener from each other is in the range of 1 to 30 pounds. Yet more preferably, the threshold tensile force required to separate or disengage the portions of hook-and-loop fastener from each other is in the range of 1 to 15 pounds.

Referring to FIGS. 22-25, another embodiment 500 of the safety device in accordance with the present invention can be seen. The safety device 500 is essentially identical to the safety device 400. Therefore, only the features unique to the embodiment 500 are described in detail below.

The safety device 500 includes a releasable fastener system. In the safety device 500, the length of the second strap portion 544 extending between the second portion of a hook-and-loop fastener 538 and the tip 548 of the second strap portion 544 is longer than the length of the second strap portion 444 extending between the second portion of a hook-and-loop fastener 438 and the tip 448 of the second strap portion 444. The length of the second strap portion 544 extending between the second portion of a hook-and-loop fastener 538 and the tip 548 of the second strap portion 544 is at least long enough such that the second strap portion 544 can extend through the at least one keeper 522 when about two thirds of the length of the second portion of a hook-and-loop fastener 538 is overlapping and in engagement with the first portion of a hook-and-loop fastener 532 to thereby allow the amount of engagement between the second portion of a hook-and-loop fastener 538 and the first portion of a hook-and-loop fastener 532 to be varied over a range of from about full engagement to about two thirds engagement, in terms of the portion of the length of the second portion of a hook-and-loop fastener 538 that overlaps and is in engagement with the first portion of a hook-and-loop fastener 532. The ability to vary the amount of engagement between the second portion of a hook-and-loop fastener 538 and the first portion of a hook-and-loop fastener 532 allows the threshold tensile force for disengaging the second strap portion 544 from the first strap portion 542 to be adjusted to suit a user's needs or preferences.

Preferably, the length of the second strap portion 544 extending between the second portion of the hook-and-loop fastener 538 and the tip 548 of the second strap portion 544 is at least long enough such that the second strap portion can extend through the at least one keeper 522 when about one half of the length of the second portion of the hook-and-loop fastener 538 is overlapping and in engagement with the first portion of the hook-and-loop fastener 532 to thereby allow the amount of engagement between the second portion of the hook-and-loop fastener 538 and the first portion of the hook-and-loop fastener 532 to be varied over a range of from about full engagement to about one half engagement, in terms of a portion of the length of the second portion of the hook-and-loop fastener 538 that overlaps and is in engagement with the first portion of a hook-and-loop fastener 532.

More preferably, the length of the second strap portion 544 extending between the second portion of the hook-and-loop fastener 538 and the tip 548 of the second strap portion 544 is at least long enough such that the second strap portion can extend through the at least one keeper 522 when about one third of the length of the second portion of the hook-and-loop fastener 538 is overlapping and in engagement with the first portion of the hook-and-loop fastener 532 to thereby allow the amount of engagement between the second portion of the hook-and-loop fastener 538 and the first portion of the hook-and-loop fastener 532 to be varied over a range of from about full engagement to about one third engagement, in terms of a portion of the length of the second portion of the hook-and-loop fastener 538 that overlaps and is in engagement with the first portion of a hook-and-loop fastener 532.

Yet more preferably, the length of the second strap portion 544 extending between the second portion of the hook-and-loop fastener 538 and the tip 548 of the second strap portion 544 is at least long enough such that the second strap portion can extend through the at least one keeper 522 when about one fourth of the length of the second portion of the hook-and-loop fastener 538 is overlapping and in engagement with the first portion of the hook-and-loop fastener 532 to thereby allow the amount of engagement between the second portion of the hook-and-loop fastener 538 and the first portion of the hook-and-loop fastener 532 to be varied over a range of from about full engagement to about one fourth engagement, in terms of a portion of the length of the second portion of the hook-and-loop fastener 538 that overlaps and is in engagement with the first portion of a hook-and-loop fastener 532.

Still more preferably, the length of the second strap portion 544 extending between the second portion of the hook-and-loop fastener 538 and the tip 548 of the second strap portion 544 is at least long enough such that the second strap portion can extend through the at least one keeper 522 when about one fifth of the length of the second portion of the hook-and-loop fastener 538 is overlapping and in engagement with the first portion of the hook-and-loop fastener 532 to thereby allow the amount of engagement between the second portion of the hook-and-loop fastener 538 and the first portion of the hook-and-loop fastener 532 to be varied over a range of from about full engagement to about one fifth engagement, in terms of a portion of the length of the second portion of the hook-and-loop fastener 538 that overlaps and is in engagement with the first portion of a hook-and-loop fastener 532.

Referring to FIGS. 26-30, another embodiment 600 of the safety device in accordance with the present invention can be seen. The safety device 600 is for use with control lines for guiding a horse. The safety device 600 includes a first strap portion 642, a second strap portion 644, a first portion of a hook-and-loop fastener 632, a second portion of a hook-and-loop fastener 638, and at least one keeper 622.

The first strap portion 642 is operably connected to one of the head portion of the first control line and the head portion of the second control line. The first strap portion 642 has a first end 641 and a second end 646. The first strap portion 642 is operably connected to the one of the head portion of the first control line and the head portion of the second control line through its first end 641. The second end of the first strap portion 642 defines the tip 646 of the first strap portion 642.

The second strap portion 644 is operably connected to the other one of the head portion of the first control line and the head portion of the second control line. The second strap portion 644 has a first end 643 and a second end 648. The second strap portion is operably connected to the other one of the head portion of the first control line and the head portion of the second control line through its first end 643. The second end of the second strap portion 644 defines the tip 648 of the second strap portion 644.

The first portion of the hook-and-loop fastener 632 is attached to the first strap portion 642 in the same manner as the first portion of the hook-and-loop fastener 432 is attached to the first strap portion 442. The first portion of the hook-and-loop fastener 632 is in the form of a panel lying flat against one side of the first strap portion 642.

The second portion of the hook-and-loop fastener 638 is attached to the second strap portion 644 in the same manner as the first portion of the hook-and-loop fastener 632 is attached to the first strap portion 642. The second portion of the hook-and-loop fastener 638 is in the form of a panel lying flat against one side of the second strap portion 644.

The at least one keeper 622 is received for sliding movement on one of the first strap portion 642 and the second strap portion 644. In the illustrated example of FIGS. 26-30, the keeper 622 is received for sliding movement on the first strap portion 642. When the first portion of the hook-and-loop fastener 632 is fastened to the second portion of the hook-and-loop fastener 638, at least a portion of the cross section of one of the first and second strap portions 642, 644 and the entire cross section of the other of the first and second strap portions 642, 644 extend through the keeper 622. In the illustrated example of FIGS. 26-30, the entire cross sections of both of the first and second strap portions 642, 644 extend through the keeper 622.

The threshold tensile force required to separate the first strap portion 642 and the second strap portion 644 is lower than the tensile force that would be placed on the control lines for guiding the horse if a rider or driver entangled in the control lines were to be dragged on the ground by the horse or a horse drawn vehicle. The keeper 622 is movable by sliding along the length of the first strap portion 642 and the second strap portion 644 that corresponds to at least a portion of the length of one of the first portion of the hook-and-loop fastener 632 and the second portion of the hook-and-loop fastener 638 to thereby allow the threshold tensile force for disengaging the first strap portion 642 from the second strap portion 644 to be adjusted to suit a user's needs or preferences by varying the position of the keeper along the length of the engagement between the first portion of the hook-and-loop fastener 632 and the second portion of the hook-and-loop fastener 638. In illustrated example of FIGS. 26-30, the first portion of the hook-and-loop fastener 632 and the second portion of the hook-and-loop fastener 638 are in engagement along their full lengths, and the keeper 622 can be moved by the user from a position of no overlap with the engagement of the first portion of the hook-and-loop fastener 632 and the second portion of the hook-and-loop fastener 638 (corresponding to a lower threshold tensile force and shown in FIG. 26) to a position where the center of the keeper 622 is located at the midpoint of the engagement of the first portion of the hook-and-loop fastener 632 and the second portion of the hook-and-loop fastener 638 (corresponding to highest threshold tensile force).

Referring to FIGS. 31-34, another embodiment 700 of the safety device in accordance with the present invention can be seen. The safety device 700 is for use with control lines for guiding a horse. The safety device 700 includes a first strap portion 742, a second strap portion 744, a first portion of a hook-and-loop fastener 732, a second portion of a hook-and-loop fastener 738, and at least one keeper 722.

The first strap portion 742 has a first end 741 and a second end or tip 746. The second strap portion 744 has a first end 743 and a second end or tip 748. The safety device 700 is identical to the safety device 600 except for the differences described below.

In the illustrated example of FIGS. 31-34, the keeper 722 is received for sliding motion on the first strap portion 742. The safety device 700 includes means for preventing the keeper from falling off the tip of the first strap portion 742. The means for preventing the keeper from falling off the tip of the first strap portion 742 comprises a portion of increased thickness 750 provided on the first strap portion 742 at a position located on a portion of the strap portion 742 extending from the first portion of the hook-and-loop fastener 732 to the tip 746 of the first strap portion 742.

The safety device 700 further comprises a second portion of increased thickness 752 provided on the first strap portion 742 at a position located a distance apart from the first portion of increased thickness 750. At least a portion of the first portion of the hook-and-loop fastener 732 is positioned intermediate the first portion of increased thickness 750 and the second portion of increased thickness 752. In the illustrated embodiment, the entire length of the first portion of the hook-and-loop fastener 732 is positioned intermediate the first portion of increased thickness 750 and the second portion of increased thickness 752. There is also additional space between the first portion of increased thickness 750 and the second portion of increased thickness 752 to allow the keeper 722 to be moved to a position where the keeper 722 does not overlap any part of the first portion of the hook-and-loop fastener 732. The first portion of increased thickness 750 and the second portion of increased thickness 752 project outward on the side of the first strap portion 742 that is opposite the side of the strap 742 on which the first portion of the hook-and-loop fastener 732 is located. The first portion of increased thickness 750 and the second portion of increased thickness 752 form means for limiting the sliding movement of the keeper 722 to a portion of the first strap portion extending between the first portion of increased thickness 750 and the second portion of increased thickness 752.

In the illustrated example, the first portion of increased thickness 750 and the second portion of increased thickness 752 are formed by stacking sections of material to a sufficient thickness to either block the movement of the keeper 722 past the portions of increased thickness or to require a significant amount of force to move the keeper 722 past the portions of increased thickness such that the likelihood of the keeper 722 falling off the first strap portion 742 becomes insignificant in everyday use. The sections of material forming the portions of increased thickness 750 and 752 can be attached to the strap portion 742 and each other using adhesives, stitching, or any other suitable means. The sections of material forming the portions of increased thickness 750 and 752 can be made of natural or synthetic leather, rubber, plastic or any other suitable material. Leather is at present preferred.

The keeper 722 may be forced over the portion of increased thickness 750 to assemble the safety device 700. Alternatively, one or both of the portions of increased thickness 750 and 752 may be formed after the keeper 722 is placed on the strap portion 742 at an appropriate location along the strap portion, or the keeper 722 may be formed of a strip of material placed around the strap portion 742 intermediate the portions of increased thickness 750 and 752 and thereafter having had its ends attached to one another.

The keeper 722 is movable by sliding along the length of the first strap portion 742 and the second strap portion 744 that corresponds to the distance between the portions of increased thickness 750 and 752 to thereby allow the threshold tensile force for disengaging the first strap portion 742 from the second strap portion 744 to be adjusted to suit a user's needs or preferences by varying the position of the keeper 722 along the length of the engagement between the first portion of the hook-and-loop fastener 732 and the second portion of the hook-and-loop fastener 738. In illustrated example of FIGS. 31-34, the first portion of the hook-and-loop fastener 732 and the second portion of the hook-and-loop fastener 738 are in engagement along their full lengths, and the keeper 722 can be moved by the user from a position of no overlap with the engagement of the first portion of the hook-and-loop fastener 732 and the second portion of the hook-and-loop fastener 738 (corresponding to the lowest threshold tensile force and shown in FIG. 31) to a position where the entire length of the keeper overlaps the engagement of the first portion of the hook-and-loop fastener 732 and the second portion of the hook-and-loop fastener 738 nearest the first portion of increased thickness 750 (corresponding to highest threshold tensile force).

Referring to FIGS. 35-38, another embodiment 800 of the safety device in accordance with the present invention can be seen. The safety device 800 is for use with control lines for guiding a horse. The safety device 800 includes a first strap portion 842, a second strap portion 844, a first portion of a hook-and-loop fastener 832, a second portion of a hook-and-loop fastener 838, and at least one keeper 822.

The first strap portion 842 has a first end 841 and a second end or tip 846. The second strap portion 844 has a first end 843 and a second end or tip 848. The safety device 800 is identical to the safety device 700 except for the differences described below.

In the illustrated example of FIGS. 35-38, the keeper 822 is received for sliding motion on the first strap portion 842. The safety device 800 includes means for preventing the keeper from falling off the tip of the first strap portion 842. The means for preventing the keeper from falling off the tip of the first strap portion 842 comprises a portion of increased width 850 provided on the first strap portion 842 at a position located on a portion of the strap portion 842 extending from the first portion of the hook-and-loop fastener 832 to the tip 846 of the first strap portion 842.

The safety device 800 further comprises a second portion of increased width 852 provided on the first strap portion 842 at a position located a distance apart from the first portion of increased width 850. At least a portion of the first portion of the hook-and-loop fastener 832 is positioned intermediate the first portion of increased width 850 and the second portion of increased width 852. In the illustrated embodiment, the entire length of the first portion of the hook-and-loop fastener 832 is positioned intermediate the first portion of increased width 850 and the second portion of increased width 852. There is also additional space between the first portion of increased width 850 and the second portion of increased width 852 to allow the keeper 822 to be moved to a position where the keeper 822 does not overlap any part of the first portion of the hook-and-loop fastener 832. The first portion of increased width 850 and the second portion of increased width 852 each project outward laterally on either side of the first strap portion 842. The maximum strap portion width in each of the first portion of increased width 850 and the second portion of increased width 852 is at least equal to and preferably greater than the width of the opening through the keeper 822. The first portion of increased width 850 and the second portion of increased width 852 form means for limiting the sliding movement of the keeper 822 to a portion of the first strap portion extending between the first portion of increased width 850 and the second portion of increased width 852.

In the illustrated example, the first portion of increased width 850 and the second portion of increased width 852 have a width sufficient to either block the movement of the keeper 822 past the portions of increased width or to require a significant amount of force to move the keeper 822 past the portions of increased width such that the likelihood of the keeper 822 falling off the first strap portion 842 becomes insignificant in everyday use. Also, the first strap portion 842 may be flexible enough to allow the portions of increased width to be rolled or folded to allow the keeper 822 to be placed between the portions of increased width 850, 852 on the strap portion 842 or for the keeper 822 to be removed from the strap portion 842 when needed.

The keeper 822 may be forced over the portion of increased width 850 to assemble the safety device 800. Rolling or bending the first strap portion 842 in the portion of increased width 850 may facilitate this procedure as previously described. Alternatively, the keeper 822 may be formed of a strip of material placed around the strap portion 842 intermediate the portions of increased width 850 and 852 and thereafter having had its ends attached to one another.

The keeper 822 is movable by sliding along the length of the first strap portion 842 and the second strap portion 844 that corresponds to the distance between the portions of increased width 850 and 852 to thereby allow the threshold tensile force for disengaging the first strap portion 842 from the second strap portion 844 to be adjusted to suit a user's needs or preferences by varying the position of the keeper 822 along the length of the engagement between the first portion of the hook-and-loop fastener 832 and the second portion of the hook-and-loop fastener 838. In illustrated example of FIGS. 35-38, the first portion of the hook-and-loop fastener 832 and the second portion of the hook-and-loop fastener 838 are in engagement along their full lengths, and the keeper 822 can be moved by the user from a position of no overlap with the engagement of the first portion of the hook-and-loop fastener 832 and the second portion of the hook-and-loop fastener 838 (corresponding to the lowest threshold tensile force and shown in FIG. 35) to a position where the entire length of the keeper overlaps the engagement of the first portion of the hook-and-loop fastener 832 and the second portion of the hook-and-loop fastener 838 nearest the first portion of increased width 850 (corresponding to highest threshold tensile force and shown in FIG. 36).

Referring to FIGS. 39-42, another embodiment 900 of the safety device in accordance with the present invention can be seen. The safety device 900 is for use with control lines for guiding a horse. The safety device 900 includes a first strap portion 942, a second strap portion 944, a first portion of a hook-and-loop fastener 932, a second portion of a hook-and-loop fastener 938, and at least one keeper 922.

The first strap portion 942 has a first end 941 and a second end or tip 946. The second strap portion 944 has a first end 943 and a second end or tip 948. The safety device 900 is identical to the safety device 800 except for the differences described below.

In the illustrated example of FIGS. 39-42, the keeper 922 is received for sliding motion on the first strap portion 942. The safety device 900 includes means for preventing the keeper from falling off the tip of the first strap portion 942. The means for preventing the keeper from falling off the tip of the first strap portion 942 comprises a first hook 950 provided on the first strap portion 942 at a position located on a portion of the strap portion 942 extending from the first portion of the hook-and-loop fastener 932 to the tip 946 of the first strap portion 942.

The safety device 900 further comprises a second hook 952 provided on the first strap portion 942 at a position located a distance apart from the first hook 950. At least a portion of the first portion of the hook-and-loop fastener 932 is positioned intermediate the first hook 950 and the second hook 952. In the illustrated embodiment, the entire length of the first portion of the hook-and-loop fastener 932 is positioned intermediate the hooks 950 and 952. There is also additional space between the first hook 950 and the second hook 952 to allow the keeper 922 to be moved to a position where the keeper 922 does not overlap any part of the first portion of the hook-and-loop fastener 932. The first hook 950 and the second hook 952 each project outward on a side of the first strap portion 942 that is opposite the side of the first strap portion 942 on which the first portion of the hook-and-loop fastener 932 is provided. The maximum height of the first hook 950 and the second hook 952 is at least equal to and preferably greater than the difference between the height of the opening through the keeper 922 and the thickness of the first strap portion 942. The first hook 950 and the second hook 952 form means for limiting the sliding movement of the keeper 922 to a portion of the first strap portion extending between the first hook 950 and the second hook 952.

In the illustrated example, the first hook 950 and the second hook 952 have a height sufficient to either block the movement of the keeper 922 past the hooks or to require a significant amount of force to move the keeper 922 past the hooks such that the likelihood of the keeper 922 falling off the first strap portion 942 becomes insignificant in everyday use. The hooks 950, 952 are preferably made of relatively rigid metal or plastic and attached to the first strap portion 942 using the rivets 956 and 954, respectively.

The keeper 922 may be forced over the hook 950 to assemble the safety device 900. Alternatively, the keeper 922 may be formed of a strip of material placed around the strap portion 942 intermediate the hooks 950 and 952 and thereafter having had its ends attached to one another.

The keeper 922 is movable by sliding along the length of the first strap portion 942 and the second strap portion 944 that corresponds to the distance between the hooks 950 and 952 to thereby allow the threshold tensile force for disengaging the first strap portion 942 from the second strap portion 944 to be adjusted to suit a user's needs or preferences by varying the position of the keeper 922 along the length of the engagement between the first portion of the hook-and-loop fastener 932 and the second portion of the hook-and-loop fastener 938. In illustrated example of FIGS. 39-42, the first portion of the hook-and-loop fastener 932 and the second portion of the hook-and-loop fastener 938 are in engagement along their full lengths, and the keeper 922 can be moved by the user from a position of no overlap with the engagement of the first portion of the hook-and-loop fastener 932 and the second portion of the hook-and-loop fastener 938 (corresponding to the lowest threshold tensile force and shown in FIG. 39) to a position where the entire length of the keeper 922 overlaps the engagement of the first portion of the hook-and-loop fastener 932 and the second portion of the hook-and-loop fastener 938 nearest the first hook 950 (corresponding to highest threshold tensile force and shown in FIG. 40).

Referring to FIGS. 43-46, another embodiment 1000 of the safety device in accordance with the present invention can be seen. The safety device 1000 is for use with control lines for guiding a horse. The safety device 1000 includes a first strap portion 1042, a second strap portion 1044, a first portion of a hook-and-loop fastener 1032, a second portion of a hook-and-loop fastener 1038, and at least one keeper 1022.

The first strap portion 1042 has a first end 1041 and a second end or tip 1046. The second strap portion 1044 has a first end 1043 and a second end or tip 1048. The safety device 1000 is identical to the safety device 900 except for the means for preventing the keeper from falling off the tip of the first strap portion 1042 and the means for limiting the sliding movement of the keeper 1022 to a portion of the first strap portion 1042.

In the illustrated example of FIGS. 43-46, the keeper 1022 is received for sliding motion on the first strap portion 1042. The safety device 1000 includes means for preventing the keeper from falling off the tip of the first strap portion 1042. The means for preventing the keeper from falling off the tip of the first strap portion 1042 comprises the end portion 1052 of the layer or panel 1020 of the first strap portion 1042 that is sewed or otherwise attached to the layer of panel 1018 of the first strap portion 1042 at a position located on a portion of the strap portion 1042 extending from the first portion of the hook-and-loop fastener 1032 to the tip 1046 of the first strap portion 1042.

The safety device 1000 includes means for limiting the sliding movement of the keeper 1022 to a portion of the first strap portion 1042. The means for limiting sliding movement of the keeper comprises an elongated slot 1050 formed between first and second layers 1020 and 1018 of the first strap portion 1042. The keeper 1022 passes between the first and second layers 1020 and 1018 of the first strap portion 1042. The first and second layers 1020 and 1018 of the first strap portion 1042 are attached together at first and second spaced apart positions 1052 and 1054 along the first strap portion 1042 to captivate the keeper 1022 on the first strap portion 1042, while allowing the keeper 1022 to move between the first and second spaced apart positions 1052 and 1054, which define the ends of the elongated slot 1050. At least a portion of the first portion of the hook-and-loop fastener 1032 is positioned intermediate the first and second spaced apart positions 1052 and 1054 on an outer surface of the first strap portion 1042.

In the illustrated embodiment, the entire length of the first portion of the hook-and-loop fastener 1032 is positioned intermediate the ends 1052 and 1054 of the elongated slot 1050. There is also additional space between the ends 1052 and 1054 of the elongated slot 1050 to allow the keeper 1022 to be moved to a position where the keeper 1022 does not overlap any part of the first portion of the hook-and-loop fastener 1032.

The panels 1018 and 1020 are preferably made of the same material as the first strap portion 1042. The panels 1018 and 1020 may be made of natural or synthetic leather, rubber, plastic, polymers, composite materials, or any other suitable material. The panels 1018 and 1020 can be attached to each other to form the ends of the elongated slot 1050 by using rivets, stitching, adhesives, or any other suitable means. The keeper 1022 may be formed of a strip of material placed the elongated slot 1050 and thereafter having had its ends attached to one another.

The keeper 1022 is movable by sliding along the length of the first strap portion 1042 and the second strap portion 1044 that corresponds to the distance between the ends 1052 and 1054 of the elongated slot 1050 to thereby allow the threshold tensile force for disengaging the first strap portion 1042 from the second strap portion 1044 to be adjusted to suit a user's needs or preferences by varying the position of the keeper 1022 along the length of the engagement between the first portion of the hook-and-loop fastener 1032 and the second portion of the hook-and-loop fastener 1038. In illustrated example of FIGS. 43-46, the first portion of the hook-and-loop fastener 1032 and the second portion of the hook-and-loop fastener 1038 are in engagement along their full lengths, and the keeper 1022 can be moved by the user from a position of no overlap with the engagement of the first portion of the hook-and-loop fastener 1032 and the second portion of the hook-and-loop fastener 1038 (corresponding to the lowest threshold tensile force and shown in FIG. 43) to a position where the entire length of the keeper 1022 overlaps the engagement of the first portion of the hook-and-loop fastener 1032 and the second portion of the hook-and-loop fastener 1038 nearest the first end 1052 of the elongated slot 1050 (corresponding to highest threshold tensile force and shown in FIG. 44).

Referring to FIGS. 47-50, another embodiment 1100 of the safety device in accordance with the present invention can be seen. The safety device 1100 is for use with control lines for guiding a horse. The safety device 1100 includes a first strap portion 1142, a second strap portion 1144, a first portion of a hook-and-loop fastener 1132, a second portion of a hook-and-loop fastener 1138, and at least one keeper 1122.

The first strap portion 1142 has a first end 1141 and a second end or tip 1146. The second strap portion 1144 has a first end 1143 and a second end or tip 1148. The safety device 1100 is identical to the safety device 1000 except for the means for preventing the keeper from falling off the tip of the first strap portion 1142 and the means for limiting the sliding movement of the keeper 1122 to a portion of the first strap portion 1142.

In the illustrated example of FIGS. 47-50, the keeper 1122 is received for sliding motion on the first strap portion 1142. The safety device 1100 includes means for preventing the keeper from falling off the tip of the first strap portion 1142. The means for preventing the keeper from falling off the tip of the first strap portion 1142 comprises the end portion 1152 of the captivating strap 1120 that is attached to the first strap portion 1142 at a position located on a portion of the strap portion 1142 extending from the first portion of the hook-and-loop fastener 1132 to the tip 1146 of the first strap portion 1142.

The safety device 1100 includes means for limiting the sliding movement of the keeper 1122 to a portion of the first strap portion 1142. The means for limiting sliding movement of the keeper comprises an elongated slot 1150 formed between the captivating strap 1120 and the first strap portion 1142. The keeper 1122 passes between the captivating strap 1120 and the first strap portion 1142. The captivating strap 1120 and the first strap portion 1142 are attached together at the first and second spaced apart end portions 1152 and 1154 of the captivating strap 1120 to form the elongated slot 1150 and captivate the keeper 1122 along the elongated slot 1150 and on the first strap portion 1142, while allowing the keeper 1122 to move between the first and second spaced apart end portions 1152 and 1154 of the captivating strap 1120, which define the ends of the elongated slot 1150. At least a portion of the first portion of the hook-and-loop fastener 1132 is positioned intermediate the first and second spaced-apart end portions 1152 and 1154 of the captivating strap 1120 on an outer surface of the first strap portion 1142. The portion of the first portion of the hook-and-loop fastener 1132 that is positioned intermediate the first and second ends of the captivating strap 1120 is located outside the elongated slot 1150 such that the keeper 1122 can move over the portion of the first portion of the hook-and-loop fastener 1132.

In the illustrated embodiment, the entire length of the first portion of the hook-and-loop fastener 1132 is positioned intermediate the ends 1152 and 1154 of the captivating strap 1120. There is also additional space between the ends 1152 and 1154 of the captivating strap 1120 to allow the keeper 1122 to be moved to a position where the keeper 1122 does not overlap any part of the first portion of the hook-and-loop fastener 1132.

The captivating strap 1120 may be made of natural or synthetic leather, rubber, plastic, polymers, composite materials, rigid plastics or polymeric materials, metals, or any other suitable material. The captivating strap 1120 and the first strap portion 1142 may be attached together at the first and second spaced apart end portions 1152 and 1154 of the captivating strap 1120 by using rivets, stitching, adhesives, or any other suitable means. In the illustrated embodiment, the captivating strap 1120 and the first strap portion 1142 are attached together at the first and second spaced apart end portions 1152 and 1154 of the captivating strap 1120 by using rivets 1156 and 1158, respectively. The keeper 1122 may be formed of a strip of material placed the elongated slot 1150 and thereafter having had its ends attached to one another.

The keeper 1122 is movable by sliding along the length of the first strap portion 1142 and the second strap portion 1144 that corresponds to the distance between the ends of the elongated slot 1150 to thereby allow the threshold tensile force for disengaging the first strap portion 1142 from the second strap portion 1144 to be adjusted to suit a user's needs or preferences by varying the position of the keeper 1122 along the length of the engagement between the first portion of the hook-and-loop fastener 1132 and the second portion of the hook-and-loop fastener 1138. In illustrated example of FIGS. 47-50, the first portion of the hook-and-loop fastener 1132 and the second portion of the hook-and-loop fastener 1138 are in engagement along their full lengths, and the keeper 1122 can be moved by the user from a position of no overlap with the engagement of the first portion of the hook-and-loop fastener 1132 and the second portion of the hook-and-loop fastener 1138 (corresponding to the lowest threshold tensile force and shown in FIG. 47) to a position where the entire length of the keeper 1122 overlaps the engagement of the first portion of the hook-and-loop fastener 1132 and the second portion of the hook-and-loop fastener 1138 nearest the first end 1152 of the captivating strap 1120, which is also nearest the end of the elongated slot 1150 closest to the tip 1146 of the first strap portion 1142 (corresponding to highest threshold tensile force and shown in FIG. 48).

Figure 51:
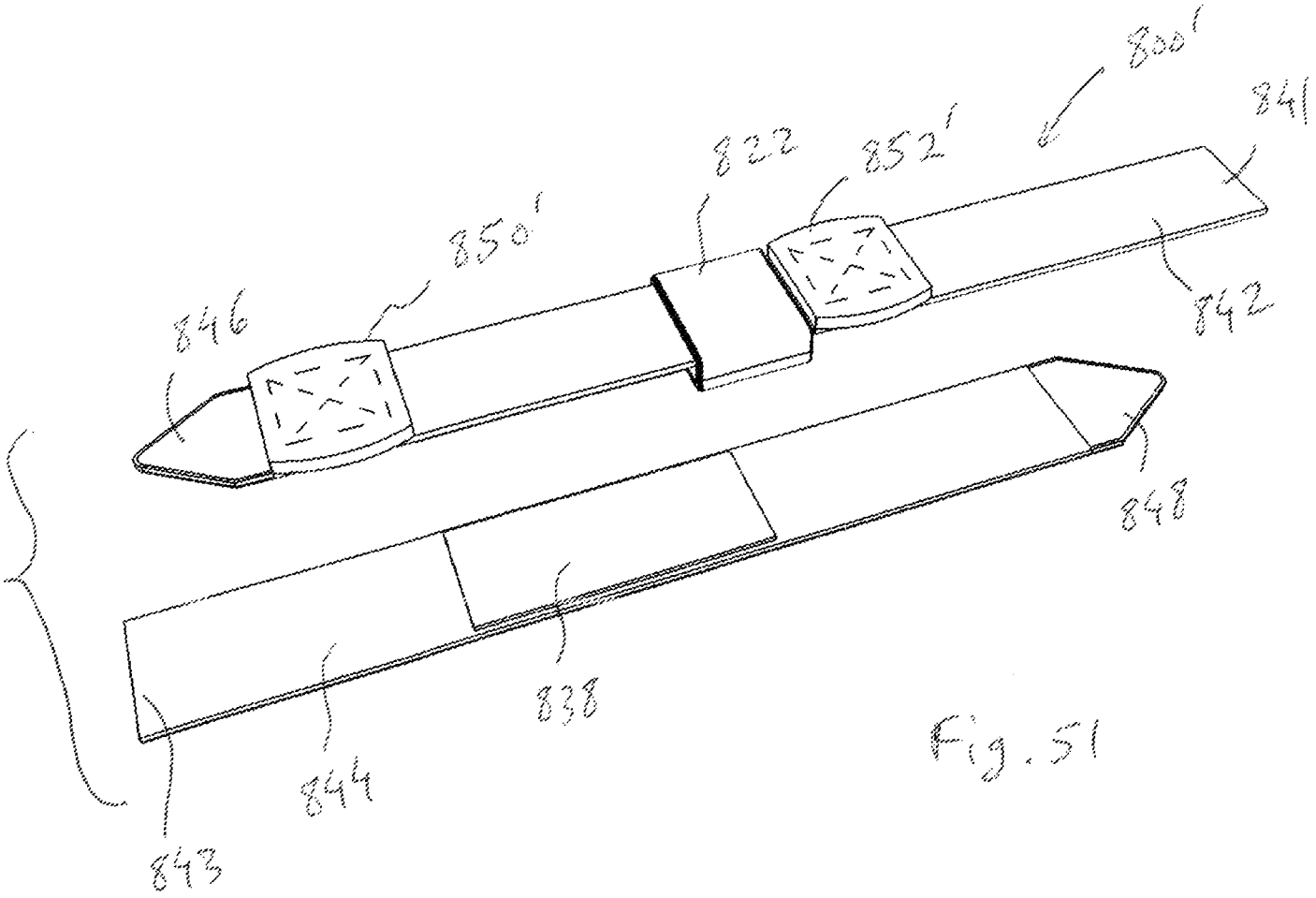
FIGS. 51-52 are views of a safety device for reins that is used for connecting the ends of the control lines for controlling and guiding a horse in accordance with an twelfth embodiment of the present invention.
Figure 52:
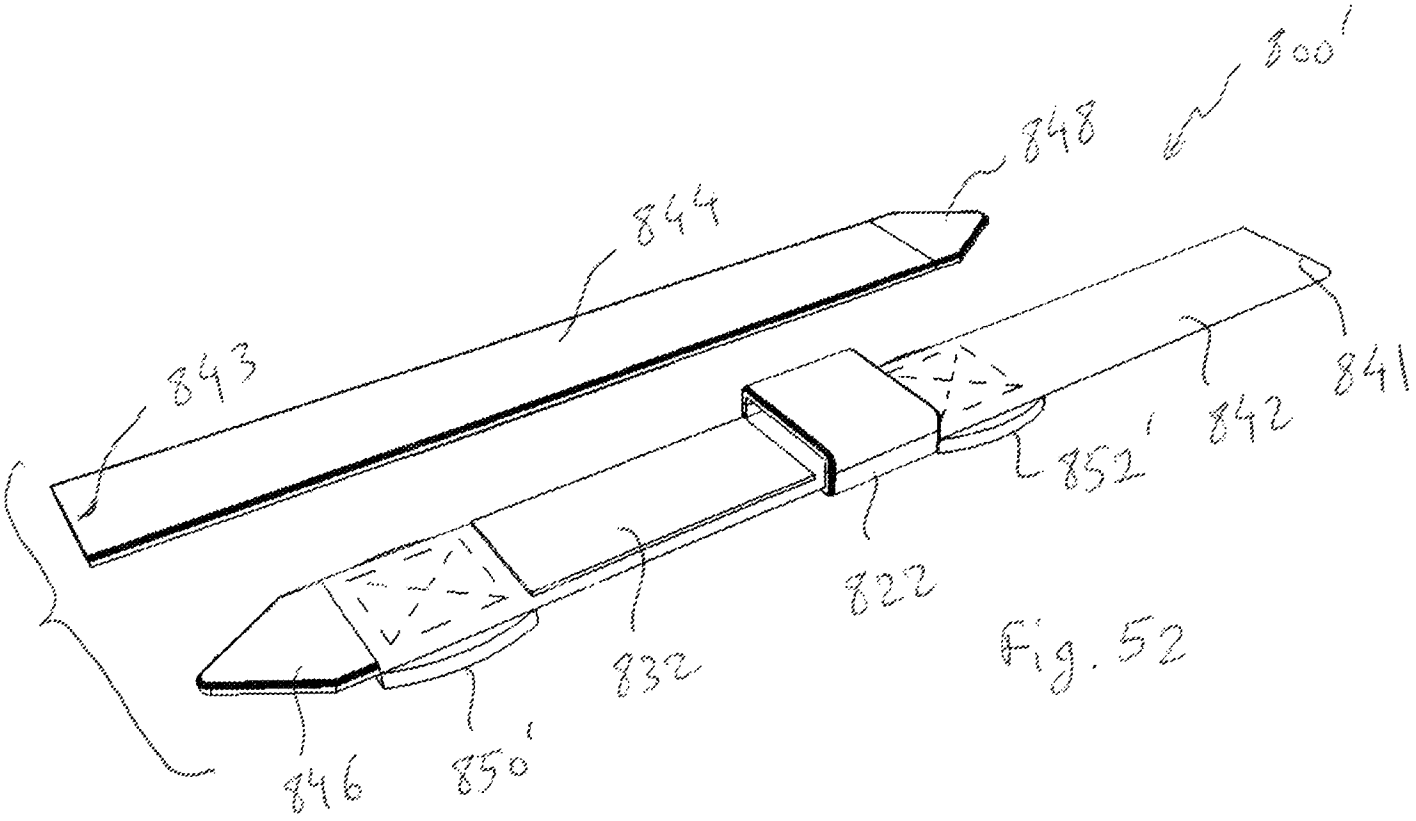

Referring to FIGS. 51-52, another embodiment 800' of the safety device in accordance with the present invention can be seen. The safety device 800' is identical to the safety device 800 except for the differences described below.

In the illustrated example of FIGS. 51-52, the first portion of increased width 850' and the second portion of increased width 852' are formed by sewing, or attaching by any other suitable means, two strap sections of increased width across the first strap portion 842 at the same locations as the portions of increased width 850 and 852 of the embodiment 800. Also, the portions of increased width 850' and 852' of the embodiment 800' have at least the same maximum width, in other words the maximum dimension in the direction transverse to the longitudinal axis of the first strap portion 842, as the portions of increased width 850 and 852 of the embodiment 800.

The terms "sewn" or "sewing" as used in the appended claims should be construed as being a generic reference for sewn, stitched, sewing or stitching. The term "tip" as used herein simply refers to the free end of a strap portion, as opposed to the end of the strap portion that is directly or indirectly connected to the control lines for guiding a horse. Even though the illustrated embodiments show pointed tips, the term "tip" as used herein does not designate any particular shape and the tips of the strap portions may be rounded or rectangular or of any other suitable shape, unless otherwise specified. The references to first, second, third, fourth, etc. are used merely to ease distinguishing between different parts of the invention that have the same name such as strap portions or rings and are not to be associated with a particular direction such as left or right or with a particular one of the control lines for guiding horses. As used herein, the term "keeper" refers to a loop of material, usually at least resembling in form an endless loop formed of a strip, that is used for holding a portion of one strap portion that includes its tip flat against another strap portion. The keeper can be made of leather, simulated leather, rubber, plastic, or any other suitable material. Currently, leather is the preferred material for the keeper.

It is to be understood that the present invention is not limited to the embodiments described above, but encompasses any and all embodiments within the scope of the appended claims. In addition, the present invention encompasses any and all permutations of the various disclosed safety devices used in whole or in part as replacements for one or more parts of the various disclosed safety connectors.

The invention claimed is:

1. A safety device for use with control lines for guiding a horse, the control lines including at least a first control line and a second control line, the first control line having a head portion, the second control line having a head portion, the first control line being usable for guiding the horse to one of the left and the right directions, the second control line being usable for guiding the horse to the other of the left and the right directions, the safety device comprising:

a first strap portion operably connected to one of the head portion of the first control line and the head portion of the second control line;

a second strap portion operably connected to the other of the head portion of the first control line and the head portion of the second control line;

a first portion of a hook-and-loop fastener attached to said first strap portion, said first portion of said hook-and-loop fastener being in the form of a panel lying flat against one side of said first strap portion;

a second portion of a hook-and-loop fastener attached to said second strap portion, said second portion of said hook-and-loop fastener being in the form of a panel lying flat against one side of said second strap portion; and at least one keeper attached to one of said first strap portion and said second strap portion such that, wherein when said first portion of said hook-and-loop fastener is fastened to said second portion of said hook-and-loop fastener, one of said first strap portion and said second strap portion, to which said at least one keeper is not attached, can extend through said at least one keeper, wherein a threshold tensile force required to separate the first strap portion and the second strap portion is lower than the tensile force that would be placed on the control lines for guiding a horse if a rider or driver entangled in the control lines for guiding a horse were to be dragged on the ground by the horse or a horse drawn vehicle.

2. A safety connector for use with control lines for guiding a horse, the control lines including at least a first control line and a second control line, the first control line having a head portion, the second control line having a head portion, the first control line being usable for guiding the horse to one of the left and the right directions, the second control line being usable for guiding the horse to the other of the left and the right directions, the safety connector comprising:

a swivel having a first ring and a second ring;

a first strap portion attached to the first ring;

a second strap portion attached to the second ring;

a first portion of hook-and-loop fastener attached to said first strap portion, said first portion of hook-and-loop fastener being in the form of a panel lying flat against one side of said first strap portion;

a complementary portion of hook-and-loop fastener adapted for attachment to a third strap portion, said complementary portion of hook-and-loop fastener being complementary to said first portion of hook-and-loop fastener, the third strap portion being operably connected to one of the head portion of the first control line and the head portion of the second control line, said complementary portion of hook-and-loop fastener being in the form of a panel that can lie flat against one side of the third strap portion when said complementary portion of hook-and-loop fastener is attached to the third strap portion; and at least one keeper attached to said first strap portion such that, when said complementary portion of hook-and-loop fastener is attached to the third strap portion and said first portion of hook-and-loop fastener is fastened to said complementary portion of hook-and-loop fastener, the third strap portion can extend through said at least one keeper, wherein, when said complementary portion of hook-and-loop fastener is attached to the third strap portion and said first portion of hook-and-loop fastener is fastened to said complementary portion of hook-and-loop fastener, a threshold tensile force required to separate the first strap portion and the third strap portion is lower than the tensile force that would be placed on the control lines for guiding a horse if a rider or driver entangled in the control lines for guiding a horse were to be dragged on the ground by the horse or a horse drawn vehicle.

3. A safety connector according to claim 2, wherein said first and second rings of said swivel are rotationally connected by a pivot pin, wherein said first and second rings can rotate freely relative to one another, wherein said pivot pin has a journal portion having a longitudinal axis, wherein at least one of said first and second rings rotates about said journal portion of said pivot pin, wherein said longitudinal axis of said journal portion of said pivot pin about which at least one of first and second rings rotates defines the axis of rotation of said first and second rings relative to one another, where said first and second rings are positioned side by side along said axis of rotation defined by said pivot pin with said first and second rings being positioned in tandem one after the other in a direction coincident with said axis of rotation defined by said pivot pin, wherein each of said first and second rings defines a respective opening, and wherein said axis of rotation defined by said pivot pin approximately bisects said opening of each of said first and second rings.

4. A safety connector according to claim 2, wherein said complementary portion of hook-and-loop fastener is a third portion of hook-and-loop fastener and wherein said at least one keeper is a first keeper, the safety connector further comprising:

a second portion of hook-and-loop fastener attached to said second strap portion, said second portion of hook-and-loop fastener being in the form of a panel lying flat against one side of said second strap portion;

a fourth portion of hook-and-loop fastener adapted for attachment to a fourth strap portion, said fourth portion of hook-and-loop fastener being complementary to said second portion of hook-and-loop fastener, the fourth strap portion being operably connected to another one of the head portion of the first control line and the head portion of the second control line, said fourth portion of hook-and-loop fastener being in the form of a panel that can lie flat against one side of the fourth strap portion when said fourth portion of hook-and-loop fastener is attached to the fourth strap portion; and a second keeper attached to said second strap portion such that, when said fourth portion of hook-and-loop fastener is attached to the fourth strap portion and said second portion of hook-and-loop fastener is fastened to said fourth portion of hook-and-loop fastener, the fourth strap portion can extend through said second keeper.

5. A safety connector according to claim 4, wherein, when said fourth portion of hook-and-loop fastener is attached to the fourth strap portion and said second portion of hook-and-loop fastener is fastened to said fourth portion of hook-and-loop fastener, a threshold tensile force required to separate the second strap portion and the fourth strap portion is lower than the tensile force that would be placed on the control lines for guiding a horse if a rider or driver entangled in the control lines for guiding a horse were to be dragged on the ground by the horse or a horse drawn vehicle.

6. A safety connector according to claim 4, wherein said first strap portion is routed through said first ring of said swivel and sewn back onto itself to pivotally attach said first strap portion to said first ring, wherein said second strap portion is routed through said second ring of said swivel and sewn back onto itself to pivotally attach said second strap portion to said second ring, wherein portions of said first strap portion that are sewn together, after said first strap portion is routed through said first ring, form an upper panel of said first strap portion and a lower panel of said first strap portion, wherein said first keeper is provided near said first ring, wherein said first keeper is captured between said upper panel of said first strap portion and said lower panel of said first strap portion, wherein said first keeper passes between said upper panel of said first strap portion and said lower panel of said first strap portion, wherein said upper panel of said first strap portion and said lower panel of said first strap portion are sewn together on either side of said first keeper to capture said first keeper at a fixed location on said first strap portion near said first ring, wherein portions of said second strap portion that are sewn together, after said second strap portion is routed through said second ring, form an upper panel of said second strap portion and a lower panel of said second strap portion, wherein said second keeper is provided near said second ring, wherein said second keeper is captured between said upper panel of said second strap portion and said lower panel of said second strap portion, wherein said second keeper passes between said upper panel of said second strap portion and said lower panel of said second strap portion, and wherein said upper panel of said second strap portion and said lower panel of said second strap portion are sewn together on either side of said second keeper to capture said second keeper at a fixed location on said second strap portion near said second ring.

7. A safety connector according to claim 6, wherein said first strap portion has a tip located distally from said first ring, wherein a length of said first strap portion extends between said first ring and said tip of said first strap portion, wherein said first portion of hook-and-loop fastener is provided on said length of said first strap portion intermediate said tip of said first strap portion and said first ring, wherein said second strap portion has a tip located distally from said second ring, wherein a length of said second strap portion extends between said second ring and said tip of said second strap portion, and wherein said second portion of hook-and-loop fastener is provided on said length of said second strap portion intermediate said tip of said second strap portion and said second ring.

8. A safety connector according to claim 7, wherein said first portion of hook-and-loop fastener lies flat against one side of said first strap portion intermediate said first keeper and said tip of said first strap portion, and wherein said second portion of hook-and-loop fastener lies flat against one side of said second strap portion intermediate said second keeper and said tip of said second strap portion.

9. A safety connector according to claim 7, wherein said first portion of hook-and-loop fastener is attached to said first strap portion using sewing, and wherein said second portion of hook-and-loop fastener is attached to said second strap portion using sewing.

10. A safety connector according to claim 4, wherein said third portion of hook-and-loop fastener has a back side and is provided with adhesive on said back side, wherein said adhesive is covered by a release liner that is peeled away in order to attach said third portion of hook-and-loop fastener to said third strap portion, wherein said fourth portion of hook-and-loop fastener has a back side and is provided with adhesive on said back side, and wherein said adhesive is covered by a release liner that is peeled away in order to attach said fourth portion of hook-and-loop fastener to said fourth strap portion.

11. A safety connector according to claim 2, wherein said at least one keeper is a first keeper, the safety connector further comprising:

a buckle attached to said second strap portion, said buckle being capable of engaging a fourth strap portion, said buckle having a frame and a prong, the fourth strap portion having a plurality of holes for engagement by said prong, the fourth strap portion being operably connected to another one of the head portion of the first control line and the head portion of the second control line; and a second keeper attached to said second strap portion such that, when the fourth strap portion and said buckle are fastened together, the fourth strap portion can extend through said second keeper.

12. A safety connector according to claim 11, wherein said first strap portion is routed through said first ring of said swivel and sewn back onto itself to pivotally attach said first strap portion to said first ring, wherein said second strap portion is routed through said second ring of said swivel and sewn back onto itself to pivotally attach said second strap portion to said second ring, wherein portions of said first strap portion that are sewn together, after said first strap portion is routed through said first ring, form an upper panel of said first strap portion and a lower panel of said first strap portion, wherein said first keeper is provided near said first ring, wherein said first keeper is captured between said upper panel of said first strap portion and said lower panel of said first strap portion, wherein said first keeper passes between said upper panel of said first strap portion and said lower panel of said first strap portion, wherein said upper panel of said first strap portion and said lower panel of said first strap portion are sewn together on either side of said first keeper to capture said first keeper at a fixed location on said first strap portion near said first ring, wherein said second strap portion is routed over one side of said frame and sewn back on itself to capture said frame and pivotally attach said frame to said second strap portion and thereby attach said buckle to said second strap portion, wherein said frame defines an opening through which said second strap portion is routed, wherein said frame and said prong are free to pivot relative to said second strap portion, wherein portions of said second strap portion that are sewn together, after said second strap portion is routed through said frame, form an upper panel of said second strap portion and a lower panel of said second strap portion, wherein said second keeper is captured between said upper panel of said second strap portion and said lower panel of said second strap portion, wherein said second keeper passes between said upper panel of said second strap portion and said lower panel of said second strap portion, and wherein said upper panel of said second strap portion and said lower panel of said second strap portion are sewn together on either side of said second keeper to capture said second keeper at a fixed location on said second strap portion, wherein a portion of said second strap portion positioned to surround said one side of said frame has an opening for said prong that allows said prong to extend through said second strap portion, and wherein said opening for said prong is large enough so that said prong can pivot freely about said one side of said frame and in relation to said second strap portion.

13. A safety connector according to claim 12, wherein said first strap portion has a tip located distally from said first ring, wherein a length of said first strap portion extends between said first ring and said tip of said first strap portion, and wherein said first portion of hook-and-loop fastener is provided on said length of said first strap portion intermediate said tip of said first strap portion and said first ring.

14. A safety connector according to claim 13, wherein said first portion of hook-and-loop fastener lies flat against one side of said first strap portion intermediate said first keeper and said tip of said first strap portion.

15. A safety connector according to claim 14, wherein said first portion of hook-and-loop fastener is attached to said first strap portion using sewing.

16. A safety connector according to claim 11, wherein said complementary portion of hook-and-loop fastener has a back side and is provided with adhesive on said back side, wherein said adhesive is covered by a release liner that is peeled away in order to attach said complementary portion of hook-and-loop fastener to said third strap portion.

17. A safety connector according to claim 2, wherein said second strap portion has a length and is provided with a plurality of holes distributed evenly along at least a portion of said length of said second strap portion, said plurality of holes being adapted for engagement by a prong of a buckle attached to a fourth strap portion, the fourth strap portion being operably connected to another one of the head portion of the first control line and the head portion of the second control line.

18. A safety connector according to claim 17, wherein said first strap portion is routed through said first ring of said swivel and sewn back onto itself to pivotally attach said first strap portion to said first ring, wherein said second strap portion is routed through said second ring of said swivel and sewn back onto itself to pivotally attach said second strap portion to said second ring, wherein portions of said first strap portion that are sewn together, after said first strap portion is routed through said first ring, form an upper panel of said first strap portion and a lower panel of said first strap portion, wherein said at least one keeper is provided near said first ring, wherein said at least one keeper is captured between said upper panel of said first strap portion and said lower panel of said first strap portion, wherein said at least one keeper passes between said upper panel of said first strap portion and said lower panel of said first strap portion, wherein said upper panel of said first strap portion and said lower panel of said first strap portion are sewn together on either side of said at least one keeper to capture said at least one keeper at a fixed location on said first strap portion near said first ring.

19. A safety connector according to claim 18, wherein said first strap portion has a tip located distally from said first ring, wherein a length of said first strap portion extends between said first ring and said tip of said first strap portion, and wherein said first portion of hook-and-loop fastener is provided on said length of said first strap portion intermediate said tip of said first strap portion and said at least one keeper.

20. A safety connector according to claim 19, wherein said complementary portion of hook-and-loop fastener has a back side and is provided with adhesive on said back side, wherein said adhesive is covered by a release liner that is peeled away in order to attach said complementary portion of hook-and-loop fastener to said third strap portion.

21. The safety device according to claim 1, wherein said second portion of a hook-and-loop fastener has a length, wherein said at least one keeper is attached to said first strap portion, wherein a length of said second strap portion extending between said second portion of a hook-and-loop fastener and a tip of said second strap portion is at least long enough such that said second strap portion can extend through said at least one keeper when about two thirds of the length of said second portion of a hook-and-loop fastener is overlapping and in engagement with said first portion of a hook-and-loop fastener to thereby allow the amount of engagement between said second portion of a hook-and-loop fastener and said first portion of a hook-and-loop fastener to be varied over a range of from about full engagement to about two thirds engagement, in terms of a portion of the length of said second portion of a hook-and-loop fastener that overlaps and is in engagement with said first portion of a hook-and-loop fastener, to thereby allow the threshold tensile force for disengaging said first strap portion from said second strap portion to be adjusted to suit a user's needs or preferences.

22. A safety device for use with control lines for guiding a horse, the control lines including at least a first control line and a second control line, the first control line having a head portion, the second control line having a head portion, the first control line being usable for guiding the horse to one of the left and the right directions, the second control line being usable for guiding the horse to the other of the left and the right directions, the safety device comprising:

a first strap portion operably connected to one of the head portion of the first control line and the head portion of the second control line, said first strap portion having a first end and a second end, said first strap portion being operably connected to the one of the head portion of the first control line and the head portion of the second control line through said first end thereof, said second end of said first strap portion defining a tip of said first strap portion;

a second strap portion operably connected to the other of the head portion of the first control line and the head portion of the second control line, said second strap portion having a first end and a second end, said second strap portion being operably connected to the other of the head portion of the first control line and the head portion of the second control line through said first end thereof, said second end of said second strap portion defining a tip of said second strap portion;

a first portion of a hook-and-loop fastener attached to said first strap portion, said first portion of said hook-and-loop fastener being in the form of a panel lying flat against one side of said first strap portion, said first portion of a hook-and-loop fastener having a length;

a second portion of a hook-and-loop fastener attached to said second strap portion, said second portion of said hook-and-loop fastener being in the form of a panel lying flat against one side of said second strap portion, said second portion of a hook-and-loop fastener having a length; and at least one keeper received for sliding movement on one of said first strap portion and said second strap portion, wherein when said first portion of said hook-and-loop fastener is fastened to said second portion of said hook-and-loop fastener, at least a portion of said one of said first strap portion and said second strap portion on which the keeper is received and the other of said first strap portion and said second strap portion extend through said at least one keeper, wherein a threshold tensile force required to separate the first strap portion and the second strap portion is lower than the tensile force that would be placed on the control lines for guiding a horse if a rider or driver entangled in the control lines for guiding a horse were to be dragged on the ground by the horse or a horse drawn vehicle, and wherein said keeper is movable by sliding along a length of said first strap portion and said second strap portion corresponding to at least a portion of the length of one of said first portion of a hook-and-loop fastener and said second portion of a hook-and-loop fastener to thereby allow the threshold tensile force for disengaging said first strap portion from said second strap portion to be adjusted to suit a user's needs or preferences by varying the position of said keeper along said length of said first strap portion and said second strap portion.

23. A safety device according to claim 22, wherein said keeper is received for sliding motion on said first strap portion, and wherein the safety device further comprises:

means for preventing said keeper from falling off said tip of said first strap portion.

24. A safety device according to claim 23, wherein said means for preventing said keeper from falling off said tip of said second strap portion comprises a structure selected from a portion of increased thickness provided on said first strap portion at a position located on a portion of said first strap portion extending from said first portion of a hook-and-loop fastener to said tip of said first strap portion, a portion of increased width provided in said first strap portion at a position located on a portion of said first strap portion extending from said first portion of a hook-and-loop fastener to said tip of said first strap portion, and a hook provided on said first strap portion at a position located on a portion of said first strap portion extending from said first portion of a hook-and-loop fastener to said tip of said first strap portion.

25. A safety device according to claim 23, wherein the safety device further comprises:

means for limiting sliding movement of said keeper, said means for limiting sliding movement of said keeper limiting sliding movement of said keeper to a portion of said first strap portion that at least in part overlaps a portion of said first portion of a hook-and-loop fastener, wherein said means for preventing said keeper from falling off said tip of said first strap portion forms part of said means for limiting sliding movement of said keeper.

26. A safety device according to claim 25, wherein said means for limiting sliding movement of said keeper comprises a first portion of increased thickness provided on said first strap portion and a second portion of increased thickness provided on said first strap portion at a position located a distance apart from said first portion of increased thickness and with at least a portion of said first portion of a hook-and-loop fastener positioned intermediate said first portion of increased thickness and said second portion of increased thickness, wherein said first portion of increased thickness and said second portion of increased thickness project outward on an opposite side of said first strap portion in relation to said first portion of a hook-and-loop fastener.

27. A safety device according to claim 25, wherein said means for limiting sliding movement of said keeper comprises a first portion of increased width provided on said first strap portion and a second portion of increased width provided on said first strap portion at a position located a distance apart from said first portion of increased width and with at least a portion of said first portion of a hook-and-loop fastener positioned intermediate said first portion of increased width and said second portion of increased width.

28. A safety device according to claim 25, wherein said means for limiting sliding movement of said keeper comprises a first hook provided on said first strap portion and a second hook provided on said first strap portion at a position located a distance apart from said first hook and with at least a portion of said first portion of a hook-and-loop fastener positioned intermediate said first hook and said second hook, wherein said first hook and said second hook project outward on an opposite side of said first strap portion in relation to said first portion of a hook-and-loop fastener.

29. A safety device according to claim 25, wherein said means for limiting sliding movement of said keeper comprises an elongated slot formed between first and second layers of said first strap portion, said keeper passing between said first and second layers of said first strap portion, said first and second layers of said second strap portion being attached together at first and second spaced apart positions along said first strap portion to captivate said keeper on said first strap portion while allowing said keeper to move between said first and second spaced apart positions, which define the ends of said elongated slot, and wherein at least a portion of said first portion of a hook-and-loop fastener is positioned intermediate said first and second spaced apart positions on an outer surface of said first strap portion.

30. A safety device according to claim 25, wherein said means for limiting sliding movement of said keeper comprises an elongated slot formed between a captivating strap and said first strap portion, said keeper passing between said captivating strap and said first strap portion, said captivating strap having first and second ends, said captivating strap being attached to said first strap portion at said first and second ends of said captivating strap to captivate said keeper on said first strap portion while allowing said keeper to move between said first and second ends of said captivating strap, which define the ends of said elongated slot, and wherein at least a portion of said first portion of a hook-and-loop fastener is positioned intermediate said first and second ends of said captivating strap outside said elongated slot such that said keeper can move over said at least a portion of said first portion of a hook-and-loop fastener.

* * * * *